US010447000B2

(12) United States Patent
Frederick et al.

(10) Patent No.: US 10,447,000 B2
(45) **Date of Patent: *Oct. 15, 2019**

(54) SPRING CONNECTORS WITH ADJUSTABLE GROOVES AND RELATED METHODS

(71) Applicant: Bal Seal Engineering, Inc., Foothill Ranch, CA (US)

(72) Inventors: Jeff Frederick, Los Angeles, CA (US); Derek Changsrivong, Costa Mesa, CA (US); Pere Pla-Junca, Coral Gables, FL (US); Peter J. Balsells, Newport Beach, CA (US); Richard Dawson, Orange, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 174 days.

This patent is subject to a terminal disclaimer.

(21) Appl. No.: 15/839,537

(22) Filed: Dec. 12, 2017

(65) Prior Publication Data

US 2018/0115133 A1 Apr. 26, 2018

Related U.S. Application Data

(63) Continuation of application No. 14/094,647, filed on Dec. 2, 2013, now Pat. No. 9,882,332.
(Continued)

(51) Int. Cl.
*H01R 4/48* (2006.01)
*H01R 43/26* (2006.01)
(Continued)

(52) U.S. Cl.
CPC ..... *H01R 43/26* (2013.01); *H01R 4/4863* (2013.01); *H01R 13/187* (2013.01); *H01R 13/629* (2013.01); *Y10T 29/49117* (2015.01)

(58) Field of Classification Search
CPC .... H01R 4/4863; H01R 43/26; H01R 13/187; H01R 13/629; Y10T 29/49117
See application file for complete search history.

(56) References Cited

U.S. PATENT DOCUMENTS 3,174,500 A 3/1965 Johnson et al.
4,017,139 A 4/1977 Nelson
(Continued)

FOREIGN PATENT DOCUMENTS

CN 102593620 A 7/2012
DE 19807663 9/1999
(Continued)

OTHER PUBLICATIONS

International Search Report on related PCT Application No. PCT/US2013/072689 from International Searching Authority (KIPO) dated Mar. 25, 2014.
(Continued)

*Primary Examiner* — Amy Cohen Johnson
*Assistant Examiner* — Paul D Baillargeon
(74) *Attorney, Agent, or Firm* — Klein, O'Neil & Singh, LLP

(57) ABSTRACT

A connector assembly having a housing and a shaft; at least a groove in the housing or on the shaft; one of the housing and the shaft has a first component and a second component; there being at least a first groove configuration and a second groove configuration resulting from two different relative positions of the first and second components; the first and second groove configurations resulting in a first insertion force and a first removal force of the shaft into and from the housing and a second insertion force and a second removal force of the shaft into and from the housing, respectively.

27 Claims, 61 Drawing Sheets

Related U.S. Application Data

(60) Provisional application No. 61/732,167, filed on Nov. 30, 2012.

(51) Int. Cl.
*H01R 13/187* (2006.01)
*H01R 13/629* (2006.01)

(56) References Cited

U.S. PATENT DOCUMENTS

| | | | |
|---|---|---|---|
| 4,678,210 | A | 7/1987 | Balsells |
| 4,804,290 | A | 2/1989 | Balsells |
| 4,872,710 | A | 10/1989 | Konecny et al. |
| 4,941,846 | A | 7/1990 | Guimond et al. |
| 5,411,348 | A | 5/1995 | Balsells |
| 5,545,842 | A | 8/1996 | Balsells |
| 6,672,565 | B2 | 1/2004 | Russell |
| 6,692,286 | B1 | 2/2004 | De Cet |
| 6,824,415 | B2 | 11/2004 | Wlos |
| 6,835,084 | B2 | 12/2004 | Poon et al. |
| 7,513,788 | B2 | 4/2009 | Camelio |
| 7,538,289 | B2 | 5/2009 | Carroll |
| 7,695,302 | B2 | 4/2010 | Eissner et al. |
| 7,722,415 | B2 | 5/2010 | Changsrivong |
| 7,914,315 | B2 | 3/2011 | Kuhn et al. |
| 7,914,351 | B2 | 3/2011 | Balsells et al. |
| 7,972,158 | B2 | 7/2011 | Wild et al. |
| 8,052,459 | B2 | 11/2011 | Smith et al. |
| 8,096,842 | B2 | 1/2012 | Poon et al. |
| 8,297,662 | B2 | 10/2012 | Balsells |
| 8,308,167 | B2 | 11/2012 | Balsells et al. |
| 8,382,532 | B2 | 2/2013 | Sjostedt et al. |
| 8,491,346 | B2 | 7/2013 | Sjostedt et al. |
| 8,561,274 | B2 | 10/2013 | Balsells |
| 9,004,805 | B2 | 4/2015 | Changsrivong et al. |
| 9,267,526 | B2 | 2/2016 | Balsells |
| 9,284,970 | B2 | 3/2016 | Dilmaghanian et al. |
| 9,312,630 | B2 | 4/2016 | Huang |
| 9,482,255 | B2 | 11/2016 | Changsrivong et al. |
| 9,500,211 | B2 | 11/2016 | Changsrivong |
| 9,534,625 | B2 | 1/2017 | Balsells |
| 9,677,587 | B2 | 6/2017 | Changsrivong et al. |
| 9,882,332 | B2 * | 1/2018 | Frederick ..... H01R 13/187 |
| 2002/0122690 | A1 | 9/2002 | Poon et al. |
| 2003/0094812 | A1 | 5/2003 | Balsells |
| 2003/0096526 | A1 | 5/2003 | Balsells |
| 2003/0157846 | A1 | 8/2003 | Poon et al. |
| 2009/0160139 | A1 | 6/2009 | Balsells |
| 2009/0264003 | A1 | 10/2009 | Hertzler et al. |
| 2011/0280653 | A1 | 11/2011 | Sjostedt et al. |
| 2013/0149031 | A1 | 6/2013 | Changsrivong et al. |

FOREIGN PATENT DOCUMENTS

| | | | |
|---|---|---|---|
| EP | 0491626 | A1 | 6/1992 |
| EP | 0757201 | A1 | 2/1997 |
| GB | 2194298 | | 3/1988 |
| GB | 2320622 | A | 6/1998 |
| JP | 2006-526262 | | 11/2006 |
| KR | 10-2005-0077512 | | 8/2005 |
| WO | WO 03067713 | | 8/2003 |

OTHER PUBLICATIONS

Written Opinion on related PCT Application No. PCT/US2013/072689 from International Searching Authority (KIPO) dated Mar. 25, 2014.

Extended European Search Report from European Intellectual Property Office on related EP application (EP13858108.7) dated Jun. 29, 2016.

Examiner's Report on corresponding foreign application (EP Application No. 13858108.7) from the European Patent Office dated May 18, 2017.

* cited by examiner 100
110
188
190
102
108
108a
106
104
116
114
200
196
228
226

198
108b
202

194
192
121
150

108
108a
110
196

212
118
108a
102
108b
104

212
108a
214
108b
106

108
102
142
144
110
140
212
104
228
226

146
148
116
216
122
150
212

4

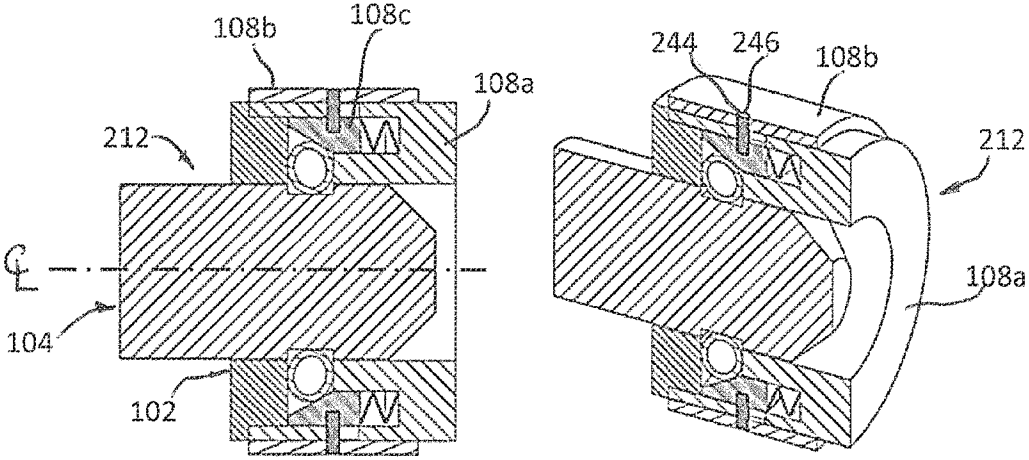
Fig.15A
Fig.15
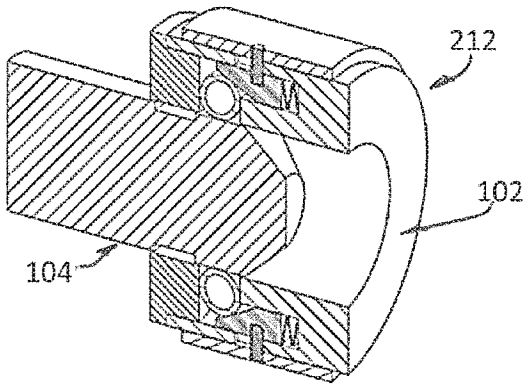
Fig.15C
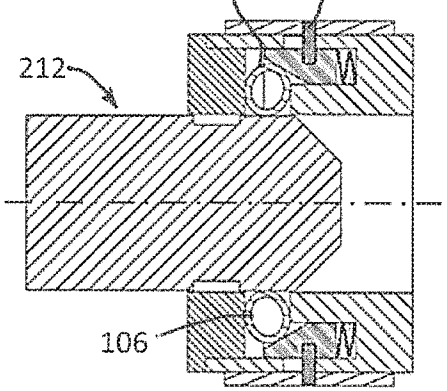
Fig.15B 108
102
130
110
112
104

212
108
202
104

110
116
106

192
116
250
102
198
212
104
254
150

240
104

142
144
146
148
240
252
212

228
226

212
106
240
212
116
102
116
102
252
212
104

240
104

104

146
148
106
212

228
226

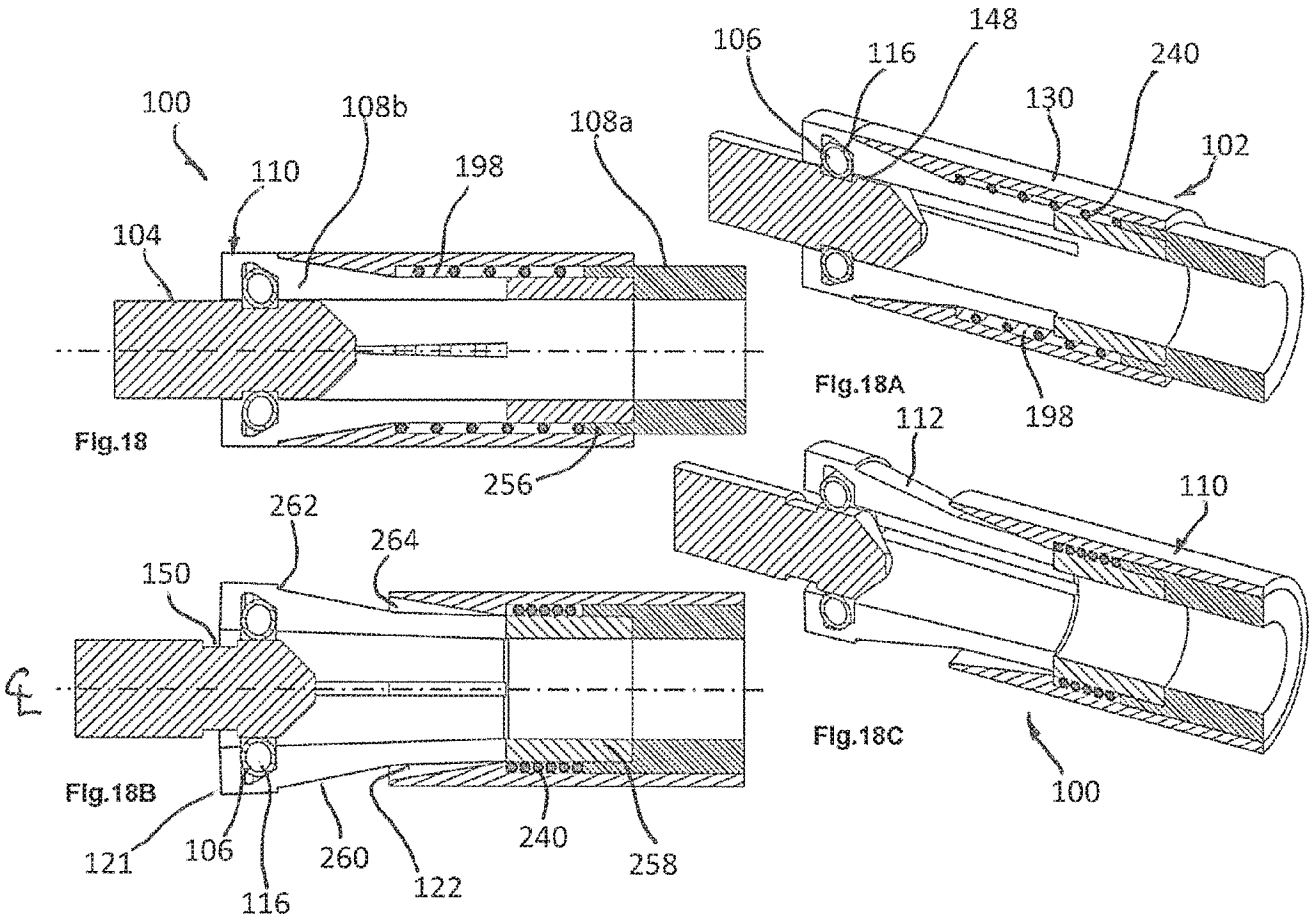
4

212
208
210
104

212
146
148
106
110
108

212
108
110
150

108
102
116
110
150
212
104

106
148
104

102
116
106
104
212

284
116
150
142

102
212
104
148

212
102
286
150
104

108
102
106
110
150
212
104

142
140
106
212

102
106
104
212

228
226

SPRING CONNECTORS WITH ADJUSTABLE GROOVES AND RELATED METHODS

FIELD OF THE ART

The present invention relates generally to connectors involving a housing, a pin, and a spring and related applications with particular discussions on spring connector assemblies in which a spring is used as a medium or structure to connect a pin to a housing with adjustable groove or grooves.

BACKGROUND

Spring connector assemblies are used in numerous industries. Connectors can be used as mechanical devices to secure two or more components together and/or as electrical connectors, to transmit current or signals through a pin, a housing, and a spring.

Conventional connectors may use canted coil springs as the medium to latch or lock a pin and a housing together. The canted coil spring may be retained in a housing groove or pin groove with a portion of the spring coils protruding out the groove. A corresponding groove in the other component is to receive the protruding spring section and achieve latching between the pin and housing. Exemplary prior art connectors are disclosed in U.S. Pat. Nos. 8,297,662 and 8,166,623.

Higher disconnect forces compared to connect forces can be accomplished by using different groove geometries, such as incorporating tapered sidewalls, angled groove bottoms, etc., and spring configurations, such as using an axial canted coil spring versus a radial canted coil spring.

SUMMARY

The present application describes spring connector assemblies comprising a housing, a shaft, and spring means confined in a cavity defined by at least a groove in the housing or on the shaft, the cavity having at least two differing configurations that influence the insertion and removal forces of the shaft into and from the housing.

Aspects of the present disclosure include a connector assembly comprising a housing and a shaft. The housing comprising a first housing component comprising a bore and an inner surface and a second housing component aligned with said first housing component along a longitudinal axis of said housing and the shaft comprising an outer surface. One of said housing inner surface and said shaft outer surface has a first groove. A spring is located within the first groove. A first shaft insertion force and a first shaft removal force resulting from a first groove configuration. Wherein relative movement of said first and second housing components changes said first groove configuration to a second groove configuration and wherein a second shaft insertion force and a second shaft removal force resulting from said second groove configuration, which differ from said first shaft insertion and removal forces, respectively.

The connector assembly wherein the first housing component can comprise elongated openings intersecting the first groove and defining elongated collapsible portions; wherein the second housing component can at least partially surrounds said elongated collapsible portions and biases them inwardly with respect to the longitudinal axis in the first groove configuration.

The connector assembly wherein the first housing component can comprise elongated openings intersecting the first groove and defining elongated collapsible portions; and wherein the second housing component can at least partially be inserted in the bore and biases said elongated collapsible portions outwardly with respect to the longitudinal axis in the second groove configuration.

The connector assembly wherein the first housing component can comprise a first subcomponent and a second subcomponent and relative movement of said first and second subcomponents along the longitudinal axis can be restrained by a biasing member.

The connector assembly wherein the spring can be a canted coil spring and the first and second housing components can sprung together.

The connector assembly wherein the spring can be a helical spring, a ribbon spring or a cantilever spring, and the first and second housing components can sprung together.

The connector assembly wherein a third component can at least partially surround the elongated collapsible portions preventing them from biasing outwardly with respect to the longitudinal axis in the first groove configuration.

The connector assembly wherein a third component can at least partially surround the elongated collapsible portions preventing them from biasing outwardly with respect to the longitudinal axis in the first cavity configuration.

The connector assembly wherein the first groove is formed with the housing and a shaft groove is formed on the shaft and wherein a common groove is defined by the first groove and the shaft groove.

A further aspect of the present disclosure is a connector assembly comprising a housing and a shaft. The housing comprising a first bore and an inner surface. The shaft comprising a first shaft component comprising an outer surface; and a second shaft component aligned with said first shaft component along a longitudinal axis of said shaft. One of said housing inner surface and shaft outer surface comprising a first groove. A spring is located within said first groove. A first shaft insertion force and a first shaft removal force resulting from a first groove configuration and wherein relative movement of said first and second shaft components changes said first groove configuration to a second groove configuration; a second shaft insertion force and a second shaft removal force resulting from said second groove configuration and differing from said first shaft insertion and removal forces, respectively.

The connector assembly wherein the first shaft component can comprise a second bore and elongated openings intersecting the first groove and defining elongated collapsible portions; and wherein the second shaft component can at least partially be inserted into said second bore and biases said elongated collapsible portions outwardly with respect to the longitudinal axis in the first groove configuration.

The connector assembly wherein the first shaft component can comprise a second bore, a first subcomponent and a second subcomponent; the relative movement of said first and second subcomponents along the longitudinal axis being restrained by a biasing member.

The connector assembly wherein the spring can be a canted coil spring and the first and second components can sprung together.

The connector assembly wherein the spring can be a helical spring, a ribbon spring or a cantilever spring, and the first and second components can sprung together.

The connector assembly wherein the first groove can form upon said housing and said shaft comprises a shaft groove that forms a common groove with said first groove.

The connector assembly wherein said second shaft component is located in a bore of said first shaft component and wherein a leverage pin is attached to the second shaft component and slidable within a slot on said first shaft component.

The connector assembly can further comprise a valve core located inside said housing.

A still further aspect of the present disclosure is a method of using a connector assembly comprising inserting a pin comprising a tapered insertion end and a pin groove into a bore of a housing comprising a housing groove; trapping a spring in a common groove defined by the pin groove and the housing groove in a first latched state; activating the pin or the housing to move the connector in a second latched state; wherein said activating step comprises moving at least two housing components axially relative to one another or moving at least two pin components axially relative to one another; and wherein a disconnect force at said second latched state is higher than a disconnect force at said first latched state.

The method can further comprise deflecting a plurality of collapsible members on the pin or on the housing in moving between the first latched state and the second latched state.

The method can further comprise a second spring located in an annular space between the two pin components or between the two housing components.

In still yet another example, a connector assembly comprising a housing and a shaft is provided. The housing comprising a first component comprising a bore and an inner surface; and a second component aligned with said first component along a longitudinal axis of said housing. A shaft comprising an outer surface. One of said housing inner surface and shaft outer surface comprising a first groove. Said first groove defining, at least in part, a cavity upon insertion of said shaft into said housing. Spring means is located within said cavity. A first shaft insertion force and a first shaft removal force resulting from a first cavity configuration, such as a first shaft groove, a first pin groove, or a first common groove. Wherein a relative movement of said first and second components changes said first cavity configuration to a second cavity configuration, such as to a second shaft groove, a second pin groove, or a second common groove. A second shaft insertion force and a second shaft removal force resulting from said second cavity configuration and differing from said first shaft insertion and removal forces, respectively.

The connector assembly wherein the first component can comprise elongated openings intersecting the first groove and defining elongated portions; wherein the second component at least partially surrounds said elongated portions and biases them inwardly with respect to the longitudinal axis in the first cavity configuration.

The connector assembly wherein the first component can comprise elongated openings intersecting the first groove and defining elongated portions; wherein the second component is at least partially inserted in the bore and biases said elongated portions outwardly with respect to the longitudinal axis in the second cavity configuration.

The connector assembly wherein the first component can comprise a first subcomponent and a second subcomponent, the relative movement of said first and second subcomponents along the longitudinal axis being restrained, and said second subcomponent being sectioned in multiple sections and comprising the first groove; wherein the second component is at least partially surrounding said second subcomponent in the first cavity configuration, and said multiple sections of said second subcomponent are positioned outwardly with respect to the longitudinal axis in the second cavity configuration compared to the position of said second subcomponent in the first cavity configuration.

The connector assembly wherein the first component can comprise a first subcomponent and a second subcomponent comprising the surfaces defining the first groove, the relative rotation of said first and second subcomponents around the longitudinal axis being restrained, and their relative movement along the longitudinal axis being influenced by the second component; wherein the first cavity configuration corresponds to a first relative position between said first and second subcomponents, and the second cavity configuration corresponds to a second relative position between said first and second subcomponents.

The connector assembly wherein the first and second components can be threaded together and the spring means consists of a canted coil spring.

The connector assembly wherein the first and second components can be threaded together and the spring means consists of one of a helical spring, a ribbon spring and a cantilever spring.

The connector assembly wherein the first and second components can sprung together and the spring means consists of a canted coil spring.

The connector assembly wherein the first and second components can sprung together and the spring means consists of one of a helical spring, a ribbon spring and a cantilever spring.

The connector assembly wherein the spring means can comprise a spring element and a sectioned element comprising multiple relatively rigid sections.

The connector assembly wherein the second component can restrain the movement of the multiple relatively rigid sections in a plane generally perpendicular to the longitudinal axis in the first cavity configuration.

The connector assembly wherein the spring element can comprise a canted coil spring and the first and second components are sprung together.

The connector assembly wherein the spring element can be one of a helical spring, a ribbon spring and a cantilever spring and the first and second components are sprung together.

The connector assembly wherein the spring element can be a canted coil spring and the first and second components are sprung together.

The connector assembly wherein the first component can comprise a first subcomponent and a second subcomponent comprising at least part of the surfaces defining the first groove; wherein the second component is engaged with at least said first subcomponent.

The connector assembly wherein the first and second subcomponents can sprung together and at least a third subcomponent engages the second component and the first subcomponent.

The connector assembly wherein the first and second subcomponents can sprung together and at least a third subcomponent engages the second component and the first subcomponent; wherein said third subcomponent is press fit in the first subcomponent.

The connector assembly wherein the first and second subcomponents can sprung together and at least a third subcomponent engages the second component and the first subcomponent; wherein said first and third subcomponents are threaded together.

A still further feature of the present disclosure is a connector assembly comprising a housing and a shaft. The housing comprising a first bore and an inner surface. The shaft comprising a first component comprising an outer surface and a second component aligned with said first component along a longitudinal axis of said shaft. One of said housing inner surface and shaft outer surface comprising a first groove. Said first groove defining, at least in part, a cavity upon insertion of said shaft into said housing. A spring means located within said cavity. A first shaft insertion force and a first shaft removal force resulting from a first cavity configuration and wherein a relative movement of said first and second components changes said first cavity configuration to a second cavity configuration; a second shaft insertion force and a second shaft removal force resulting from said second cavity configuration and differing from said first shaft insertion and removal forces, respectively.

Aspects of the present disclosure include a locking connector assembly comprising a shaft, a first housing, a canted coil spring, and a second housing.

The shaft can comprise a length and an outer surface with a shaft groove on the outer surface.

The first housing can have an opening with an inner surface and end surface, the opening being sized and shaped to receive a portion of the shaft and having a housing groove on the inner surface and recessed from the end surface.

The canted coil spring can comprise a plurality of coils located in the shaft groove and the housing groove of the first housing, the canted coil spring being located between the first housing and the shaft and the plurality of coils abutting the shaft groove and the housing groove to prevent the shaft from unlocking and separating from the first housing.

The second housing can be shaped to at least partially surround the first housing or an inner shaft shaped to project at least in part into the shaft.

The locking connector assembly can further include wherein the opening is cylindrical and wherein the housing groove is a circumferential groove.

The locking connector assembly can further include wherein the shaft groove is a circumferential groove.

The locking connector assembly can further include wherein a first end of the first housing with the end surface is radially deflectable.

The locking connector assembly can further include wherein the second housing has a structure to constrain the first end of the first housing from deflecting radially outward.

The locking connector assembly can further include wherein the first end of the first housing comprises a slit extending orthogonally relative to a medial plane of the groove.

The locking connector assembly can further include wherein the second housing has a first position and a second position and wherein when the housing is in the second position, the shaft is prevented from separating from the first housing.

The locking connector assembly can further include wherein when the housing is in the first position, the shaft is separable from the first housing.

The locking connector assembly can further include wherein the slit crosses through the groove.

Aspects of the present disclosure include a locking connector assembly comprising a shaft, a housing, and a canted coil spring.

The shaft can include a first shaft component having a length, an opening, an outer surface, and a shaft groove on the outer surface. The shaft can also include a second shaft component received, at least in part, in the opening of the first shaft component.

The housing can have an opening with an inner surface and an end surface, the opening of the housing sized and shaped to receive a portion of the shaft and having a housing groove recessed from the end surface.

The canted coil spring can comprise a plurality of coils located in the shaft groove and the housing groove of the first housing. The canted coil spring can be located between the housing and the shaft and the plurality of coils abutting the shaft groove and the housing groove to prevent the shaft from unlocking and separating from the housing.

The locking connector assembly can include wherein the shaft groove is circumferential.

The locking connector assembly can include wherein an end of the first shaft component is radially collapsible.

The locking connector assembly can include wherein the second shaft component is moveable in the opening of the first shaft component between a first position and a second position, and wherein when the second shaft component is in the second position, the first shaft component is constrained from collapsing radially inward.

The locking connector assembly can include wherein the end of the first shaft component comprises a slit extending orthogonally relative to a medial plane of the groove.

The locking connector assembly can include wherein each coil of the plurality of coils of the canted coil spring has a major axis and a minor axis and wherein the canted coil spring is loaded closer to the major axes of the plurality of coils than to the minor axes of the plurality of coils to prevent the shaft from unlocking and separating from the housing.

The locking connector assembly can include wherein the opening of the housing is cylindrical and wherein the housing groove is a circumferential groove.

The locking connector assembly can include wherein the second shaft component has a leverage pin extending outward perpendicular to an axis of movement of the second shaft component and through a second opening of the first shaft component.

The locking connector assembly can include wherein a plurality of wavy springs are placed in an annular space located between the first shaft component and the second shaft component.

Aspects of the present disclosure include a method of using a locking connector assembly.

The method can include inserting a canted coil spring into an opening of a first housing such that the canted coil spring is located in a housing groove of the first housing, said canted coil spring comprising a plurality of coils.

The method can include inserting a shaft comprising a length, an outer surface, and a shaft groove on the outer surface into the opening of the first housing, the opening sized and shaped to receive a portion of the shaft.

The method can include coupling a second housing to the first housing, the second housing being shaped to at least partially surround the first housing.

The method can include wherein the canted coil spring being located between the first housing and the shaft and the plurality of coils abutting the shaft groove and the housing groove to prevent the shaft from unlocking and separating from the housing.

The method can include wherein the opening is cylindrical and wherein the housing groove is a circumferential groove.

The method can include wherein the shaft groove is a circumferential groove.

The method can include wherein the first housing comprises a first end and a second end, said first end being closer to the housing groove than said second end, and wherein the first end of the first housing is radially deflectable.

The method can include wherein the second housing has a first position and a second position, wherein movement of the second housing from the first position to the second position constrains the first end of the first housing from deflecting radially outward.

The method can include wherein the first end of the first housing comprises a slit extending orthogonally relative to a medial plane of the housing groove.

The method can include wherein each coil of the plurality of coils of the canted coil spring has a major axis and a minor axis and wherein the canted coil spring is loaded closer to the major axes of the plurality of coils than to the minor axes of the plurality of coils to prevent the shaft from unlocking and separating from the housing.

The method can include wherein the slit crosses through the housing groove.

The method can include wherein the second housing is movable to prevent separation of the shaft from the first housing.

BRIEF DESCRIPTION OF DRAWINGS

These and other features and advantages of the present device, system, and method will become appreciated as the same becomes better understood with reference to the specification, claims and appended drawings wherein:

FIGS. 1-1, 1-1A, 1-1B, and 1-1C illustrate a an alternative connector assembly comprising a housing, a shaft and a canted coil spring, wherein the housing comprises two components and the assembly is shown in different stages of connect/disconnect.

FIGS. 14, 14A, 14B, 14C, 14D, 14E, 15, 15A, 15B, 15C, 15D, 15E, 16, 16A, 16B, 16C, 16D, and 16E illustrate similar connector assemblies comprising a housing, a shaft and a canted coil spring, wherein the housing comprises two components, one of them further comprising two subcomponents and the assemblies are shown in different stages of connect/disconnect.

FIGS. 17-1 and 17-1A show an alternative connector assembly comprising a housing, a shaft and a helical or ribbon spring, wherein the housing comprises two components and is similar to the connector of FIGS. 17, 17A, 17B, 17C, 17D, 17E, 17F, 17G, 17H, 17I, 17J, and 17K.

FIGS. 18, 18A, 18B, 18C, 18D, and 18E illustrate a connector assembly comprising a housing, a shaft and a canted coil spring, wherein the housing comprises two components and the assembly is shown in different stages of connect/disconnect.

FIGS. 21, 21A, 21-1, 21-1A, 21-2, 21-2A, 22, 22A, 22-1, 22-1A, 22-2, 22-2A, 23, 23-1, and 23-2 illustrate similar connector assemblies comprising a housing, a shaft and coil means, wherein the housing comprises two components and the assemblies are shown in different stages of connect/disconnect.

FIGS. 27-1, 27-1A, 27-1B, 27-1C, and 27-1D illustrate a connector assembly comprising a housing, a shaft and a canted coil spring, wherein the housing comprises two components that are threaded to one another and the assembly is shown in different stages of connect/disconnect.

DETAILED DESCRIPTION OF THE ILLUSTRATED EMBODIMENTS

The detailed description set forth below in connection with the appended drawings is intended as a description of the presently preferred embodiments of connectors provided in accordance with aspects of the present device, system, and method and is not intended to represent the only forms in which the present device, system, and method may be constructed or utilized. The description sets forth the features and the steps for constructing and using the embodiments of the present device, system, and method in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figures 1, 1A, 1B, 1C:
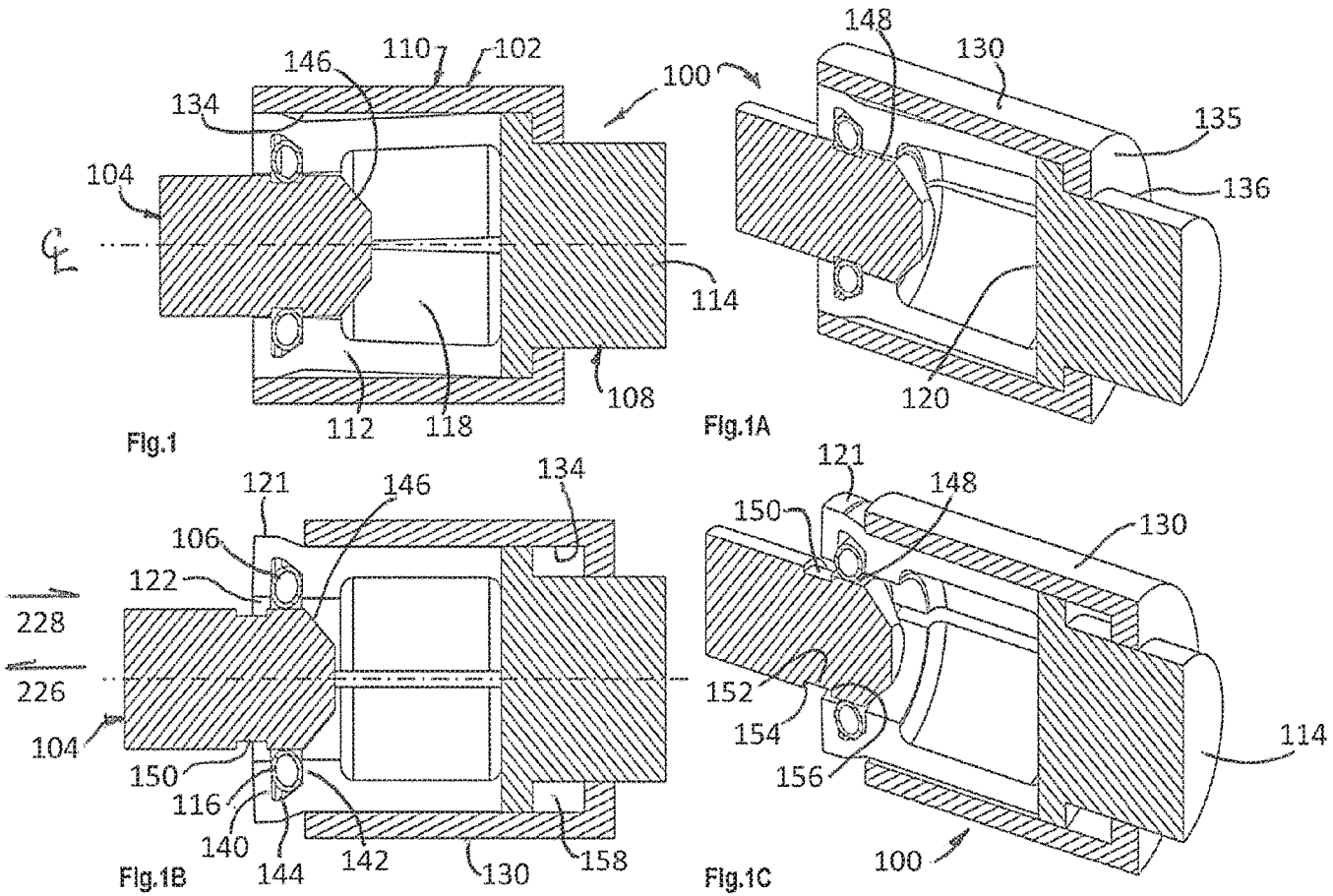
FIGS. 1, 1A, 1B, 1C, 1D, and 1E illustrate a connector assembly comprising a housing, a shaft and a canted coil spring, wherein the housing comprises two components and the assembly is shown in different stages of connect/disconnect.
Figure 1D:
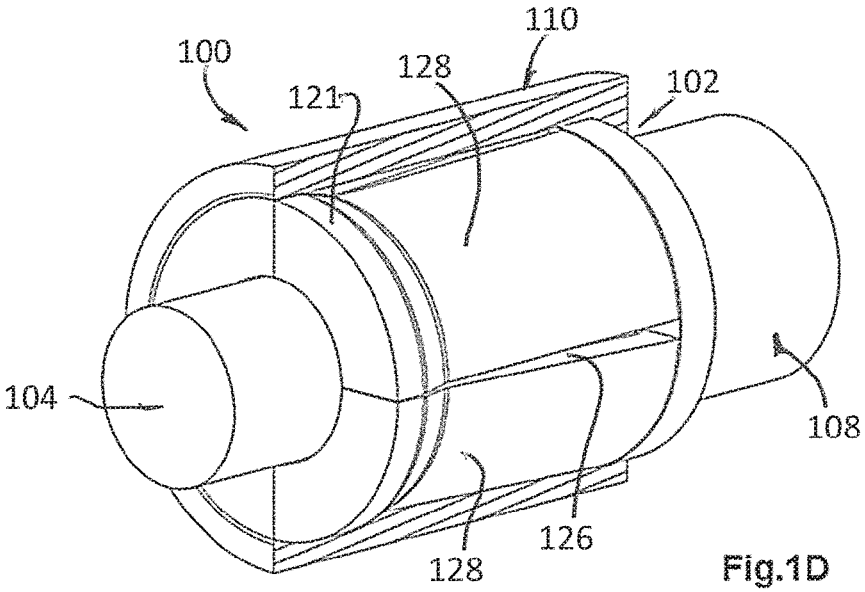
Figure 1E:
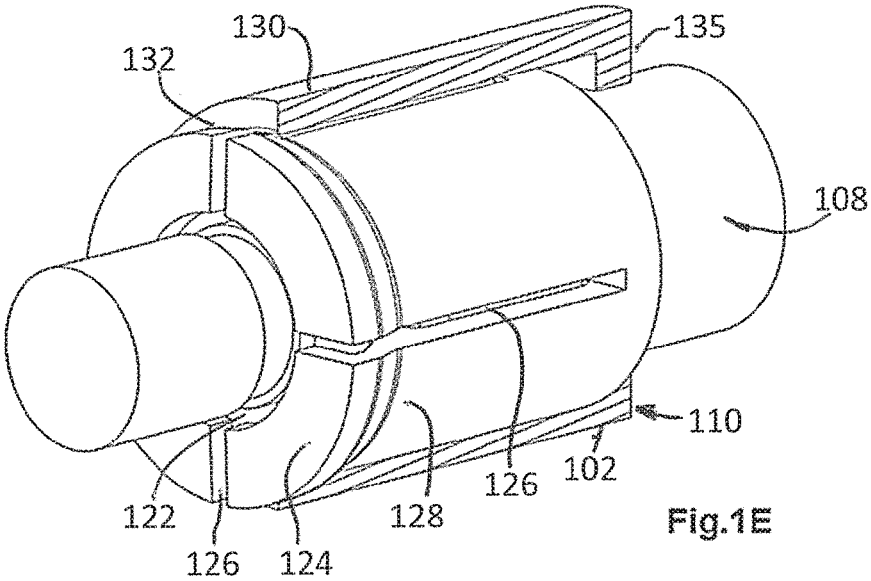
Figures 1, 1A:
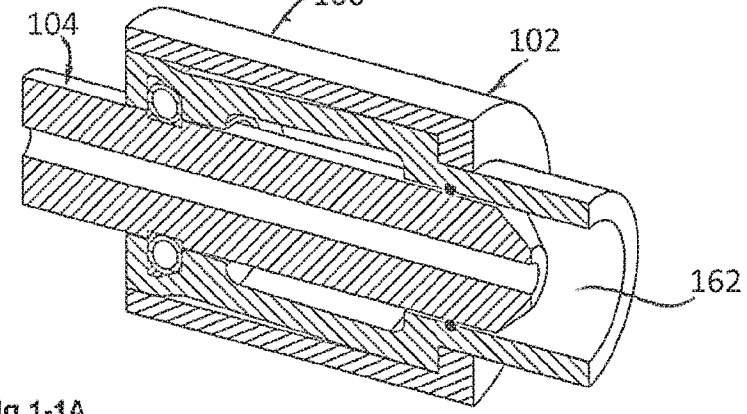
Figures 1, 1C:
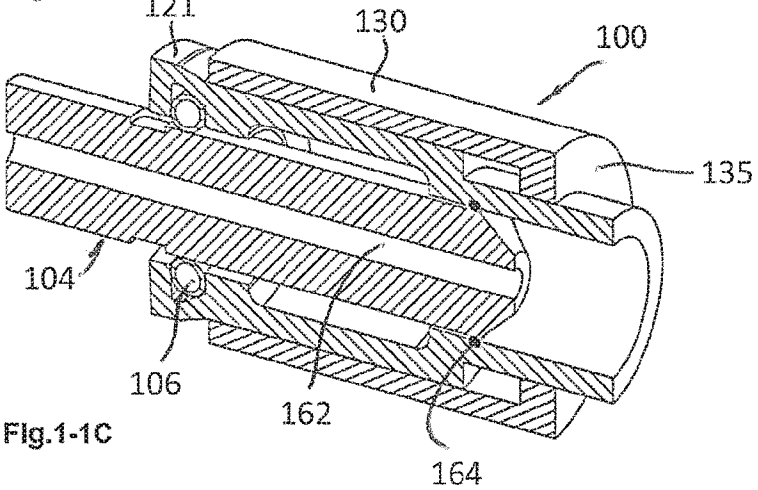
Figure 1:
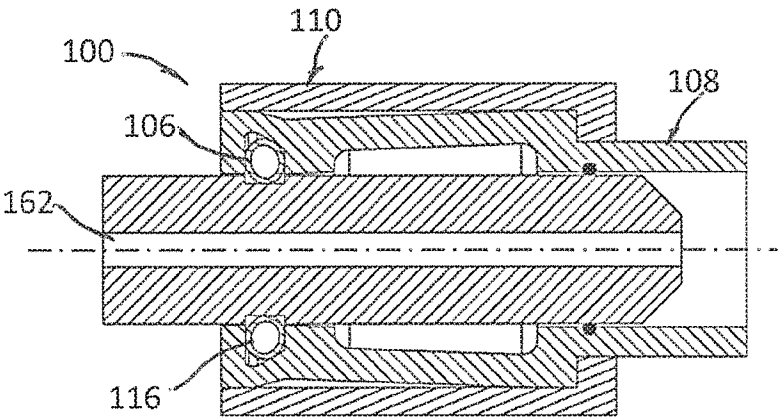
Figures 1, 1B:
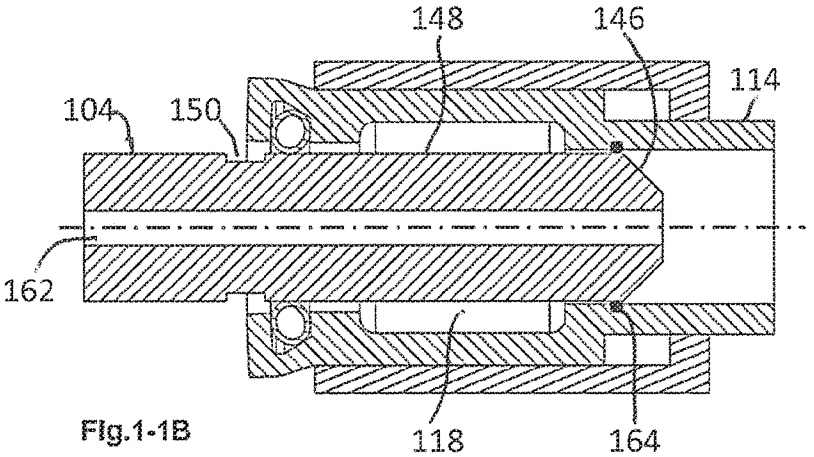

FIGS. 1 to 1E illustrate a connector assembly 100 comprising a housing 102 and a shaft 104, which may also be referred to as a pin, a rod, or a piston. Specifically, FIGS. 1, 1A and 1D show the connector assembly in a second latched or engaged state or position in which the spring is captured in a common groove and the first housing component 108 and the second housing component 110 activated. The housing 102 also has a first latched or engaged state or position in which the spring is captured by the common groove but the first housing component 108 and the second housing component 110 are not activated (not shown) so that the housing groove can change configuration. FIGS. 1B, 1C, and 1E show the connector assembly 100 either in the process of latching or in the process of separating after moving from the second latched state to the first latched state. FIGS. 1B, 1C, and 1E may also be referred to as a transit state or position. As shown, the housing 102 is a grooved housing and the shaft 104 is a grooved shaft, both having a respective a longitudinal axis formed along a respective centerline C. As shown in FIGS. 1 and 1B, the two centerlines are aligned along a common longitudinal axis, i.e., coaxial, and having a spring 106 disposed therebetween. In the example shown, the spring is a canted coil spring, such as an axial canted coil spring or a radial canted coil spring.

In an embodiment, the housing 102 comprises a first housing component or simply first component 108 and a second housing component or simply second component 110. The first component 108 comprises a body portion 112 and a stem 114. In one example, the body portion 112 and the stem are unitarily formed. In another embodiment, the body portion and the stem are separate components that are placed side-by-side or end-to-end. In the separate components embodiment, the two can be mechanically engaged or secured or welded together. As shown, the first component 108 comprises a housing groove 116 formed in a housing bore 118. The bore 118 can be a closed end bore and closed by an end wall 120, which may also be referred to as a flange. Optionally, the closed end wall 120 may have one or more openings or bores. The stem 114 extends axially of the end wall 120. In one example, the housing bore 118 has a varying internal bore diameter with different dimensions along the bore, as shown in FIGS. 1 and 1B. In other examples, the bore 118 has a constant or uniform internal dimension.

In one example, the body portion 112 comprises an elongated body portion having the hollow bore 118, which may also be referred to as a housing cavity. The body portion 112 is elongated and can have different shapes, which in the present embodiment is generally cylindrical, and comprises an enlarged exterior tapered end 121 at the inlet opening 122 thereof. The body portion 112 further comprises an end wall 124 at the inlet having an inlet opening 122 formed therethrough, as more clearly shown in FIG. 1E.

The body portion 112 is furcated and comprises at least two lengthwise slits or cut-outs 126 (FIGS. 1D and 1E). The at least two slits 126 define at least two collapsible housing sections 128, which may also be referred to as collapsible extending members or elongated portions. In the present embodiment, four slits 124 are formed through the body portion 112, including through the inlet end wall 124, along a length of the body portion 112 and up to or slightly short of the closed end wall 120. The four slits 126 define four collapsible housing sections 128. In other examples, three slits or more than four slits may be incorporated. Thus, the body portion 112 comprises a series of elongated portions 128 extending from a flange section 120 of the connector assembly and distributed around the longitudinal axis. The collapsible housing sections 128 allow the overall outer dimension of the body portion 112 to change from a first outer dimension to a smaller second outer dimension when the collapsible housing sections 128 are deflected inwardly towards the housing lengthwise axis. The elongated portions 128 may also expand to increase the outer dimension. As the housing groove is located internally of the collapsible housing sections 128, the housing groove can also change in size or configuration depending on the changes in the elongated portions.

In an example, the second component 110 comprises a partially closed enclosure comprising a body portion 130 comprising an open end 132 for receiving the first housing portion 108 in the cavity 134 thereof and a partially closed end 135 comprising an opening 136 having the stem 114 projecting therethrough. In an example, the cavity 134 of the body portion 130 comprises a generally constant internal diameter with a varying internal diameter contemplated.

With reference again to FIGS. 1B, 1C, and 1E, the canted coil spring 106 is first placed in the housing groove 116 prior to insertion of the shaft 104 into the bore 118 of the first housing portion 108. In other examples, the spring 106 may be pin mounted instead of housing mounted. The canted coil spring may be an axial canted coil spring with each coil of the plurality of coils comprising a major axis and a minor axis. The spring may be one of the springs disclosed in co-pending U.S. application Ser. No. 14/078,125, filed Nov. 12, 2013, or in U.S. Pat. Nos. 4,655,462, 4,826,144, 4,876,781, and 4,964,204, the contents of which are expressly incorporated herein by reference. In other examples, the spring 106 may be a radial canted coil spring.

In an example, the housing groove 116 comprises two sidewalls 140, 142, and a bottom wall 144 located therebetween. The sidewalls may be generally parallel to one another or tapered relative to the centerline ℄. The bottom wall 144 may have a single slanted section or multiple slanted sections. Part of the bottom wall 144 may also include a generally flat section, which can be parallel to the housing centerline. In other examples, the bottom wall 144 is generally flat. In still yet other examples, the housing groove 116 is a V-groove, with or without a flat bottom wall located between the slanted walls of the V-groove. The two slanted walls may also be non-symmetrical. Other housing groove geometries are also contemplated. Although not shown, prior to inserting the shaft 104 into the bore 118, the spring 106 is spaced from the bottom wall 144 of the housing groove 116. This allows the spring inside diameter to expand upon insertion of the shaft. In other words, the spaced relationship between the spring and the groove bottom wall 144 provides room for the spring to expand. In other examples, the spring 106 contacts the bottom wall 144 of the housing groove prior to the insertion of the shaft 104. Upon insertion of the shaft of the alternative embodiment in which the spring contacts the bottom wall, the spring rotates and deflects to accommodate for the girth of the shaft.

FIGS. 1B, 1C, and 1E show the shaft inserted into the bore 118 and the tapered inlet end 146 of the shaft 104 lifting and expanding the spring's internal diameter. The spring 106 is shown located at the landing area 148 between the tapered inlet end 146 and the pin groove or shaft groove 150. Further insertion of the pin 104 from the position shown will move the pin between the housing groove 116 and the pin groove 150 in a first engaged state (not shown) prior to activating the first housing component 108 and the second housing component 110. Said differently, the spring 106 is captured between a common groove defined by the housing groove 116 and the pin groove 150 but before both the pin 104 and the first housing component 108 move together further into the second component 110 to activate the first component and the second component. As a gap 158 is present between the flange 120 and the partially closed wall 135 in the first latched state (similar to the housing shown in FIG. 1B), the pin can readily retract away from the housing unless prevented otherwise, as further discussed below.

As shown, the pin groove 150 comprises a flat bottom wall 152 located between two sidewalls 154, 156. In other examples, the pin groove 150 has a different groove geometry, including a V-groove with or without a subtended bottom wall or two parallel sidewalls with a tapered bottom wall. Other groove geometries are contemplated. From the first engaged state (not shown), the pin 104 and the first housing 108 are moved together relative to the outer second housing 110 to move the connector to the second engaged or latched position, as shown in FIGS. 1, 1A, and 1E. In this position, the two housing components 108, 110 are bottomed out and the gap 158 has disappeared. In other examples, the bottoming out of the first and second housing components 108, 110 can be marked or referenced by different contact points or locations on the housing.

In the present embodiment, the second engaged or latched state or position of the connector assembly 100 is characterized by the collapsible elongated portions 128 being deflected by the outer second housing 110, the slits 126 being squeezed or reduced from their relaxed state, the enlarged exterior end 121 being squeezed by the outer second housing 110, or combinations of all three conditions. These acts or functions are configured to constrain the housing groove in the second latched state to restrict separation of the pin from the housing. The second engaged or latched state of the connector assembly 100 is therefore characterized by the canted coil spring 106 being captured by a common groove and a multi-part housing being activated, such as shown in FIGS. 1B, 1C, and 1E to constrain the housing groove and therefore the common groove in the second latched state. In other examples, the second engaged or latched state of the connector assembly is characterized by the spring 106 being captured by a common groove and a multi-part pin being activated, as further discussed below.

The open end 132 of the body portion 130 of the second section 110 has an inlet dimension or inlet opening that is smaller than the largest outer dimension of the enlarged exterior end 121 of the first housing section 108. This allows the second section 110 to compress the first housing section 108 when activated. Said differently, for the enlarged exterior end 121 to fit within the inlet opening of the second housing section 110, the collapsible sections 128 must deflect inwardly towards the lengthwise axis of the housing. Thus, in the second latched state (FIGS. 1, 1A, 1D), the body portion 130 of the second housing 110 surrounds the elongated portions 128 formed by the slits 126 and biases them inwardly, as more clearly shown in FIG. 1D. This second latched state results in a second shaft removal force to separate the shaft 104 from the housing 102, which is higher than the first shaft removal force when the spring is in the first engaged or latched state, i.e., when the spring 106 is in the common groove defined by the pin groove 150 and the housing groove 116 but before the first housing section 108 and the second housing section 110 are activated. In the present embodiment, the second engaged or latched state is also understood to result in the reduction of the housing groove dimension. For example, the dimension of the bottom wall 144 of the housing groove 116 at the first engaged or latched state is larger than the same measurement location when the connector assembly is in the second engaged or latched state, which is marked by inward deflections of the collapsible members 128. Thus, the second shaft removal force is higher than the first shaft removal force due to the reduction in the housing groove dimension at the second engaged configuration compared to the first engaged configuration, in which the housing groove is larger as the elongated members 128 are not squeezed by the outer housing 110. In other examples, the second latched position is marked by a groove geometry that is not reconfigurable. For example, when latched in the first state and moved to the second state, the housing groove geometry stays the same but the housing activation prevents the groove geometry from changing until the housing is de-activated.

In the transit configuration, position, or state shown in FIGS. 1B, 1C, and 1E, the second component 110 surrounds the body portion 112 but allows the collapsible housing sections 128 to restore their unconstrained position, as more clearly shown in FIG. 1E. Prior to inserting the pin 104 into the inlet opening 122 of the second component 110, the housing 102 appears the same as shown in FIGS. 1B, 1C, and 1E.

The figures show the first component 108 and the second component 110 being engaged to one another via frictional contact surfaces. In other examples, as further discussed below, the two components are threaded and advancement of one component relative to the other requires a clockwise or a counter-clockwise rotation of one of the housing components. A gap 158 between the partially closed wall 135 of the second housing section 110 and the flange 120 of the first housing section 108 shown in FIG. 1B is reduced, closed, or taken up when the connector assembly moves from the first engaged configuration (not shown) to the second engaged configuration (FIGS. 1, 1A, 1D), which is also the activated configuration in which the multi-part component of the connector assembly is bottomed out. In an example, the interior surface of the second housing section 110 contacts the exterior surface of the first housing section 108 at least along the area at or near the enlarged exterior end 121 of the first housing section 108 to squeeze the first housing section 108 when activated. The interior surface of the second housing section 110 can also contact the first housing section 108 at the flange area 120. These two components 108, 110 may be threaded together instead, or sprung together by means of wavy springs, a Belleville spring or a helical spring, as examples. Other suitable engagement means to engage the two components 108, 110 is understood to fall within the scope of this application. FIGS. 1-1E show a housing mounted canted coil spring and a shaft having a shaft groove 150. However, the same connector assembly but wherein the shaft does not incorporate a groove also falls within the scope of this application, as well as the same connector assembly but having a shaft mounted canted coil spring instead of a housing mounting spring and wherein the housing can include or exclude a housing groove.

Thus, the present connector assembly is understood to have the following states in going through its connection and disconnection cycles: a pre-connected position in which the pin is spaced from the housing, a transit state in which the pin is inserted into the housing but not yet latched, a first latched position in which the spring is captured in the common groove but the first and second housing sections are not activated, a second latched position in which the spring is captured in the common groove and the first and second housing sections are activated, a first latched position following the second latched position in which the spring is captured in the common groove and the first and second housing sections are de-activated, a transit state in which the pin is retracted from the housing from the first latched state, and a complete removal of the pin from the housing. In other examples, the activation and de-activation are between a multi-part pin or shaft, as further discussed below. In other words, instead of activating and de-activating the housing, in other connector assemblies discussed elsewhere herein, the multi-part pin is activated and de-activated to move between a first latched state and a second latched state.

In one example, the first housing section 108 may be made from an elastomeric material, a polymeric, plastic material, or from a metal material. The slits 126 may be formed to allow increase or decrease in diameter of the first housing section, such as to allow for compressing the enlarged exterior end 121 to reduce the housing groove 116. The second housing component 110 may also be made from an elastomeric, polymeric, plastic material, or a metal material. The first and second housing sections 108, 110 may also be made from different materials. For example, the first housing section 108 may be made from a plastic material while the second housing section is made from a metal material.

Wire types usable herein to form the spring 106 include copper, copper alloy, aluminum, aluminum alloy, gold, gold alloy, silver, silver alloy, brass, and brass alloy. Additional wires include steel material, such as medical grade stainless steel, titanium, noble metals such as platinum or conventional implantable grade materials with noble metal coatings, such as platinum over stainless steel. The wire may also be a multi-metallic wire in which a base core material is surrounded by one or more other materials. In some examples, the spring has an inner core and an outer layer having different material compositions with the outer layer comprising at least one of platinum, iridium, rhodium, rhenium, ruthenium and palladium. The outer layer should have sufficient thickness to provide the spring with an electrical resistance that is within 20% or less of a spring made entirely of at least one of platinum, iridium, rhodium, rhenium, ruthenium and palladium. For electrical connector applications, the spring may be used with a housing and a pin or shaft made from stainless steel type 316L, MP35N, platinum-iridium, titanium or other conductive materials, including being plated or coated with a highly conductive metal, such as silver, copper, gold, and their alloys.

In use the pin 104 may be connected to a first source, device, or component and the housing 102 may be connected to a second source, device, or component to latch the two together and/or to transfer or transmit electricity or signal between the two sources, devices, or components. For example, the pin may be connected to a first hose section and the housing to a second hose section so that the two hose sections are joined when the pin and the housing are latched. The pin and the housing may also be connected to a power source and a circuit board to provide electric current between the two, as examples.

The connector assembly 100 is therefore understood to include a pin and a housing and a spring captured in a common groove that can have a range of deflection down to no deflection. For example, when the housing components are not fully activated, the groove geometry and deflect an amount that is less than when the housing has not been activated but more than when the housing has been activated. The disconnected force to remove the pin from the housing can also vary when the spring is captured in the common groove. The disconnect force can have the highest value when the housing is fully activated and the least when the housing is not activated. The disconnect force value can measure somewhere in between when the housing is partially activated. When the connector assembly utilizes a locking scheme to secure the pin to the housing in the second latched state, the greatest or highest disconnect force is understood to be equal to the force to destroy the spring to enable separation of the pin from the housing. When the connector assembly utilizes a latching scheme to secure the pin to the housing in the second latched state, the greatest or highest disconnect force is understood to be equal to the greatest force to disconnect the pin from the housing without destroying the spring. When the housing is not activated or only partially activated, the disconnect force is lower than the two referenced points.

For other connector embodiments disclosed herein below, it is understood that where a feature is shown but not expressly described and is otherwise the same or similar to the feature or features described elsewhere, such as above with reference to FIGS. 1-1E, the disclosed part or parts shown in the drawing figures but not expressly described because of redundancy may nonetheless be understood to be described or taught by the same or similar features expressly set forth in the text for the embodiments in which the feature or features are described, such as that of FIGS. 1-1E. Said differently, subsequent disclosures of the present application are built upon the foundation of earlier disclosures unless the context indicates otherwise. The disclosure is therefore understood to teach a person of ordinary skill in the art the disclosed embodiments and the features of the disclosed embodiments without having to repeat similar components and features in all embodiments. Said differently, the same or similar features shown in the following connectors incorporate the teachings of the embodiments of FIGS. 1-1E unless the context indicates otherwise. Thus, it is contemplated that later disclosed embodiments enjoy the benefits of earlier expressly described embodiments, such as features and structures of earlier described embodiments, unless the context indicates otherwise.

FIGS. 1-1 to 1-1C illustrate a connector assembly similar to the connector assembly of FIGS. 1 to 1E but wherein a lumen or passage 162 is provided through the shaft 104 and the housing to allow fluid to flow therethrough. An O-ring 164 is incorporated to provide sealing to prevent leakage into the bore area 118 of the housing 102. Depending on the fluid type and operating parameters, the housing and pin should be made from appropriate materials. For example, the pin and the housing may be connected to two different hose sections and the connector assembly functions as a coupling for allowing fluid to flow therethrough.

Figure 2A:
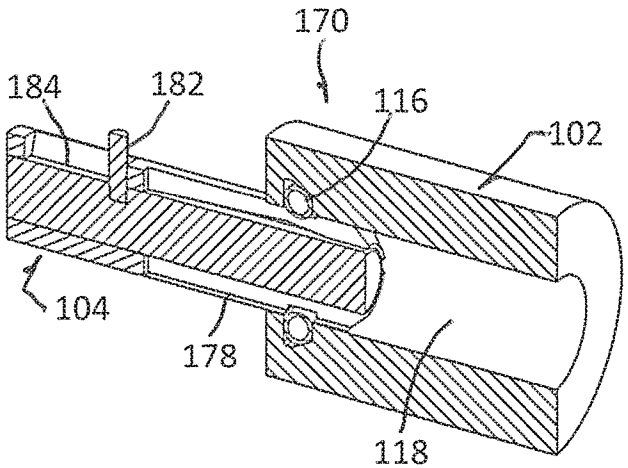
FIGS. 2, 2A, 2B, 2C, 2D, and 2E illustrate a connector assembly comprising a housing, a shaft and a canted coil spring, wherein the shaft comprises two components and the assembly is shown in different stages of connect/disconnect.
Figure 2C:
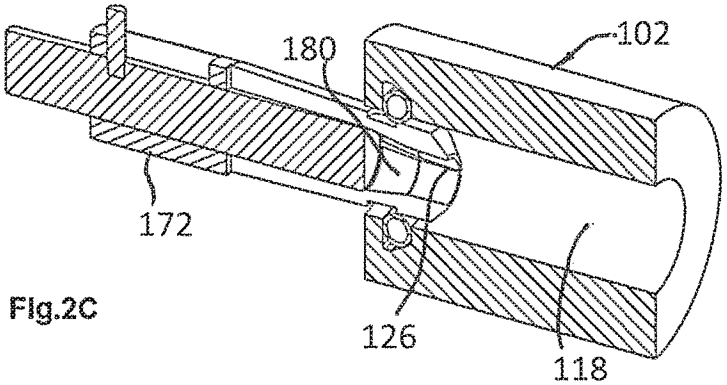
Figure 2:
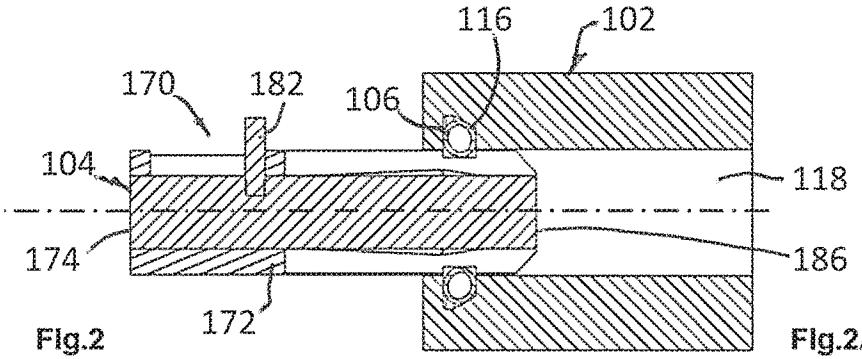
Figure 2B:
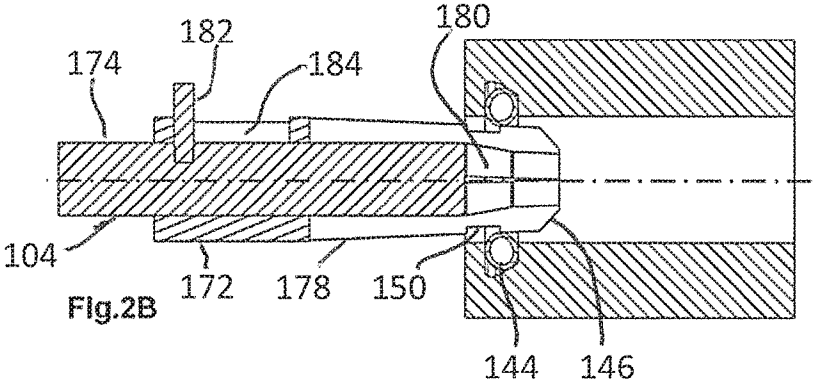
Figure 2D:
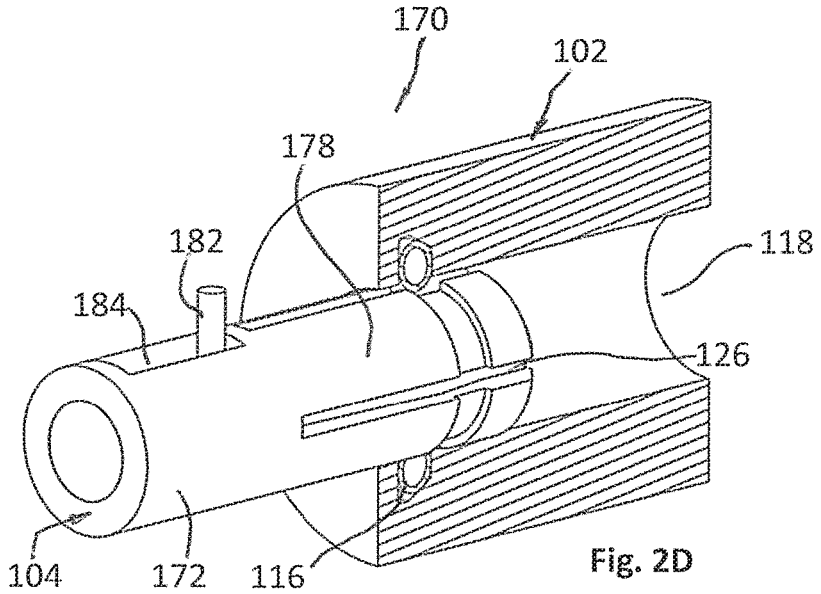
Figure 2E:
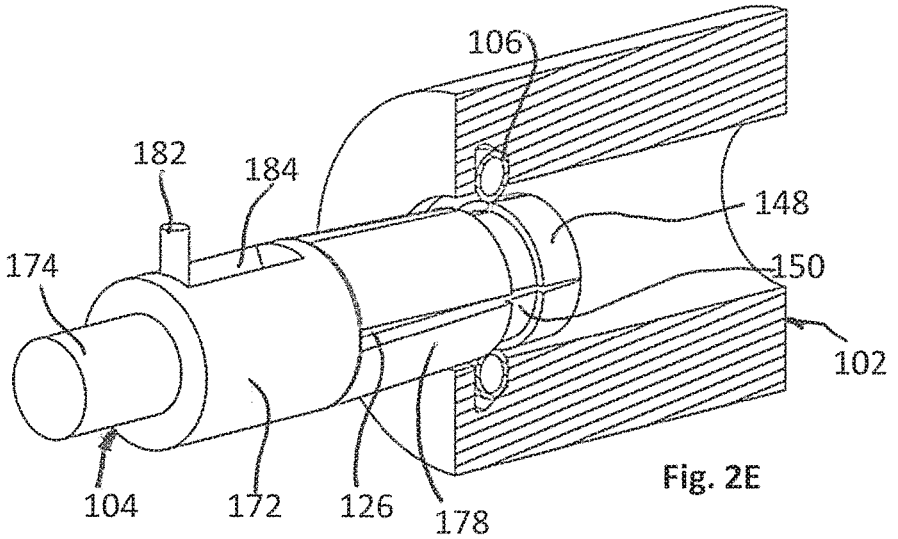

FIGS. 2 to 2E illustrate an alternative connector assembly 170 provided in accordance with aspects of the present invention, which shares similarities with the connector assembly 100 of FIGS. 1-1E with the following differences. In the present embodiment, the shaft 104 comprises a first shaft component 172 comprising a bore 180 and a shaft groove 150 and a second shaft component 174 slidably disposed within the first shaft component 172. The present connector assembly 170 has similar first and second latched positions as the connector of FIGS. 1-1E except the pin changes from a de-activated state to an activated state to move the connector between the first and the second latched positions as opposed to the first and the second housing sections, as further discussed below.

The first shaft component 172 is furcated and comprises at least two slits 126 (FIGS. 2D and 2E) defining at least two collapsible pin sections or elongated portions 178. In other examples, more than two slits may be provided to form more than two collapsible pin portions. As shown, there are four slits 126 and four collapsible pin portions 178. In the figures, FIGS. 2, 2A, and 2D show the connector in its second latched configuration in which the spring 106 is captured in a common groove defined by the housing groove 116 and the pin groove 150 and the multi-part shaft 104 has been activated. FIGS. 2B, 2C and 2E show the connector in its transit configuration. The present connector assembly 170 also has a first latched configuration (not shown) in which the spring 106 is captured in the common groove defined by the housing groove 116 and the pin groove 150 but wherein multi-part shaft 104 is de-activated. The present connector also has a transit state as shown in FIGS. 2B, 2C, and 2E, a pre-connected position, and a complete removal position.

As shown in FIGS. 2B, 2C, and 2E, the second component 174 is located in the shaft bore 180 of the first component 172 but the two are de-activated in that the second component 174 has not moved relative to the first component 172 to restrict the common groove from changing in configuration, such as change in size and/or shape. In the present example, the collapsible pin portions 178 are prevented from deflecting inwardly towards the lengthwise axis in the second latched state. In an example, a leverage pin 182 is provided with the second shaft component 174 to move the second shaft component 174 and to indicate the de-activated position of the shaft 104. The leverage pin 182 is movable within a slot 184 (FIG. 2E) provided in the first shaft portion 172 to facilitate moving the leverage pin 182 to move the shaft 104 to the activated position, as shown in FIG. 2. The leverage pin 182 may be threaded to or press fit into a bore formed in or on the second shaft component 174.

From the transit state shown in FIG. 2B, the pin 104 may further be inserted into the bore 118 of the housing 102 to move the connector to a first latched configuration (not shown). Note that the collapsible pin portions 178 of the first shaft component 172 deflect inwardly towards the longitudinal axis of the pin 104 as the spring 106 moves from the tapered inlet end 146 to the landing area 148 on the pin in moving the connector from a pre-connected state to the transit state shown. This allows the pin 104 to still be inserted into the housing 102 by providing clearance even if the canted coil spring is positioned in an orientation that does not allow the coils deflect or cant. The needed space for inserting the pin is provided by the collapsible members. Thus, the spring 106 may contact the groove bottom 144 in the pre-connected state and the pin 104 can still be inserted into the housing bore 118.

The pin 104 can then be activated by moving the leverage pin 182 within the slot 184 from its de-activated to its activated position at the forward position in the slot shown in FIG. 2 to move the connector assembly 170 to its second latched configuration. In this position, the forward end 186 of the second shaft section 174 is moved within the bore 180 to a location next to the slits 126 to prevent the collapsible pin portions 178 from deflecting and in effect form a temporary solid shaft 104 with the slits forming along an outer circumference with a solid core. The second latched configuration shown in FIG. 2 results in a shaft removal force that is higher than the shaft removal force when the connector is in the first latched configuration (not shown) in which the multi-part pin 104 has not been activated.

FIGS. 2-2E show the first shaft component 172 and second shaft component 174 being engaged via frictional contact surfaces. These two components may alternatively be threaded together, or sprung together by means of wavy springs, a Belleville spring or a helical spring, as examples. Other suitable engagement means fall within the scope of the present disclosure. The figures also show the housing 102 having two open ends with the housing bore 118 and a single component housing. The figures also show a groove on the shaft and a housing mounted canted coil spring. However, the same connector assembly may be practiced but wherein no groove in utilized on the shaft, as well as the same connector assembly but having a shaft mounted canted coil spring instead of a housing mounted spring configuration. In the shaft mounted spring configuration, the housing can include or not include a housing groove. The open end of the housing 102 may be attached to a pipe or some other structure. In other examples, the housing has one closed end.

Figure 3:
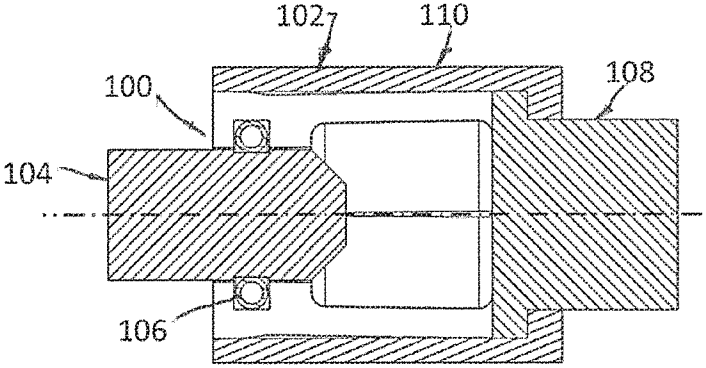
FIGS. 3, 3A, 3B, 3C, 3D, and 3E illustrate a connector assembly comprising a housing, a shaft and a helical or a ribbon spring, wherein the housing comprises two components and the assembly is shown in different stages of connect/disconnect.
Figure 3A:
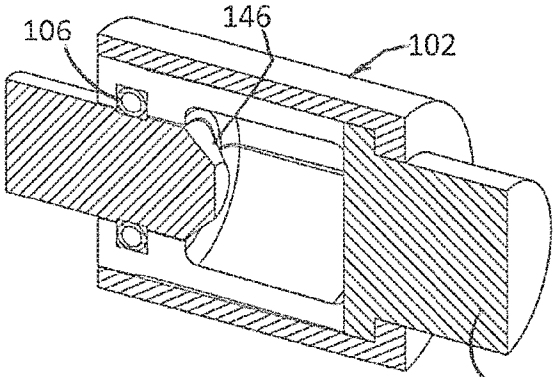
Figure 3B:
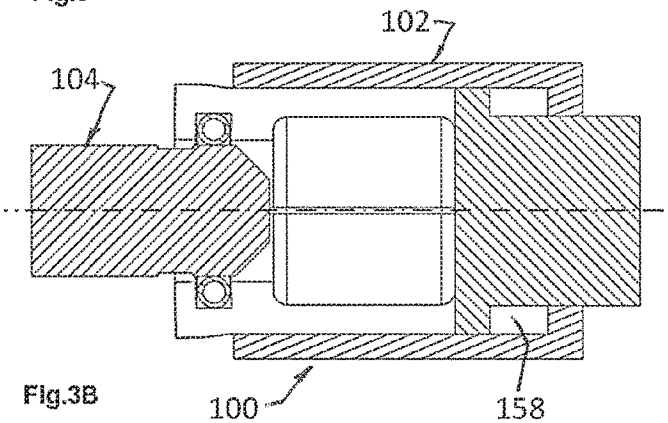
Figure 3C:
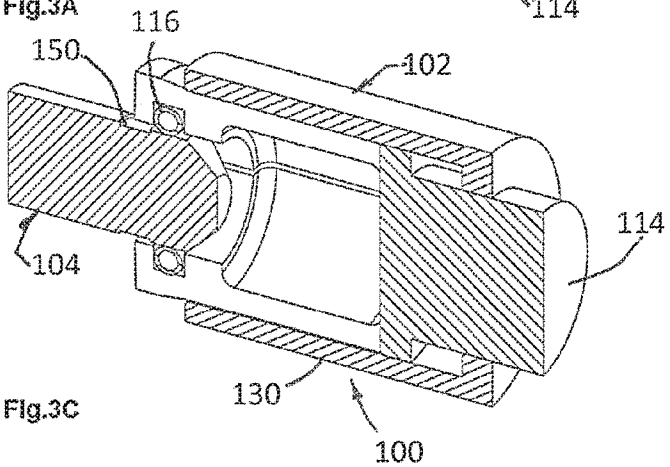
Figure 3D:
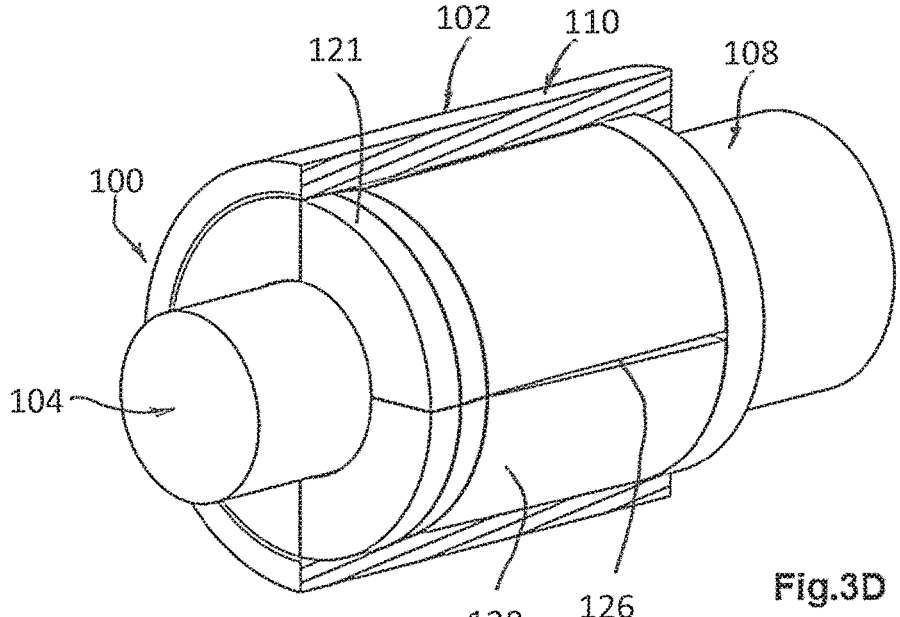
Figure 3E:
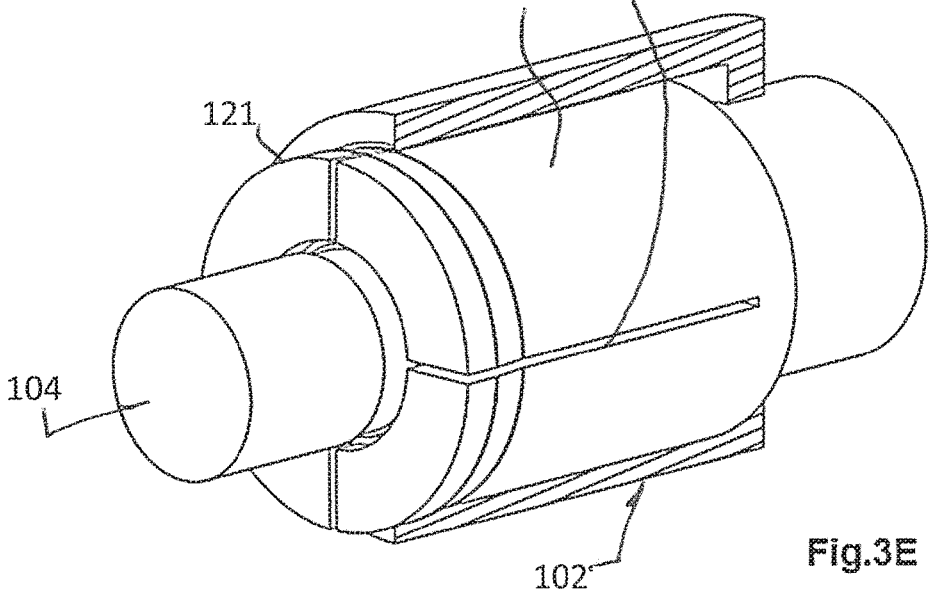

FIGS. 3 to 3E illustrate a connector assembly 100 similar to the connector assembly shown in FIGS. 1 to 1E but wherein the spring 106 is a helical spring or a ribbon spring instead of a canted coil spring. Other suitable types of springs, such as for example cantilever springs, fall within the scope of the present disclosure.

Figure 4A:
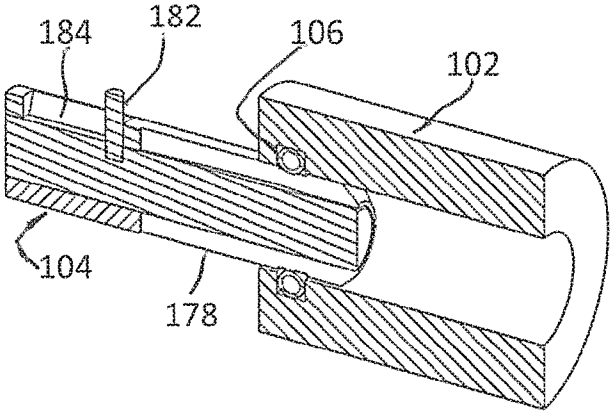
FIGS. 4, 4A, 4B, 4C, 4D, and 4E illustrate a connector assembly comprising a housing, a shaft and a helical or a ribbon spring, wherein the shaft comprises two components and the assembly is shown in different stages of connect/disconnect.
Figure 4:
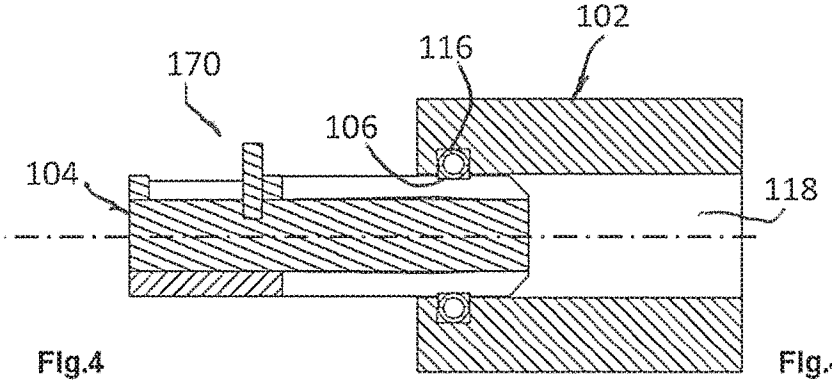
Figure 4C:
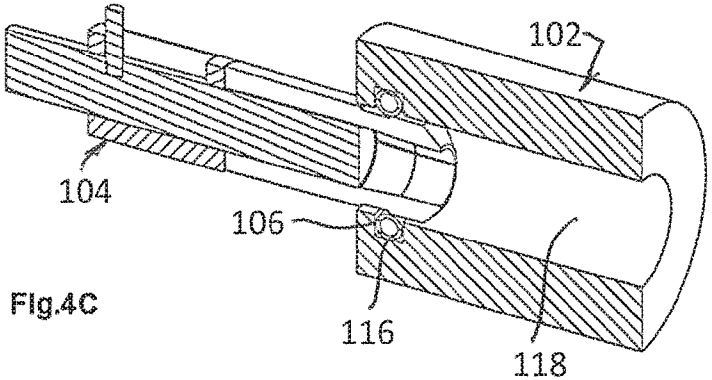
Figure 4B:
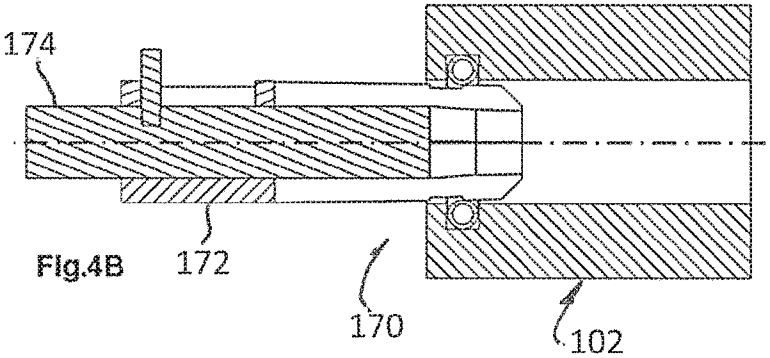
Figure 4D:
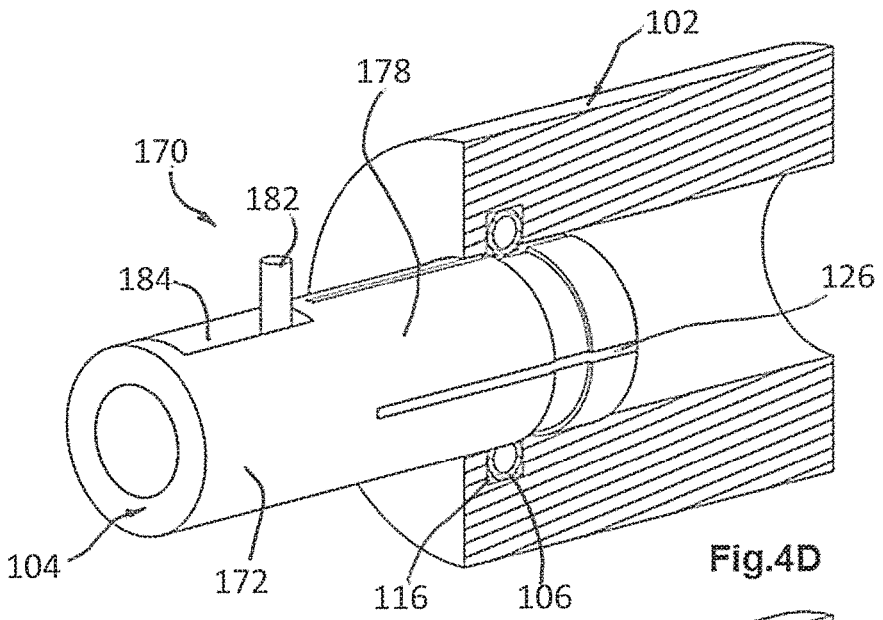
Figure 4E:
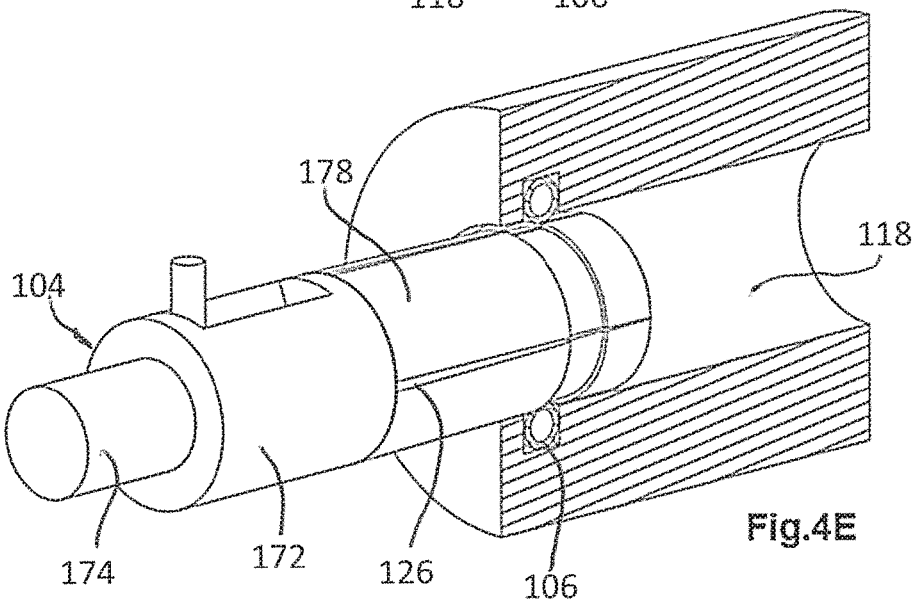

FIGS. 4 to 4E illustrate a connector assembly 170 similar to the connector assembly shown in FIGS. 2 to 2E but wherein the spring 106 is a helical spring or a ribbon spring instead of a canted coil spring. Other suitable types of springs, such as for example cantilever springs, fall within the scope of the present disclosure.

Figures 5, 5A, 5B, 5C:
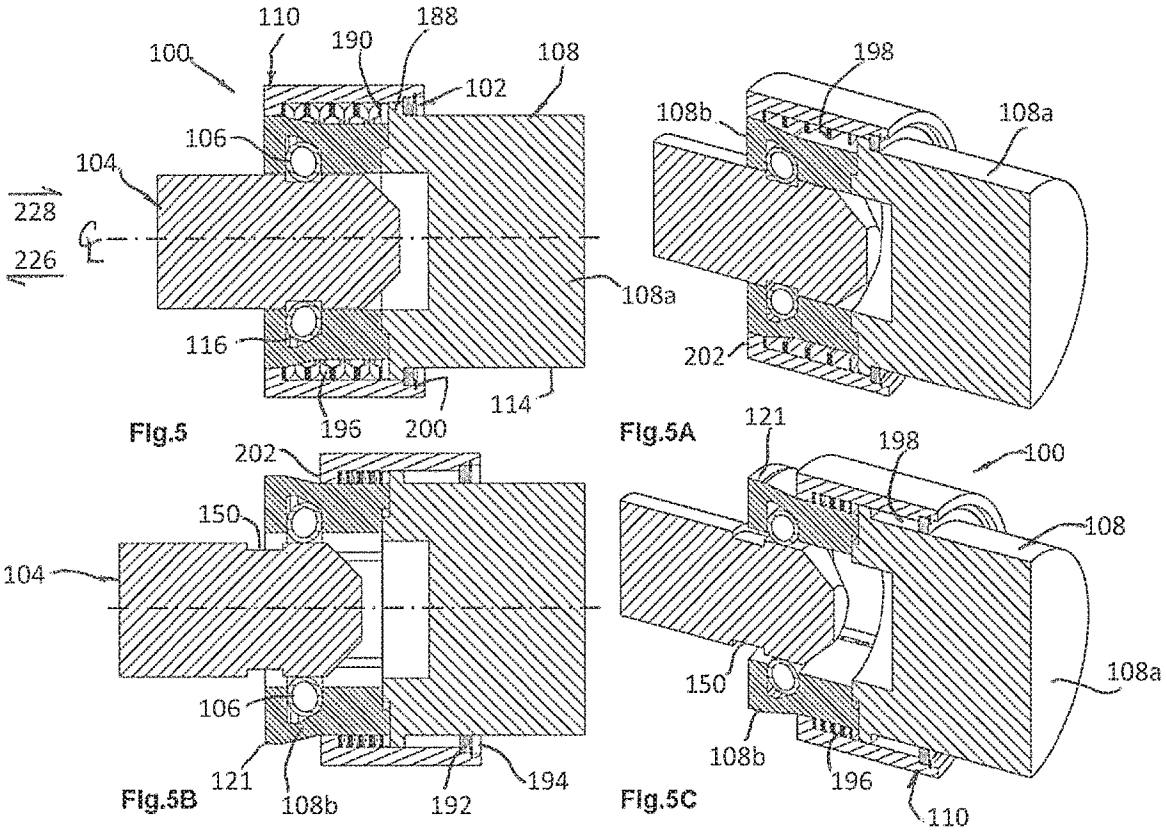
FIGS. 5, 5A, 5B, 5C, 5D, and 5E show a connector assembly comprising a housing, a shaft and a canted coil spring, wherein the housing comprises two components, one of them further comprising multiple subcomponents and the assembly is shown in different stages of connect/disconnect.
Figure 5D:
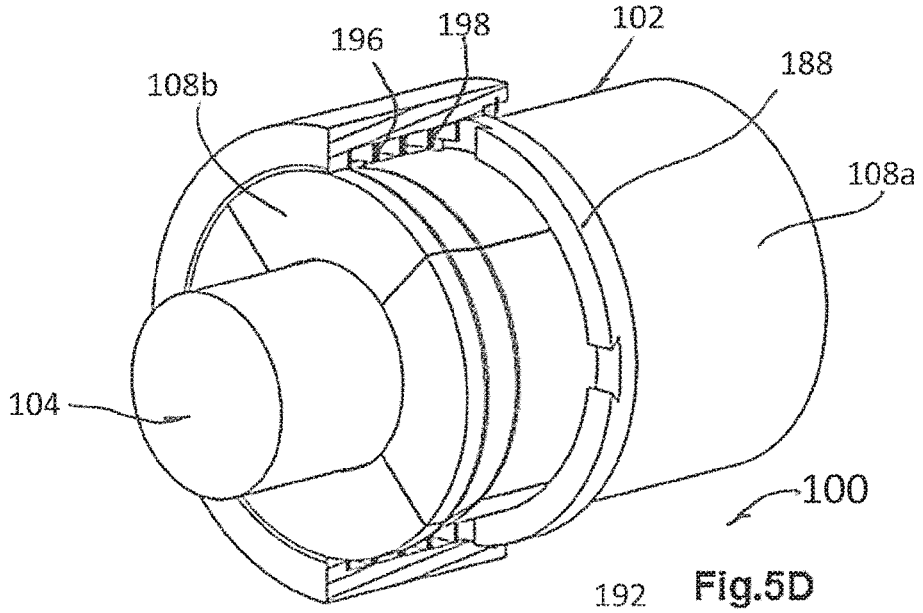
Figure 5E:
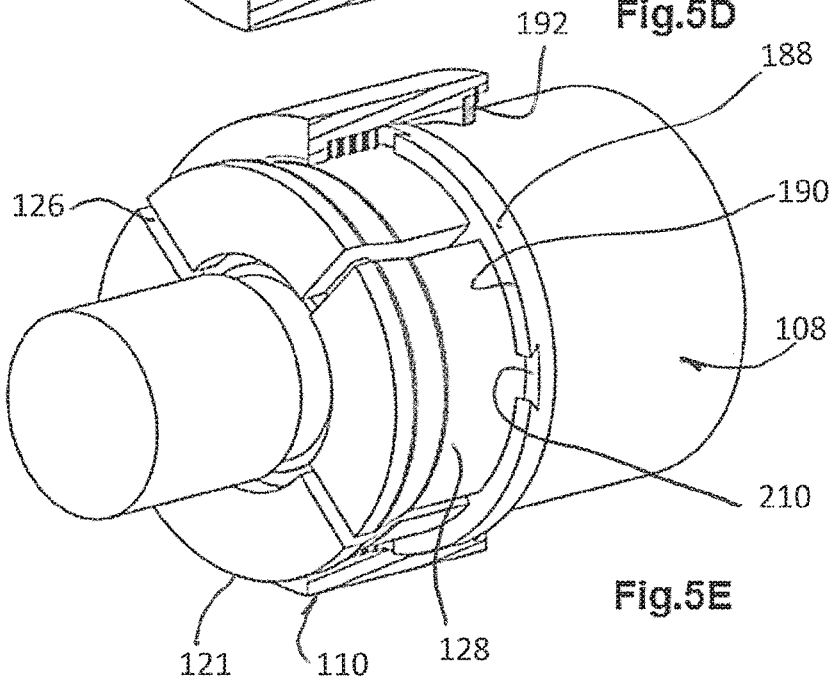

FIGS. 5 to 5E show a connector assembly 100 provided in accordance to an alternative aspect of the present device, system, and method. The present connector assembly 100 comprises a multi-piece or multi-component housing 102 and a shaft, rod or pin 104, similar to the connector assembly of FIGS. 1-1E. In the present embodiment, the relative movement between the first housing component 108 and the second housing component 110 along the longitudinal axis of the housing 102 is restrained.

As shown, first housing component 108 is sectioned into a first sub-section or sub-component 108*a* and a second sub-section or sub-component 108*b*. The first sub-section 108*a* comprises a stem 114 that projects out of the second housing section 110 and the second sub-section 108*b* comprises a housing groove 116. The first sub-section 108*a* further comprises an outwardly extending flange 188 comprising a push surface 190. The first and second sub-components 108*a*, 108*b* can have a simple non-engaging abutting contact with one another or can be engaged such as by fastening, threads, welding, detents, etc.

The second housing 110 has a retaining collar 192 that snap fit into a recessed space 194. Known securement can be employed to ensure against unwanted dislodgement of the collar from the housing 110, such as using a snap-ring 200 fitted into a retaining groove. The collar and the snap-ring may also be referred to as a ring and a Smalley ring. The collar provides access to allow a plurality of wavy springs 196 to be placed into an annular space 198 located between the first and second housing sections 108, 110. The flange 188 on the first housing section 108 is also located in the annular space and is closed therein by the retaining collar 192. In an alternative embodiment, the flange 188 is separately formed from the first housing section 108.

The present connector assembly 100 may operate the same as discussed above with reference to FIGS. 1-1E. The connector 100 also has a first latched state (not shown) and a second latched state (FIGS. 5, 5A and 5D). The present connector also has a transit state that differs when moving the connector 100 from the first latched state (not shown) in which the spring 106 is positioned in the common groove defined by the housing groove 116 and the pin groove 150 but prior to activation of the first housing section 108 and the second housing section 110 to the second latched state shown in FIGS. 5, 5A, and 5D, and in moving the connector from the second latched state back to the first latched state due to the wavy springs 196. Looking first at FIG. 5 to a first latched position just before FIG. 5B then at FIG. 5B, the force to de-activate the first and the second housing sections 108, 110 is opposed by the wavy springs 196. In other words, the wavy springs 196 must be compressed between the flange 188 and the end wall 202 during the de-activation step. Once the connector is at the first latched position, in which the housing 102 appears similar to that shown in FIG. 5B and the wavy springs 196 are compressed, the pin 104 can further be retracted to dislodge the spring 106 from the common groove to remove the pin 104, such as shown in FIG. 5B. Temporary holding means, such as a pin, a stop, or a course thread, may be used to hold the wavy springs 196 in the compressed state.

In reverse to move the connector from the first latched state to the second latched state (FIG. 5), the wavy springs 196 expand and assist with moving the pin 104 and the first housing section 108 relative to the second housing section 110. Thus, the transit state in one direction has a lower moving force than the transit state in the opposite direction due to the wavy springs 196. The transit state in which the wavy springs are compressed require a greater force than when the wavy springs expand to assist with separating the two housing components.

FIGS. 5-5E show the first and second housing components 108, 110 sprung together by means of wavy springs. Different type of springs may be considered, such as for example a Belleville spring or a helical spring. The two components 108, 110 may be threaded together instead, as further discussed below as a means for activating the two housing components relative to one another. Other suitable engagement means fall within the scope of this application. The figures also show a groove 150 on the shaft and a housing mounted canted coil spring 106. However, the same connector assembly but having no groove on the shaft also falls within the scope of this application, as well as the same connector assembly but having a shaft mounted canted coil spring instead, with and without a groove in the housing.

With reference specifically to FIGS. 5D and 5E, the flange 188 on the first sub-component 108*a* comprises a plurality of grooves 210 formed at the push surface 190. The grooves 210 are sized and shaped to keep the plurality of wavy springs 196 aligned in axially spaced apart positions along the outer circumference of the second sub-component 108*b*.

Figure 6A:
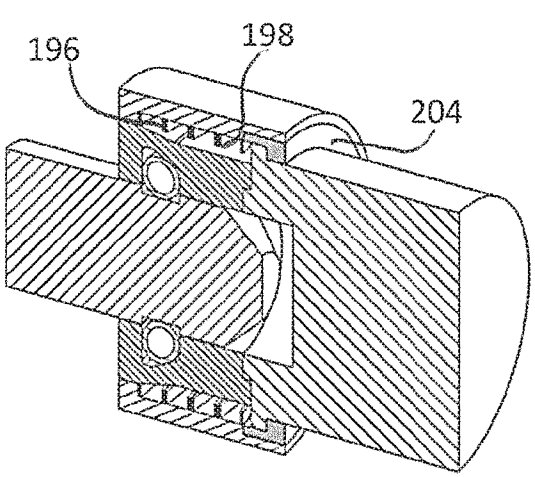
FIGS. 6, 6A, 6B, 6C, 6D, and 6E show the connector assembly shown in FIGS. 5 to 5E with a modification in the housing and the assembly is shown in different stages of connect/disconnect.
Figure 6C:
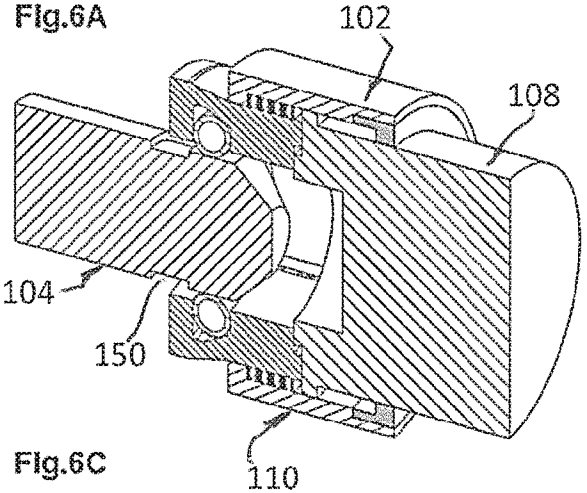
Figure 6:
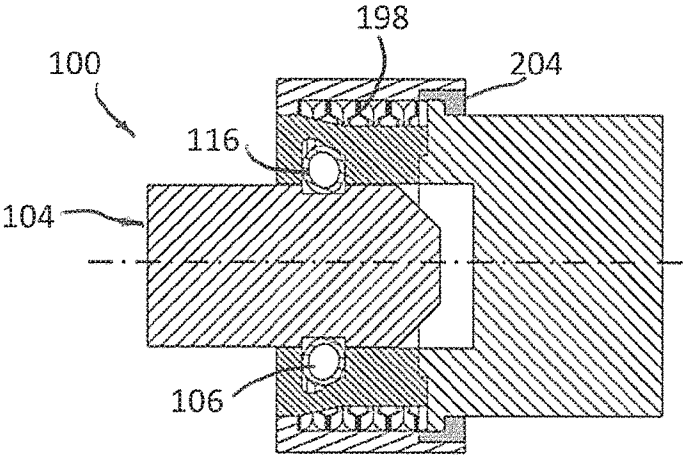
Figure 6B:
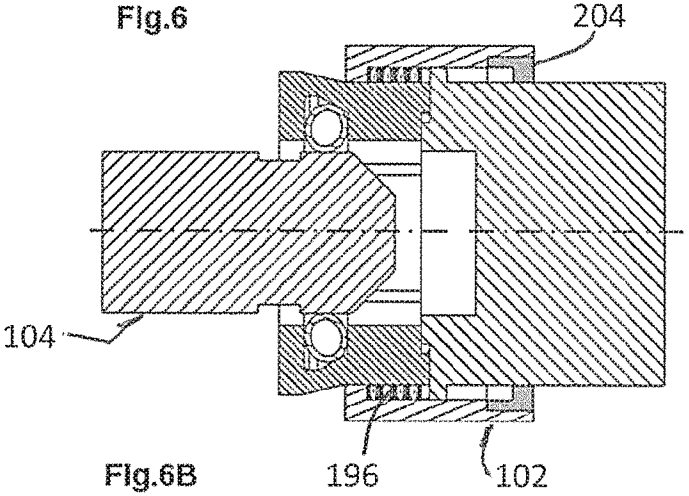
Figure 6D:
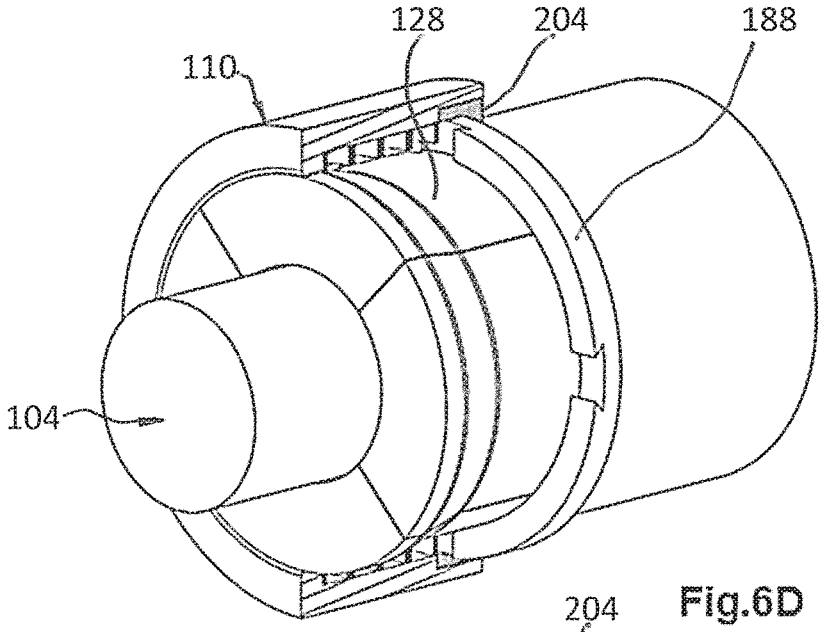
Figure 6E:
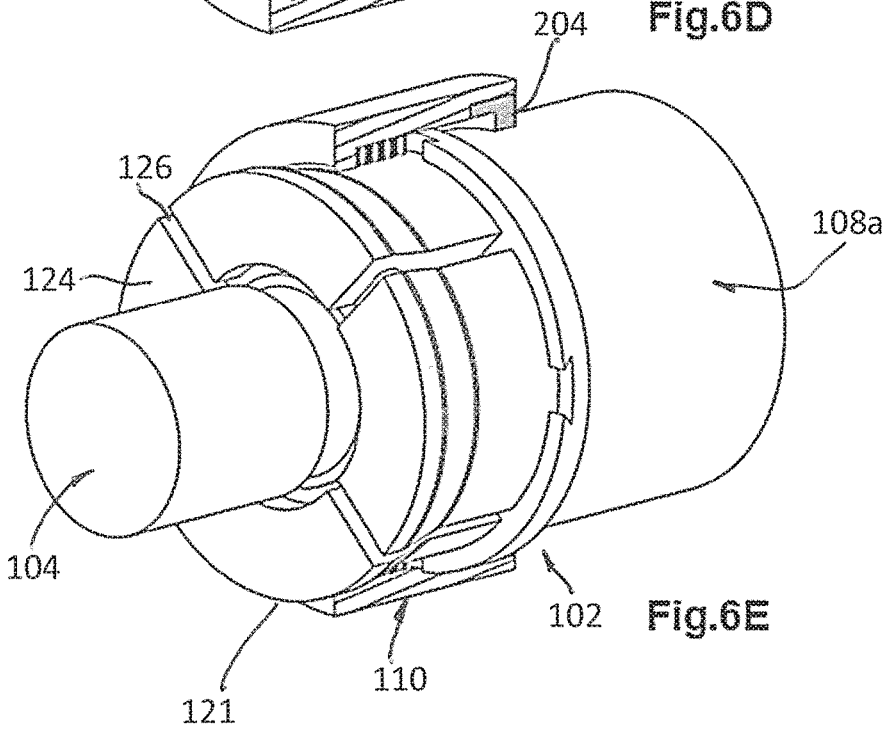

FIGS. 6 to 6E show a connector assembly 100 similar to the connector assembly shown in FIGS. 5 to 5E. In the present embodiment, the ring 192 and the Smalley ring 200 are replaced with a single retaining element 204. The second housing component 110 and the single retaining element 204 may be threaded together or the single retaining element may be press fit therein instead.

Figure 7A:
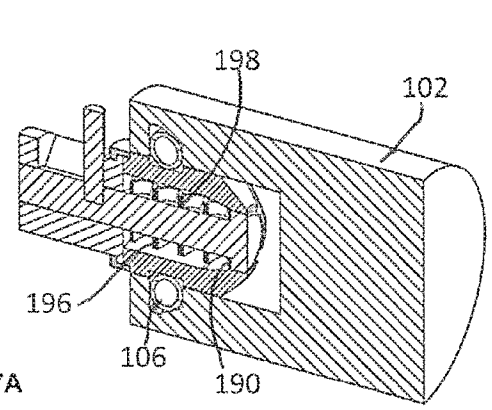
FIGS. 7, 7A, 7B, 7C, 7D, 7E, 7F, and 7G show a connector assembly comprising a housing, a shaft and a canted coil spring, wherein the shaft comprises two components, one of them further comprising multiple subcomponents and the assembly is shown in different stages of connect/disconnect.
Figure 7:
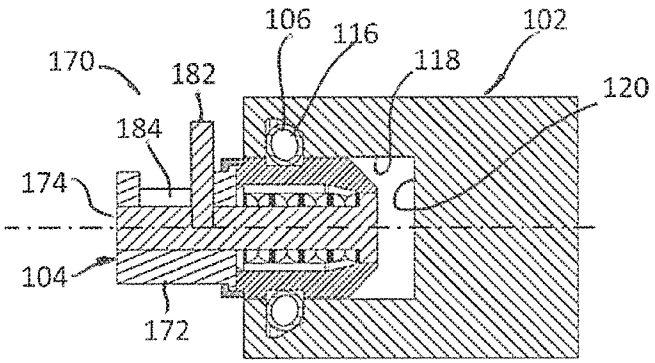
Figure 7C:
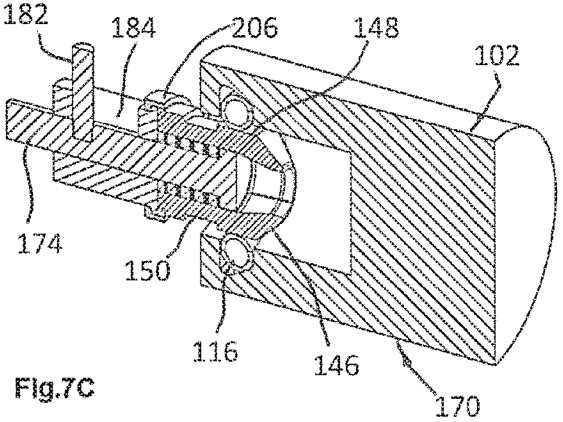
Figure 7B:
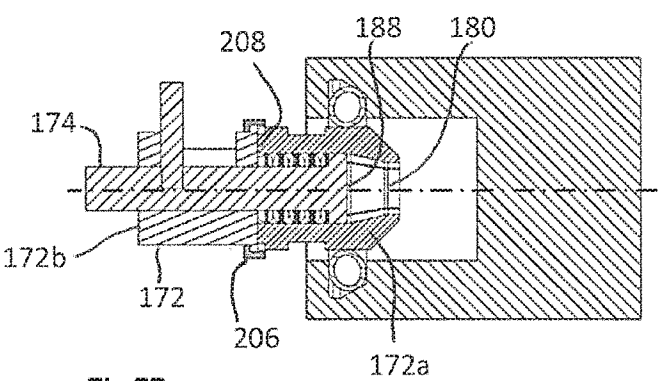
Figure 7E:
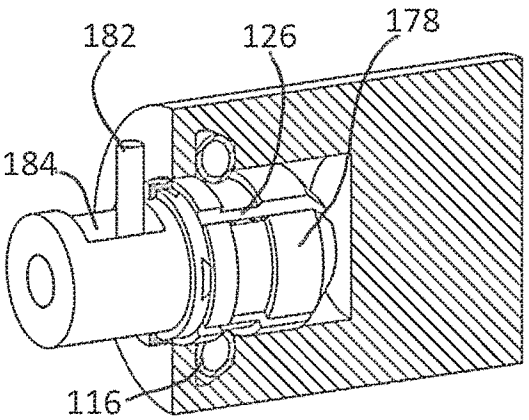
Figure 7G:
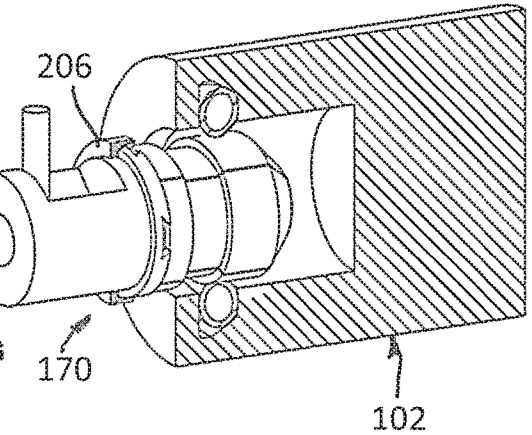

FIGS. 7 to 7G show a connector assembly 170 provided in accordance to an alternative aspect of the present device, system, and method. The present connector assembly 170 comprises a multi-piece or multi-component pin, shaft or rod 104 and a housing 102, similar to the connector assembly of FIGS. 2-2E. In the present embodiment, the relative movement between the first shaft component 172 and the second shaft component 174 along the longitudinal axis of the pin 104 is restrained.

As shown, the first shaft component 172 is sectioned into a first sub-section or sub-component 172*a* and a second sub-section or sub-component 172*b*. The two sub-components are held together by a collar 206 with threads and other engagement means contemplated. As shown, the first sub-section 172*a* comprises a pin groove 150, slits 126 and collapsible pin portions 178 and the second sub-section 172*b* comprises a slot 184 for the leverage pin 182 to traverse there along. The second shaft section 172*b* comprises an outwardly extending flange 188 comprising a push surface 190.

A plurality of wavy springs 196 are positioned in an annular space 198 located between the first and second pin components 172, 174. The flange 188 on the second shaft component 174 and the end surface 208 on the second sub-component 172*b* bound the two end wavy springs 196 within the annular space 198. The wavy springs therefore compress and expand against the constraint of the flange 188 and the end surface 208. In an alternative embodiment, the flange 188 is separately formed from the second shaft section 174.

The present connector assembly 170 may operate the same as discussed above with reference to FIGS. 2-2E. The connector 170 has a first latched state (not shown) and a second latched state (FIGS. 7, 7A, 7D and 7E). The present connector also has a transit state that differs when moving the connector 170 from the first latched state (not shown) in which the spring 106 is positioned in the common groove defined by the housing groove 116 and the pin groove 150 but prior to activation of the first shaft section 172 and the second shaft section 174 to the second latched state shown in FIGS. 7, 7A, 7D and 7E and in moving the connector from the second latched state back to the first latched state due to the wavy springs 196. Looking first at FIG. 7 to a first latched position just before FIG. 7B then at FIG. 7B, the force to de-activate the first and the second shaft sections 172, 174 is opposed by the wavy springs 196. In other words, the wavy springs 196 must be compressed between the flange 188 and the end wall 208 during the de-activation step. Once the connector is at the first latched position, in which the pin 104 appears similar to that shown in FIG. 7B and the wavy springs 196 are compressed, the pin 104 can further be retracted to dislodge the spring 106 from the common groove to remove the pin 104 from the housing 102.

In reverse to move the connector from the first latched state to the second latched state (FIG. 7), the wavy springs 196 expand and assist with activating the pin 104 by moving the second shaft component 174 to the activated position relative to the first shaft component 172, as shown in FIG. 7. Thus, the transit state in one direction has a lower pin moving force than the transit state in the opposite direction due to the wavy springs 196. The transit state in which the wavy springs are compressed require a greater force than when the wavy springs expand.

FIGS. 7-7G show the first and second shaft components 172, 174 sprung together by means of wavy springs. Other type of springs may be considered, such as for example a Belleville spring or a helical spring. These two components may be threaded together instead, as further discussed below as a means for activating the two shaft components relative to one another. Other suitable engagement means fall within the scope of this application. The figures also show a groove on the shaft and a housing mounted canted coil spring. However, the same connector assembly but having no groove on the shaft also falls within the scope of this application, as well as the same connector assembly but having a shaft mounted canted coil spring instead, with and without a groove in the housing.

Figure 7D:
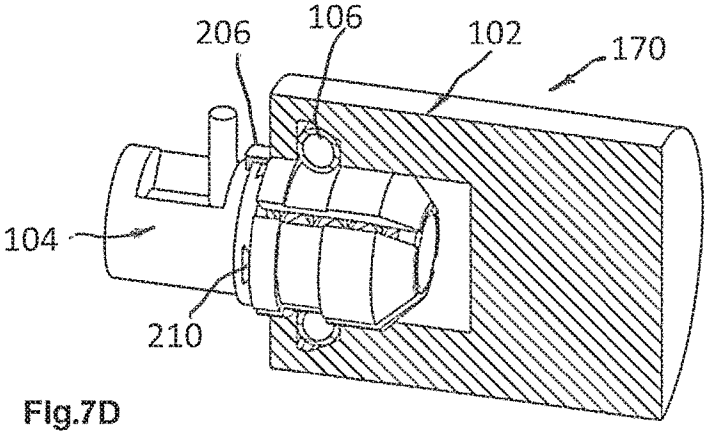
Figure 7F:
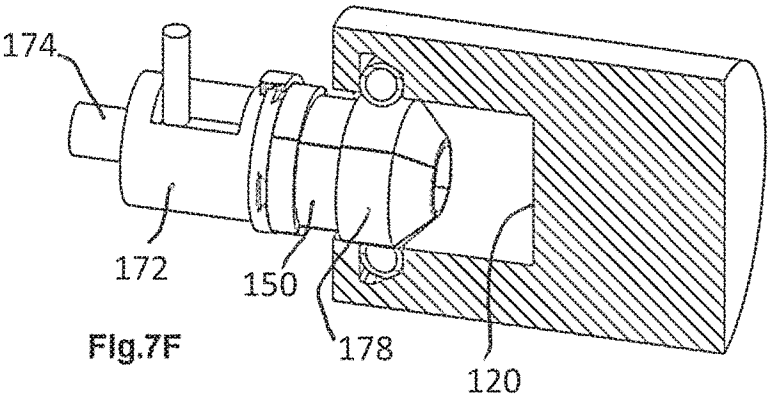

With specific reference to FIGS. 7D and 7F, a plurality of grooves 210 are formed on the end surface 208 of the second sub-component 172*b*. The grooves 210 are sized and shaped to keep the wavy springs 196 aligned in axially spaced apart positions along the outer surface of the second shaft component 174.

Figure 8A:
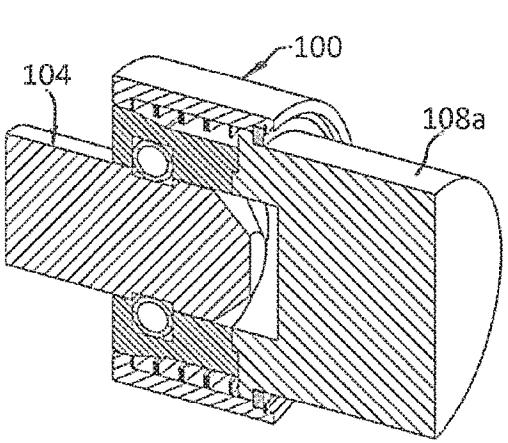
FIGS. 8, 8A, 8B, 8C, 8D, and 8E show a connector assembly comprising a housing, a shaft and a helical or a ribbon spring, wherein the housing comprises two components, one of them further comprising multiple subcomponents and the assembly is shown in different stages of connect/disconnect.
Figure 8C:
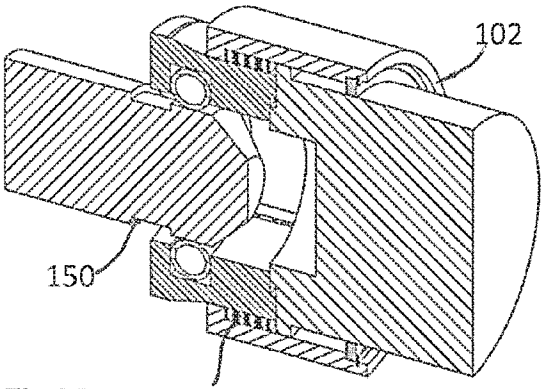
Figure 8:
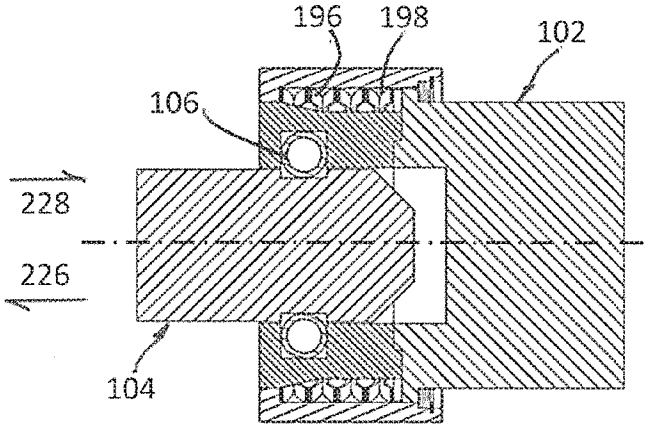
Figure 8B:
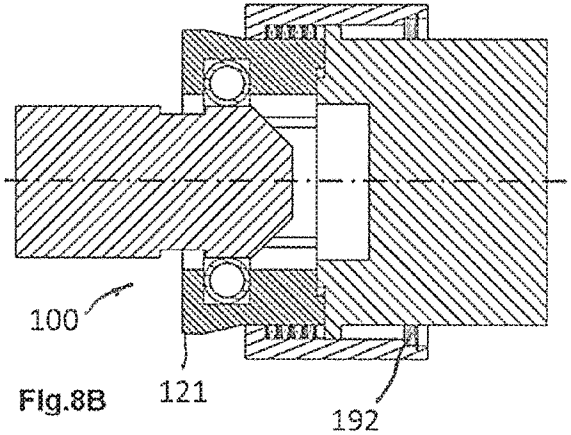
Figure 8D:
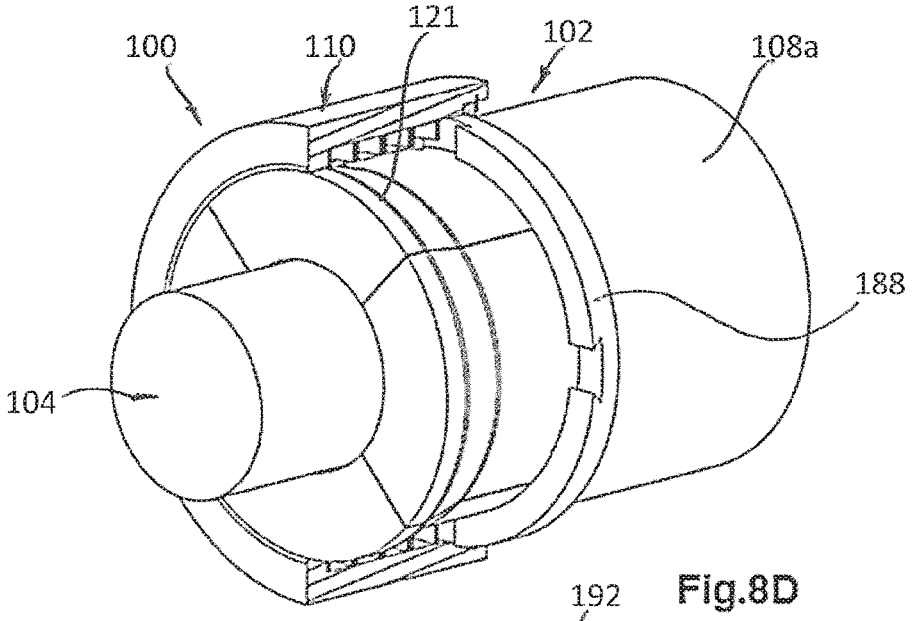
Figure 8E:
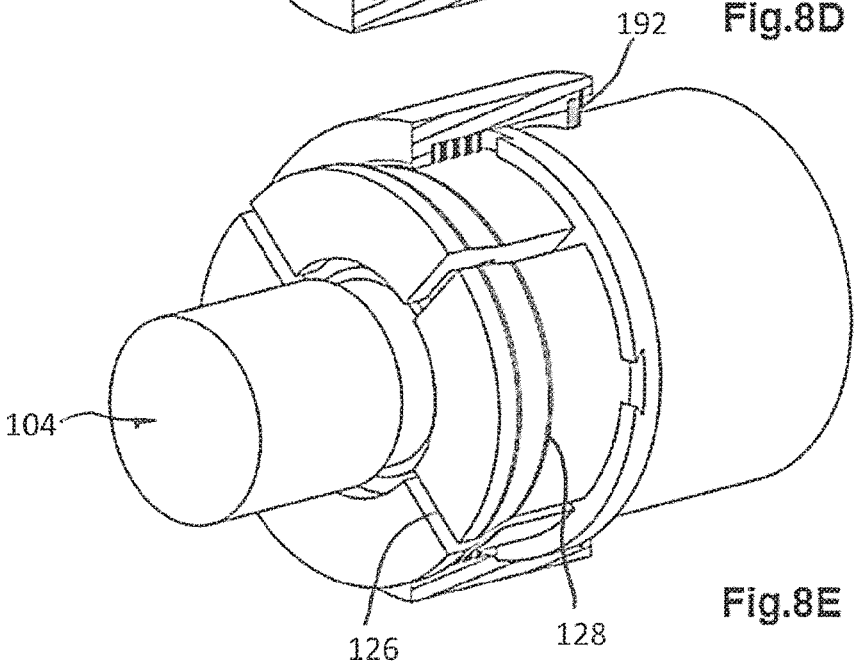

The connector assembly 100 of FIGS. 8-8E is similar to the connector assembly of FIGS. 5-5E except wherein the spring 106 for latching the pin 104 to the housing 102 has been replaced by a helical spring or a ribbon spring instead of a canted coil spring. Other suitable types of spring, such as for example cantilever springs, fall within the scope of this application.

Figure 9A:
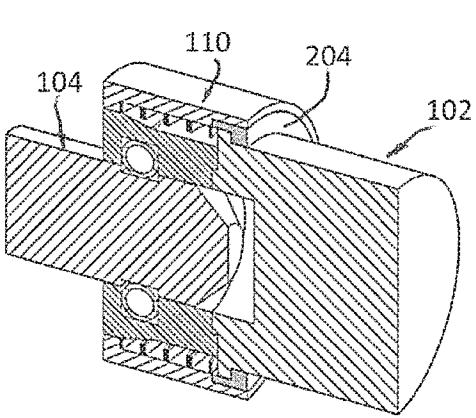
FIGS. 9, 9A, 9B, 9C, 9D, and 9E show the connector assembly shown in FIGS. 8 to 8E with a modification in the housing and the assembly is shown in different stages of connect/disconnect.
Figure 9:
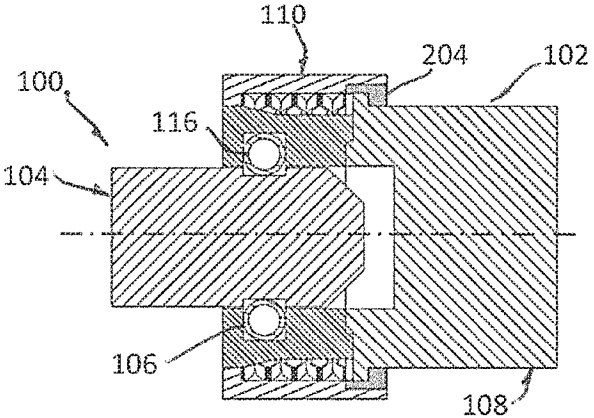
Figure 9C:
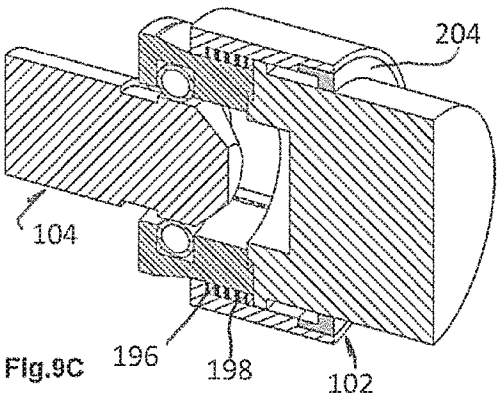
Figure 9B:
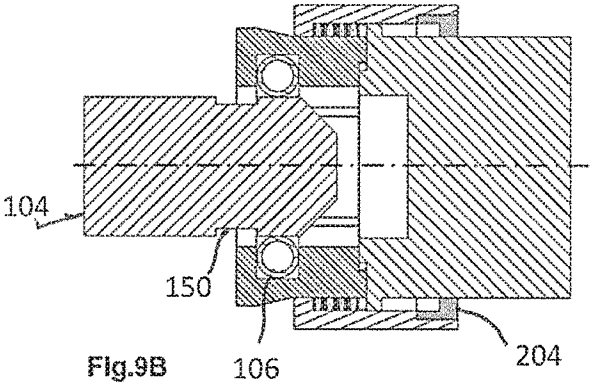
Figure 9D:
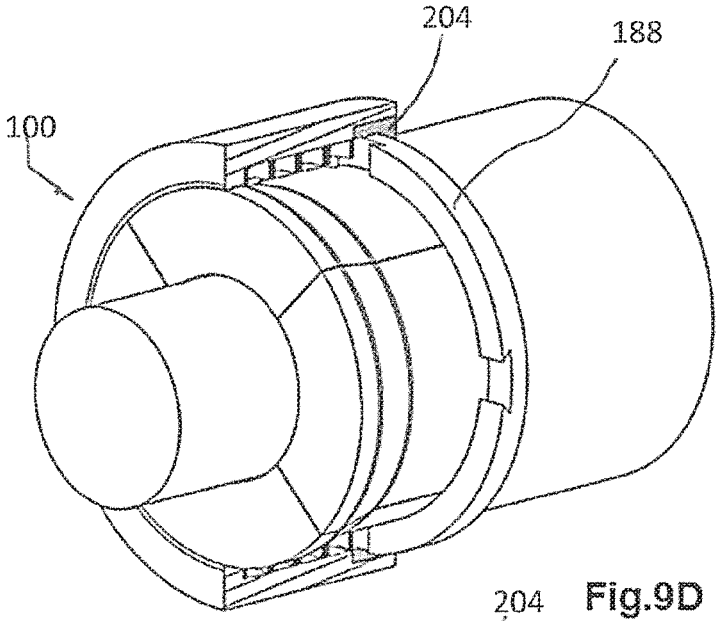
Figure 9E:
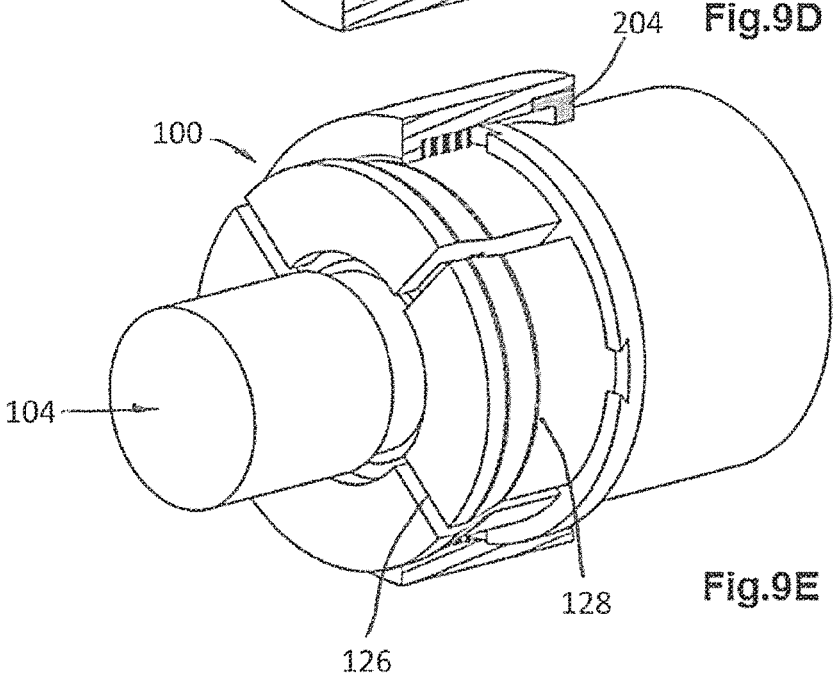

The connector assembly 100 of FIGS. 9-9E is similar to the connector assembly of FIGS. 6-6E except wherein the spring 106 for latching the pin 104 to the housing 102 has been replaced by a helical spring or a ribbon spring instead of a canted coil spring. Other suitable types of spring, such as for example cantilever springs, fall within the scope of this application.

Figure 10A:
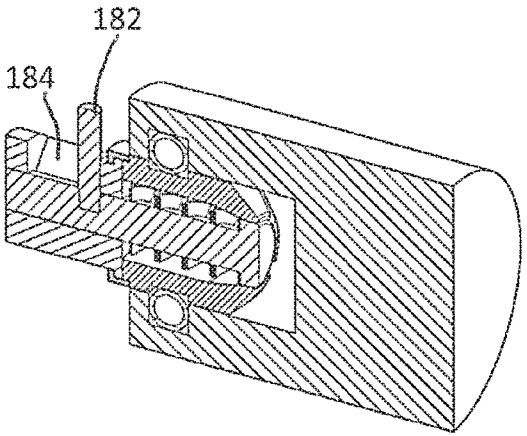
FIGS. 10, 10A, 10B, 10C, 10D, 10E, 10F, and 10G show a connector assembly comprising a housing, a shaft and a helical or a ribbon spring, wherein the shaft comprises two components, one of them further comprising multiple subcomponents and the assembly is shown in different stages of connect/disconnect.
Figure 10C:
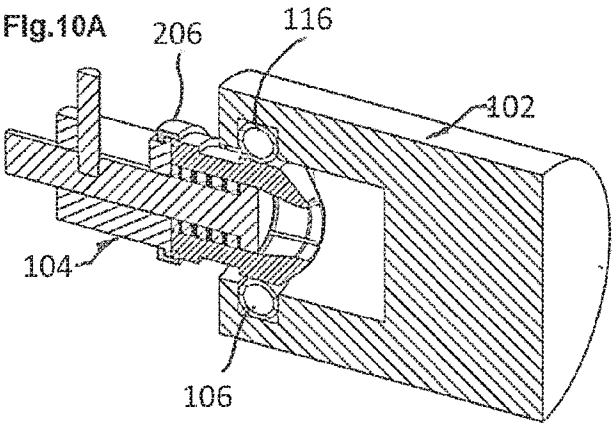
Figure 10:
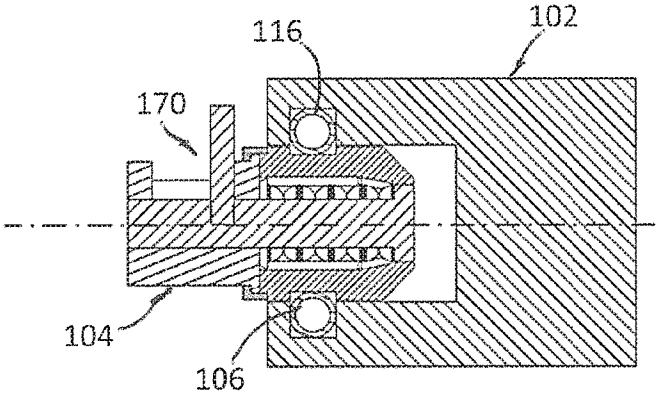
Figure 10B:
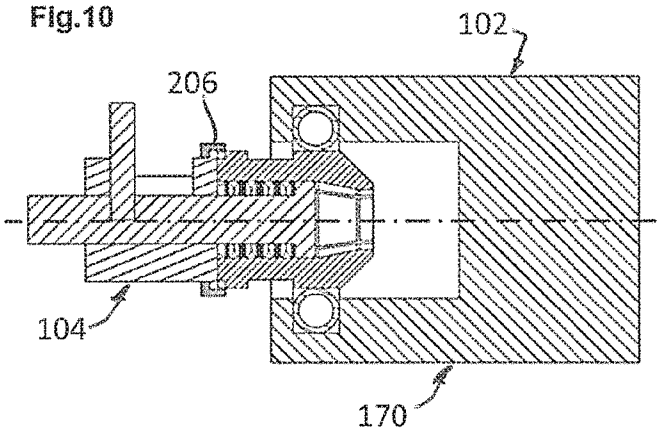
Figure 10E:
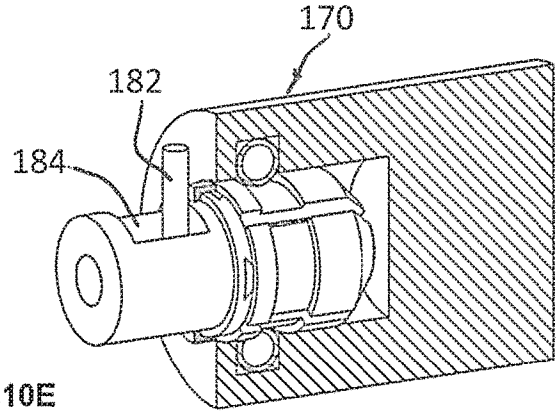
Figure 10G:
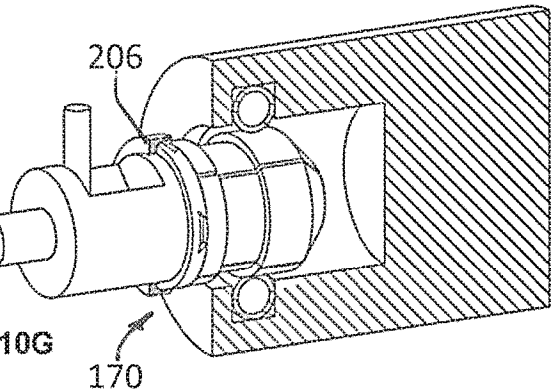
Figure 10D:
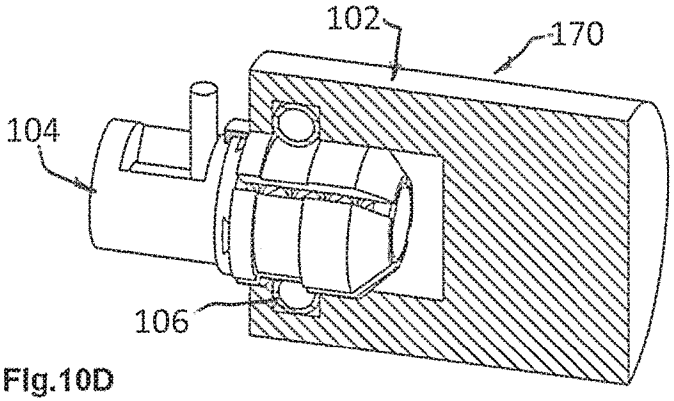
Figure 10F:
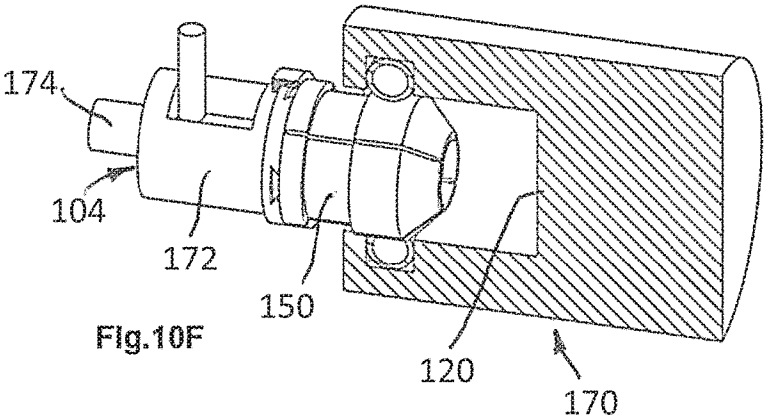

The connector assembly 170 of FIGS. 10-10G is similar to the connector assembly of FIGS. 7-7G except wherein the spring 106 for latching the pin 104 to the housing 102 has been replaced by a helical spring or a ribbon spring instead of a canted coil spring. Other suitable types of spring, such as for example cantilever springs, fall within the scope of this application.

The connector assemblies described herein, such as in FIGS. 1-10G, are understood to include a common groove having a dimension, such as a dimension measured from a groove bottom of a housing groove to a groove bottom of a pin groove, that can change to enable connect and disconnect forces to latch the pin to the housing. The groove configuration can vary when moving the housing components from one state to another or moving the pin components from one state to another. The common groove dimension can change from a first dimension to a second dimension. In particular examples, the second common groove dimension can comprise a wider common groove, a deeper common groove, or both a wider and a deeper common groove. Further, a second set of springs, such as wavy springs or Belleville springs, may be incorporated to further vary the force needed to move the connector between different states, i.e., to restrict or constrain the transit states. In some examples, the dimension of the common groove can change by incorporating deflectable or collapsible members in the housing and wherein part of the common groove is formed by the collapsible members in the housing. In other examples, the dimension of the common groove can change by incorporating deflectable or collapsible members in the pin and wherein part of the common groove is formed by the collapsible members in the pin. In the examples disclosed, the dimension of the common groove measured from a groove bottom of a housing to a groove bottom of a pin can change from a first dimension when the housing or the pin is activated to a larger second dimension when the housing or the pin is de-activated. In some cases, activation of the pins or the housings simply restrict the common groove from intentionally changing but de-activation merely keeps the common groove the same unless intentionally changed. In the examples disclosed, the dimension of the common groove measured from a groove bottom of a housing to a groove bottom of a pin can change to a third dimension, which is larger than the second dimension, when the pin groove and the housing groove move relative to one another to separate the common groove. For example, when the spring 106 captured by the common groove is moved to a transit state, the process can start with the common groove expanding towards the third dimension as the spring is moved out of the common groove to a landing area 148.

Specific different mechanisms for enabling movement of the pin and the housing to move the connector from a pre-connected state, to a first transit state, to a first latched state, to a second latched state, back to the first latched state, and to a second transit state to separate the pin from the housing are described in the various embodiments disclosed herein.

Figures 11, 11A, 11B, 11C:
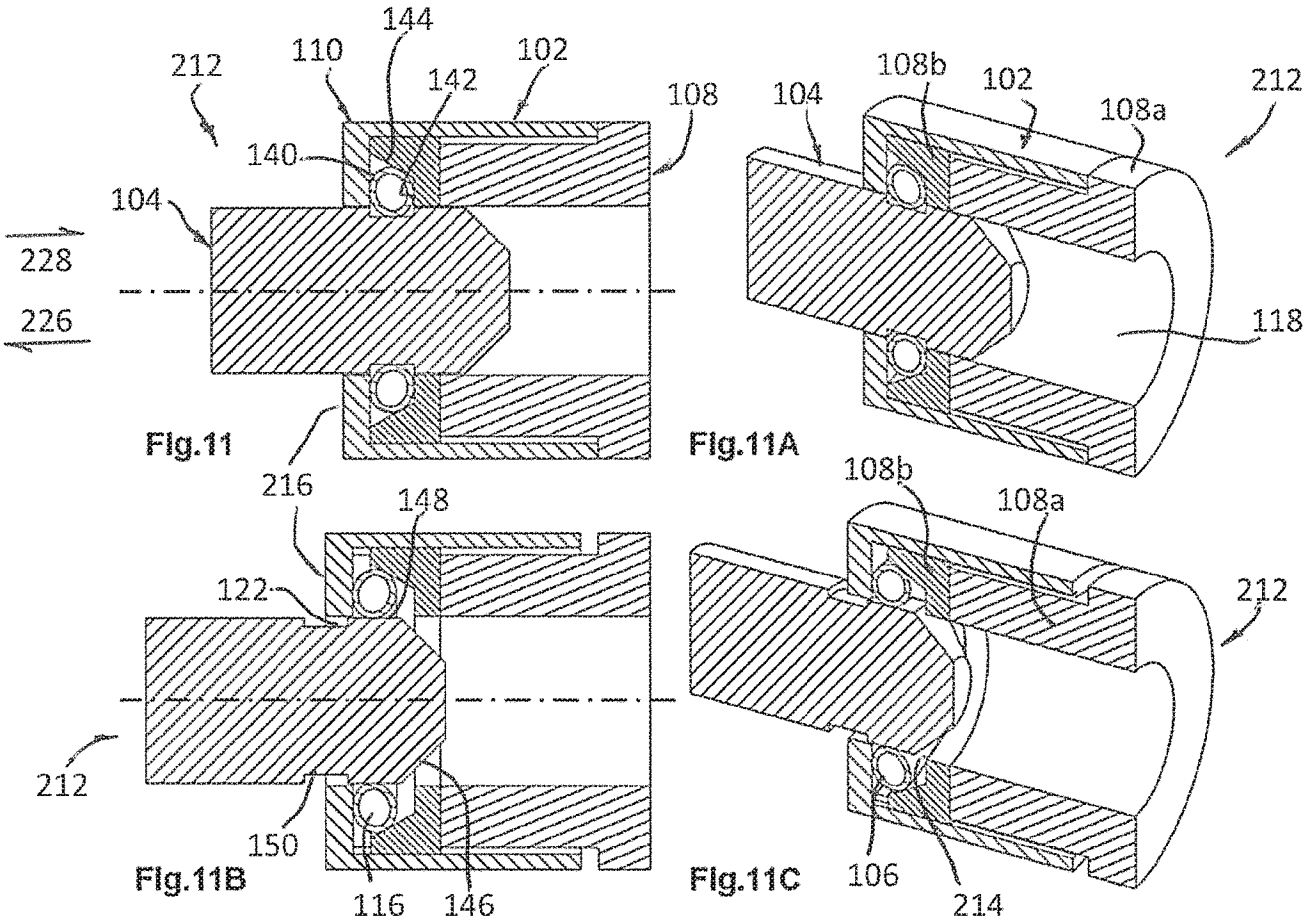
FIGS. 11, 11A, 11B, 11C, 11D, and 11E illustrate a connector assembly comprising a housing, a shaft and a canted coil spring, wherein the housing comprises two components, one of them further comprising two subcomponents having restrained their relative rotation and the assembly is shown in different stages of connect/disconnect.
Figure 11D:
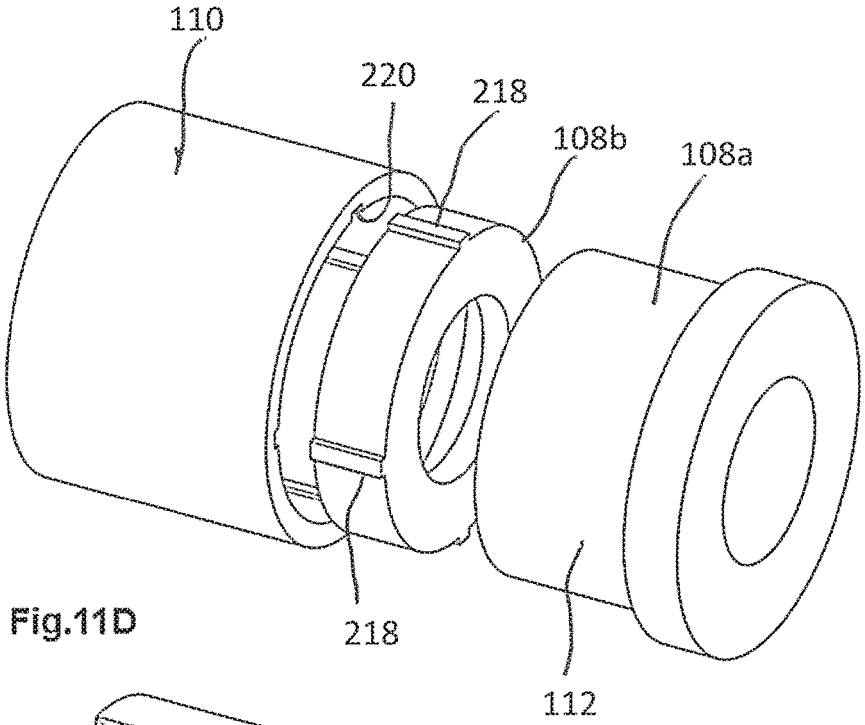
Figure 11E:
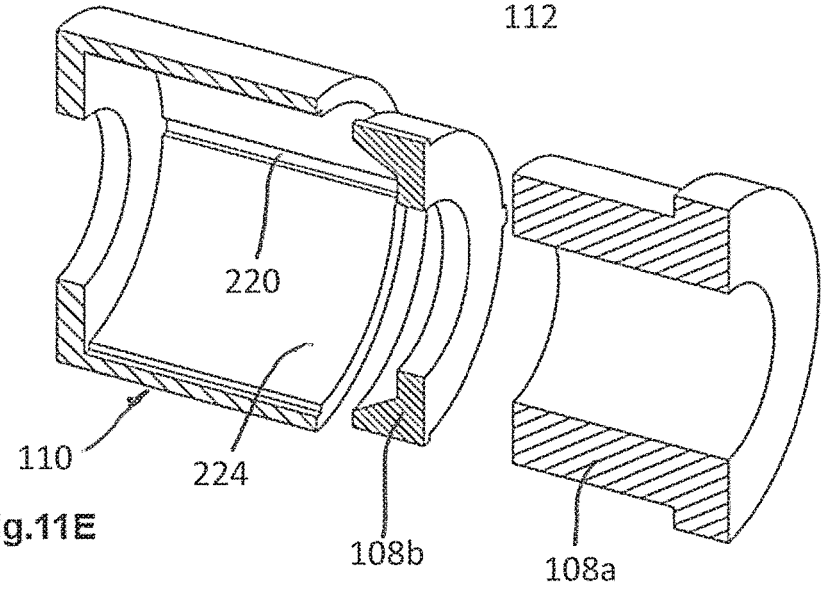

FIGS. 11 to 11E illustrate a connector assembly 210 provided in according to another aspect of the present device, system, and method and comprises a housing 102 and a pin 104, which comprises a pin groove 150. In the figures, FIG. 11D is an exploded view of the housing 102 of FIGS. 11-11C and FIG. 11E is a cross-sectional view of FIG. 11D. In the present embodiment, the housing 102 comprises a first housing component 108 and a second housing component 110. In the present embodiment, the first housing component 108 comprises a first subcomponent 108*a* and a second subcomponent 108*b*. The second housing component 110 and the second subcomponent 108*b* together define a housing groove 116 with a recessed space 214 on the second subcomponent forming a tapered bottom wall 144 and a sidewall 142 of the housing groove 116 and the end flange 216 on the second housing component 110 forming the other sidewall 140 of the housing groove 116.

In the present embodiment, the housing groove 116 can change from a first housing groove dimension or size to a larger second housing groove dimension or size, which is understood to mean a larger groove width, a larger groove depth, or both. In one example, the first housing component 108 and the second housing component 110 can move relative to one another to change the housing groove dimension. In the example shown, the first housing component 108 is configured to move away from the second housing component 110 to increase the housing groove width and the contact point of the spring 106 with the bottom wall 144 of the housing groove from a first contact location to a second contact location, which is deeper along the tapered bottom wall 144 to in effect also increase the groove depth. This then provides room for the spring 106 to expand and/or rotate to enable movement of the connector through the various states, as further discussed below.

With reference specifically to FIGS. 11, 11B, 11D, and 11E, the second housing sub-component 108*b* incorporates a plurality of axially aligned and spaced apart ribs 218 for interacting with a plurality of axially aligned and spaced apart grooves 220 on the second housing component 110. The ribs 218 and the grooves 220 resemble a tongue and groove arrangement to keep the second housing sub-component 108*b* and the second housing component 110 from rotating relative to one another, although they can still axially move relative to one another to increase the housing groove dimension. In another example, the second housing sub-component 108*b* has the grooves 220 and the second housing component 110 has the ribs 218.

In one example, relative axial movement between the second housing sub-component 108*b* and the second housing component 110 to increase the housing groove dimension depends on relative movement between the first housing sub-component 108*a* and the second component 110. In one example, the first and second housing components 108, 110 are activated by pushing the first component 108 into the second component 110 until the two components bottom out, such as providing a physical contact to prevent further insertion or collapsing within one another. The exterior surface 222 of the body portion 112 of the first sub-component frictionally engages the interior surface 224 of the second housing component 110 prevent the two from de-activation. To de-activate, the friction must be overcome, such as by rotating the first sub-component 108*a* relative to the second housing component 110.

In another example, the flange 120 on the first sub-component 108*a* and the second housing component 110 can engage, such as by detents or threads. A fastener, such as a buckle or a set screw, may also be used to retain the first sub-component 108*a* to the second housing component 110. Thus, relative rotation of the first sub-component 108*a* and the second component 108*b* around the longitudinal axis of the connector is restrained and their relative movement along the longitudinal axis is influenced by the first sub-component 108*a*.

The present connector assembly 212 may operate in a similar way as other connector assemblies discussed elsewhere herein. The connector 212 has a first latched state (not shown) and a second latched state (FIGS. 11, 11A). The present connector also has a transit state. Looking first at FIG. 11, the connector assembly 212 is in a second latched position in which the spring 106 is located in a common groove defined by the housing groove and the pin groove and the first and second housing components 108, 110 are activated. At this position, the force to remove the pin 104 from the housing 102 by moving the pin in the withdraw direction 226 is high as the spring cannot collapse or deflect in the orientation shown to permit separation of the pin. The connector 212 can be said to be a locking connector as the pin 104 cannot be removed from the housing 102 without destroying the spring. However, the pin can still move in a further insertion direction 228. The insertion direction 228 may also be referred to as a first direction and the withdrawal direction 226 may be referred to as a second direction.

To move to a first latched position (not shown), the housing 102 is de-activated by moving the first sub-component 108*a* relative to the second sub-component 108*b* to enlarge the housing groove 116, as discussed above. This moves the connector 212 to the first latched position in which the spring 106 is still captured by the common groove but wherein the housing groove dimension has increased due to the de-activation of the housing 102. The de-activated housing 102 appears similar to that shown in FIGS. 11B and 11C, where the first and second sub-components 108*a*, 108*b* are not bottomed out. At this point, the pin 104 can move in the withdraw direction 226 since the common groove is now larger and allows the spring 106 to rotate to a more vertical position (as shown by looking at the spring orientation in FIG. 11 and the orientation in FIG. 11B). The pin 104 can now move to the transit state with the spring 106 at the landing section 148 of the pin, as shown in FIG. 11B. Further retraction of the pin in the withdraw direction 226 can completely separate the pin 104 from the housing 102.

In reverse to move the connector 212 from the first latched state (not shown) to the second latched state (FIG. 11), the pin 104 is first moved from a pre-connected state (not shown) and inserted into the inlet opening 122 of the housing 102. The tapered inlet end 146 enlarges the spring inside diameter and/or rotates the spring and then moves the spring 106 to the landing area 148 on the pin. Further movement of the pin 104 in the first direction 228 relative to the housing 102 will force the spring to snap into or be captured by the common groove defined by the housing groove 116 and the pin groove 150 when the two aligned. At this point, the connector is in the first latched state with the spring 106 captured by the common groove but before the housing 102 is activated. To activate the housing 102, the first housing section 108 is moved relative to the second housing section 110 until the two are bottomed out, as discussed above. The connector is now in its second latched state, as shown in FIG. 11.

FIGS. 11-11C show the first and second components 108, 110 being engaged via frictional contact surfaces. These two components may be threaded together instead, or sprung together by means of wavy springs, Belleville springs or a helical spring, as examples. Other suitable engagement means fall within the scope of this application. The figures also show a groove on the shaft and a housing mounted canted coil spring. However, the same connector assembly but having no groove on the shaft also falls within the scope of this application, as well as the same connector assembly but having a shaft mounted canted coil spring instead, with and without a groove in the housing.

Figures 12, 12A, 12B, 12C:
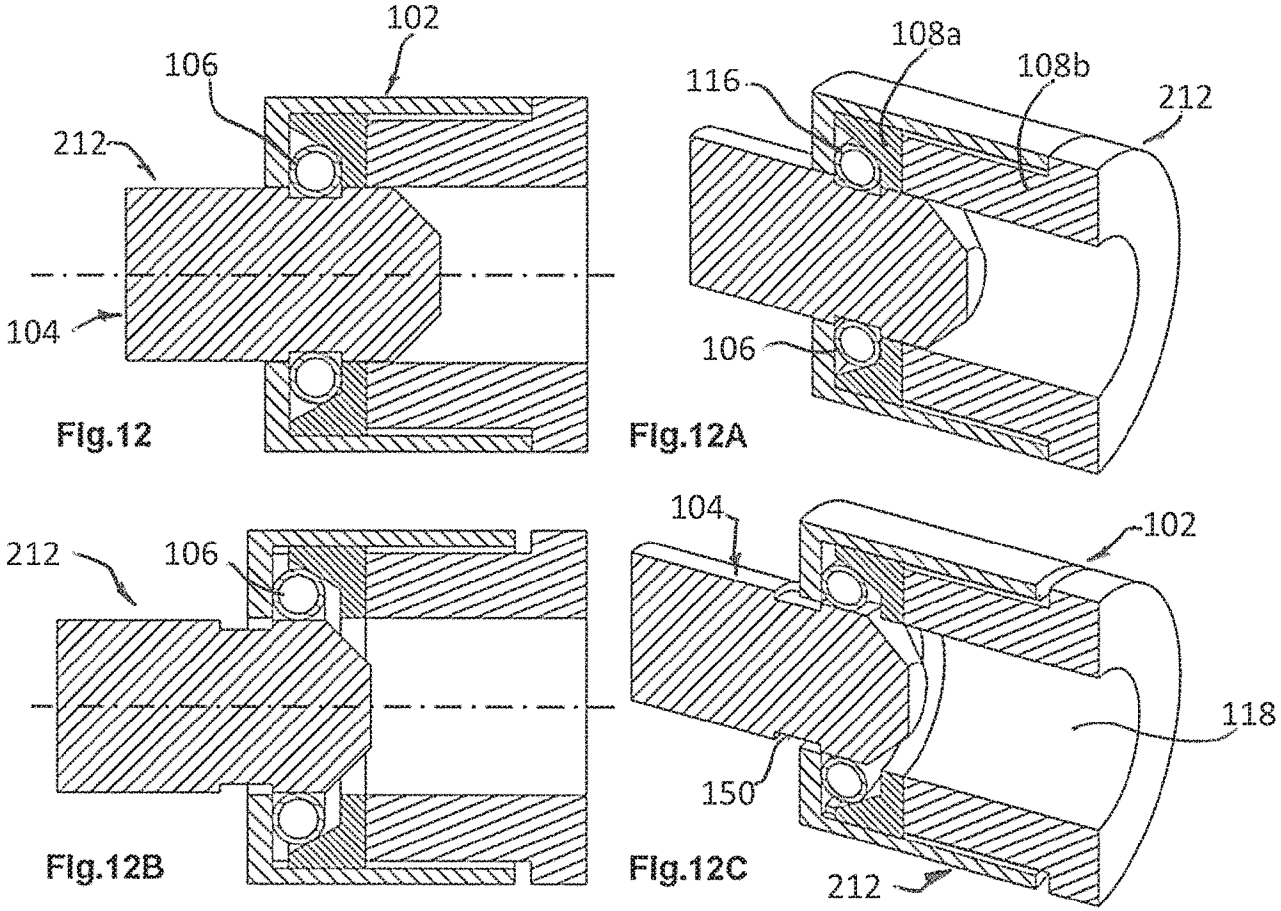
FIGS. 12, 12A, 12B, 12C, 12D, and 12E illustrate a connector assembly comprising a housing, a shaft and a helical or a ribbon spring, wherein the housing comprises two components, one of them further comprising two subcomponents having restrained their relative rotation and the assembly is shown in different stages of connect/disconnect.
Figure 12D:
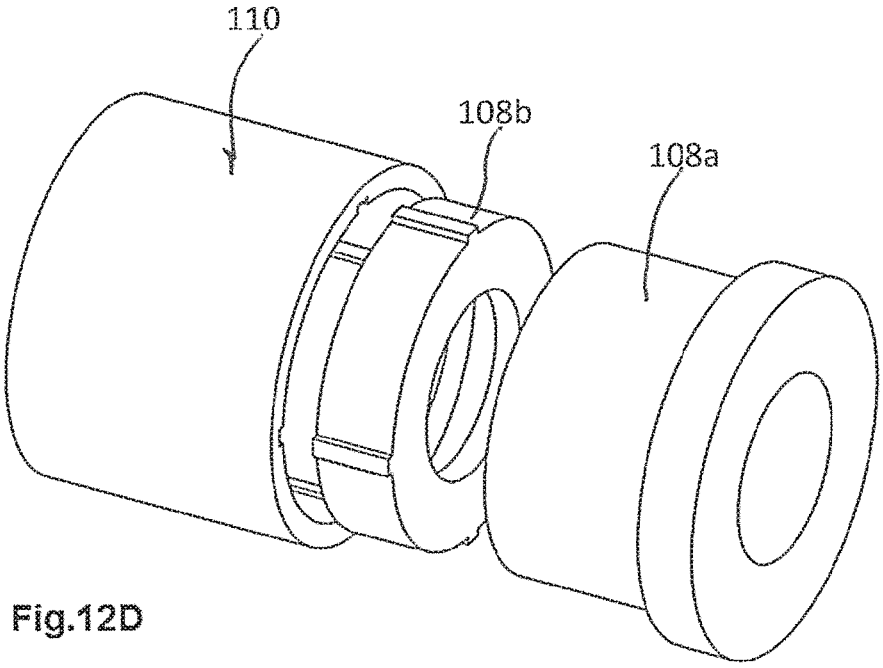
Figure 12E:
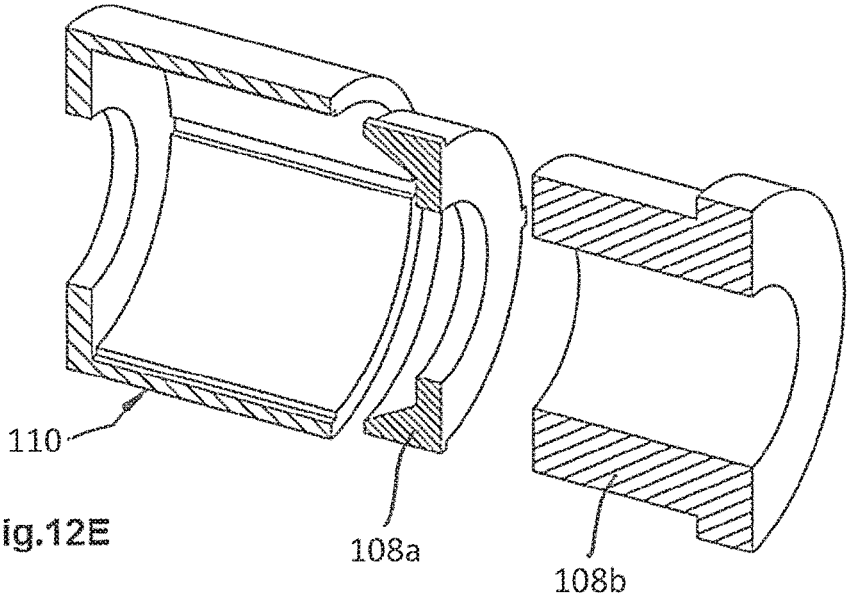

FIGS. 12-12E illustrate a connector assembly 212 similar to the connector assembly shown in FIGS. 11-11E but wherein the spring 106 is a helical spring or a ribbon spring instead of a canted coil spring. Other suitable types of spring, such as for example cantilever springs, fall within the scope of this application.

Figure 13A:
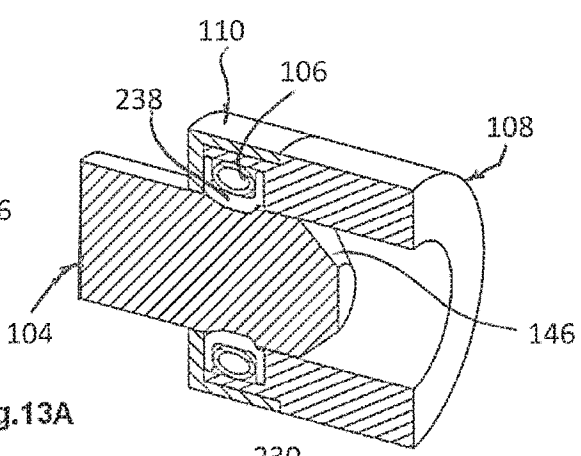
FIGS. 13, 13A, 13B, and 13C show a connector assembly comprising a housing, a shaft and spring means, wherein the housing comprises two components and the spring means consists of a spring element and multiple relatively rigid sections and the assembly is shown in different stages of connect/disconnect.
Figure 13:
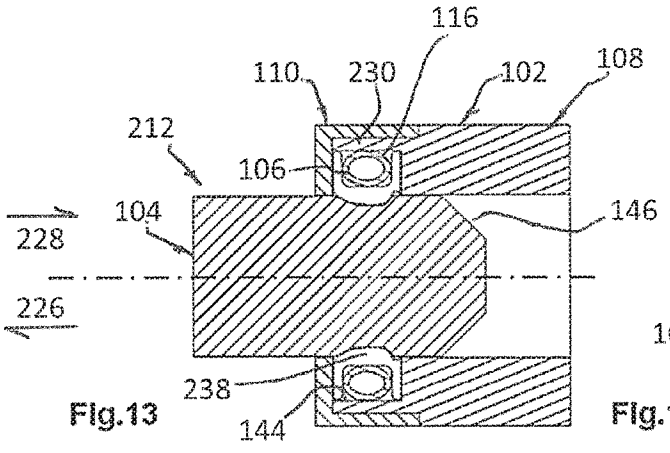
Figure 13C:
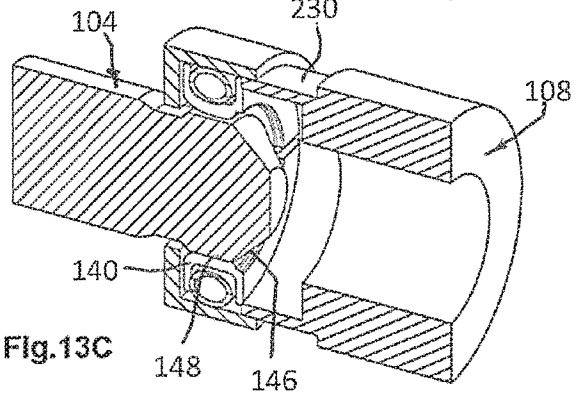

FIGS. 13-13C show a connector assembly 212 provided in accordance with another embodiment of the present device, system, and method, which comprises a housing 102 with a housing groove 116 and a pin 104 with a pin groove 150. In the present embodiment, the housing 102 comprises a first housing component 108 and a second housing component 110. The second housing component 110 and the first housing component 108 together define a housing groove 116. Specifically with reference to FIGS. 13 and 13A, the first housing component 108 comprises an axially extending collar 230, which defines an exterior recess 232 and an interior recess 234. The exterior recess 232 is configured to receive the skirt section 236 on the second housing section 110. The interior recess 234 forms the bottom wall 144 and the sidewall 142 of the housing groove 116. The other sidewall 140 of the housing groove 116 is defined by the end flange 216 on the second housing component 110.

In the present embodiment, the housing groove 116 can change from a first housing groove dimension or size to a larger second housing groove dimension or size, which is understood to mean a larger grove width, a larger groove depth, or both. In one example, the first housing component 108 and the second housing component 110 can move relative to one another to change the housing groove dimension. In the example shown, the first housing component 108 is configured to move away from the second housing component 110 to increase the housing groove width and depth. This then provides room for the spring 106, which in the present embodiment is a radial canted coil spring, to expand to enable movement of the connector through the various states, as further discussed below.

Although the present connector may be practiced without an insert ring 238 by resizing the common groove appropriately, the insert ring 238 reduces the effective gap or dimension of the common groove measured between the housing groove bottom and the pin groove bottom. At the second latched state shown in FIG. 13, the spring 106 biases outwardly against the axial collar 230 and biases inwardly against the insert ring 238. The insert ring 238 defines a U-shape channel for receiving the spring. On the inside diameter of the insert ring 238, the shaped surface allows the ring 238 to slide in and out of the pin groove 150 as the connector moves between the transit state and the latched state. The insert ring 238 may be made from a plastic material, a composite, or a metal material. FIG. 13 shows the housing 102 in the activated position with the first housing component 108 and the second component 110 being bottomed out and the insert ring 238 either close to or simultaneously touching both bottom groove surfaces 144, 152. The two components 108, 110 can be retained in the activated position through various means, including through friction, threads, or fasteners.

The present connector assembly 212 may operate in a similar way as other connector assemblies discussed elsewhere herein. The connector 212 has a first latched state (not shown) and a second latched state (FIGS. 13 and 13A). The present connector also has a transit state. Looking first at FIG. 13, the connector assembly 212 is in the second latched position in which the spring 106 is located in a common groove defined by the housing groove 116 and the pin groove 150 and the first and second housing components 108, 110 activated. At this position, the force to remove the pin 104 from the housing 102 by moving the pin in the withdraw direction 226 is high as the spring cannot collapse or deflect due to the present of the insert ring 238, even if the spring is able to compress or deflect. The connector 212 can be said to be a locking connector as the pin 104 cannot be removed from the housing 102 without destroying or deforming the insert ring 238 and/or the spring.

Figure 13B:
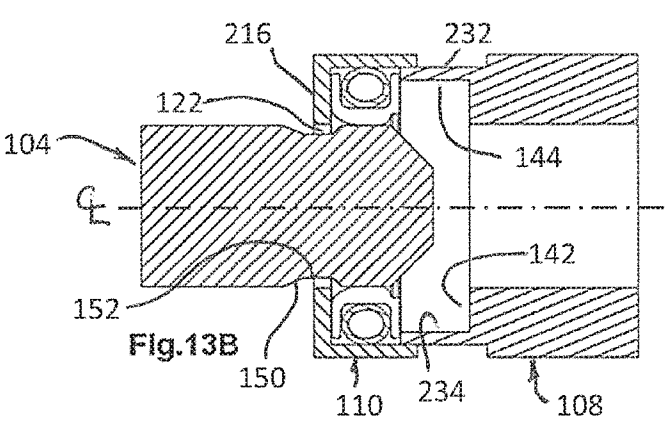

To move to a first latched position (not shown), the housing 102 is de-activated by moving the first component 108 and the second component 110 to enlarge the housing groove 116, as discussed above. This moves the connector 212 to the first latched position in which the spring 106 is still captured by the common groove but wherein the housing groove dimension has increased due to the de-activation of the housing 102. The de-activated housing 102 appears similar to that shown in FIGS. 13B and 13C, where the first and second housing components 108, 110 are not bottomed out. At this point, the pin 104 can move in the withdraw direction 226 since the common groove is now larger and allows the spring 106 to compress and the insert ring 238 to be expanded and lifted out of the pin groove 150 during pin removal. The insert ring 138 is therefore expandable, such as having a split in the ring, made from multiple ring sections, or is made from an expandable material. The pin 104 can now move to the transit state with the spring 106 at the landing section 148 of the pin, as shown in FIG. 13B. Further retraction of the pin in the withdraw direction 226 can completely separate the pin 104 from the housing 102.

In reverse to move the connector 212 from the first latched state (not shown) to the second latched state (FIG. 13), the pin 104 is first moved from a pre-connected state (not shown) and inserted into the inlet opening 122 of the housing 102. The tapered inlet end 146 enlarges the insert ring 238 and compresses the spring 106 in moving the spring 106 to the landing area 148 on the pin. Further movement of the pin 104 in the first direction 228 relative to the housing 102 will force the spring to snap into or be captured by the common groove defined by the housing groove 116 and the pin groove 150 as the two grooves align. At this point, the connector is in the first latched state with the spring 106 captured by the common groove but before the housing 102 is activated. To activate the housing 102, the first housing section 108 is moved relative to the second housing section 110 until the two are bottomed out, as discussed above. The connector is now in its second latched state, as shown in FIG. 13.

FIGS. 13-13C show the first and second components 108, 110 being engaged via frictional contact surfaces. These two components may be threaded together instead, or sprung together by means of wavy springs, Belleville springs or a helical spring, as examples. Other suitable engagement means fall within the scope of this application. The figures also show a groove on the shaft and a housing mounted canted coil spring. However, the same connector assembly but having no groove on the shaft also falls within the scope of this application, as well as the same connector assembly but having a shaft mounted canted coil spring instead, with and without a groove in the housing.

Figures 14, 14A, 14B, 14C:
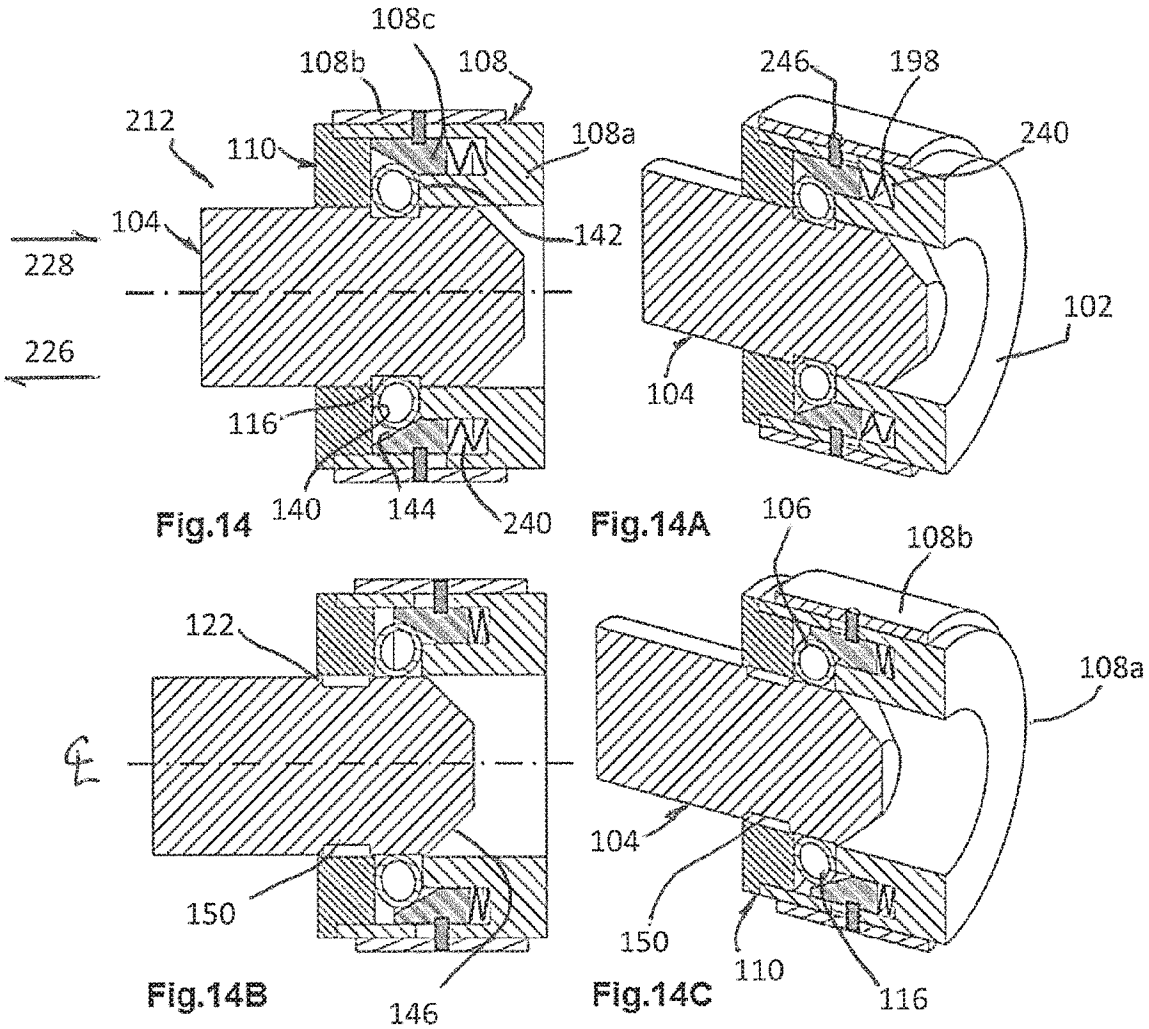
Figure 14D:
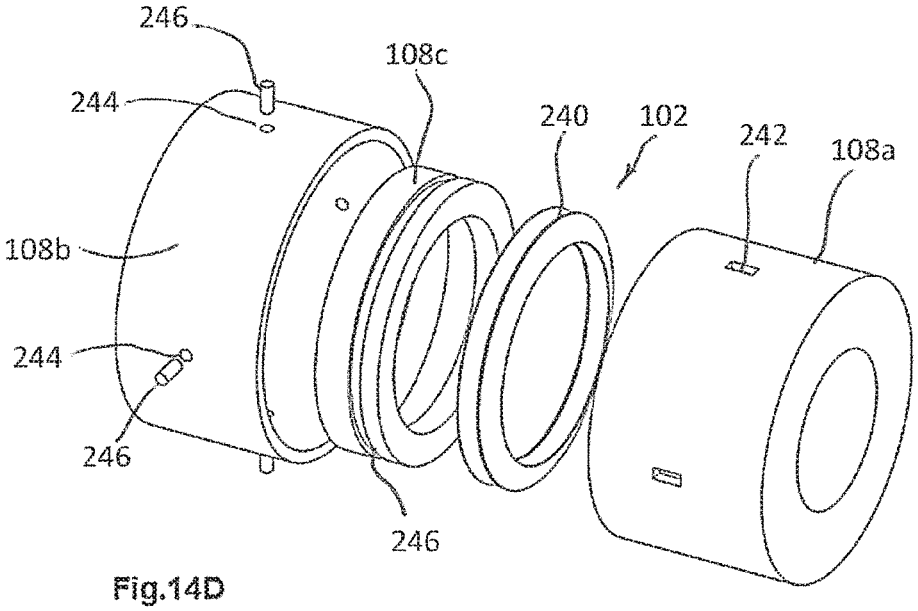
Figure 14E:
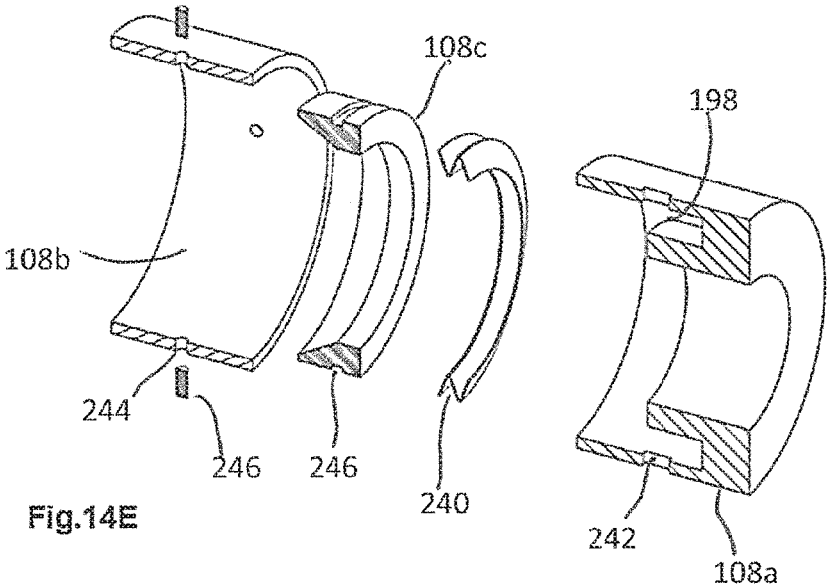

FIGS. 14-14E illustrate a connector assembly 212 provided in accordance with another embodiment of the present device, system, and method, which comprises a housing 102 with a housing groove 116 and a pin 104 with a pin groove 150. In the present embodiment, the housing 102 comprises a first housing component 108 and a second housing component 110. The first housing component 110 and the first housing component 108 together define a housing groove 116. Specifically with reference to FIGS. 14, 14D and 14E, the first housing component 108 comprises a first housing sub-component 108*a*, a second housing sub-component 108*b*, and a third housing sub-component 108*c*. The first sub-component 108*a* has an annular space 198 for receiving at least part of the third sub-component 108*c* and a biasing member 240, which in the present embodiment is a Belleville spring with other spring types contemplated. A plurality of channels 242 are provided on the first sub-component 108*a*, which act as keyways.

In one example, the second component 108*b* embodies a cylindrical ring section comprising a plurality of bores 244 to receive a plurality of retention pins 246. In the example shown, four pins 246 and four bores 244 are provided. During assembly, the channels 242 on the first housing sub-component 108 are aligned with the bores 244 on the second housing sub-component 108. Each pin 246 then projects through a corresponding aligned bore 244 and channel 242 and into the ring groove 246 of the third sub-component. As the second sub-component 108*b* moves, the pins 246 move within the respective keyway or channel 242 to also move the third housing sub-component 108*c*, as further discussed below. In the example shown, the pins 246 are pressed fit to the bores 244.

Refer again to FIGS. 14-14C, the housing groove 116 is defined at least in part by the first housing component 108*a*, which forms one of the sidewalls 142, the second housing sub-component 108*c*, which forms the bottom wall 144 and the second housing component 110, which forms the other sidewall 140. The housing groove 116 is sized and shaped to cooperate with an axial canted coil spring 106 and has different housing groove dimensions depending on whether the housing is activated or de-activated.

In one example, the third housing sub-component 108*b* and the second housing sub-component 108*c* are moveable axially relative to the first housing sub-component 108*a* to increase the housing groove dimension, such as to de-activate the housing, or to decrease the housing groove dimension, such as to activate the housing. With reference to FIG. 14B then to FIG. 14, the housing is de-activated by moving the pins 246 in the insertion direction 228 to move the third housing sub-component 108*c* to compress the spring 240. As the second housing sub-component 108*b* are coupled to the pins 246, the pins are moved by sliding the second housing sub-component 108*b* relative to the first housing sub-component. To activate the housing, the second housing sub-component 108*b* is moved in the reversed direction. In one example, the exterior surface of the first sub-component 108*a* frictionally engages the interior surface of the second housing sub-component 108*a*. The friction prevents the second housing sub-component 108*b* from sliding until the friction is overcome. In other examples, the second housing sub-component 108*b* is fixed from relative movement through other means, such as by using threads, detents, or fasteners. Thus, the second housing sub-component 108*b* cannot move relative to the first housing sub-component 108*a* to activate or deactivate the housing until the fixing means is removed or overcome.

The present connector assembly 212 may operate in a similar way as other connector assemblies discussed elsewhere herein. The connector 212 has a first latched state (not shown) and a second latched state (FIGS. 14, 14A). The present connector also has a transit state. Looking first at FIG. 14, the connector assembly 212 is in a second latched position in which the spring 106 is located in a common groove defined by the housing groove 116 and the pin groove 150 and the first and second housing components 108, 110 activated. At this position, the force to remove the pin 104 from the housing 102 by moving the pin in the withdraw direction 226 is high as the spring cannot collapse or deflect in the orientation shown to permit separation of the pin. The connector 212 can be said to be a locking connector as the pin 104 cannot be removed from the housing 102 without destroying the spring. However, the pin can still move in a further insertion direction 228.

To move to a first latched position (not shown), the housing 102 is de-activated by sliding the second housing sub-component 108*b* to slide the pins 246 within the keyways 242 of the first housing cub-component 108*a* along the first direction 228. This moves the connector 212 to the first latched position in which the spring 106 is captured by the common groove but wherein the housing groove dimension has increased due to the de-activation of the housing 102. The de-activated housing 102 appears similar to that shown in FIGS. 14B and 14C, where the first and second sub-components 108*a*, 108*b* are not bottomed out. At this point, the pin 104 can move in the withdraw direction 226 since the common groove is now larger and allows the spring 106 to rotate to a more vertical position (as shown by looking at the spring orientation in FIG. 14 and the orientation in FIG. 14B). In some examples, the common groove is capable of being enlarged upon disconnection, such as when forcing the groove to expand by movement of the spring, without actually changing its configuration by mere de-activation. The pin 104 can now move to the transit state with the spring 106 at the landing section 148 of the pin, as shown in FIG. 14B. Further retraction of the pin in the withdraw direction 226 can completely separate the pin 104 from the housing 102.

Note that the transit state to enlarge the housing groove and de-activate the housing 102 comprises the step of compressing the spring 240 located inside the annular space 198. This requires a sufficient amount of force not only to move the third housing component 108*c* but also enough to compress the spring 240. The transit state to activate the housing and decrease the housing groove requires moving the third housing sub-component 108*c* in the second direction 226 and expanding the spring 240, which assists with the sliding motion.

In reverse to move the connector 212 from the first latched state (not shown) to the second latched state (FIG. 14), the pin 104 is first moved from a pre-connected state (not shown) and inserted into the inlet opening 122 of the housing 102. The tapered inlet end 146 enlarges the spring inside diameter and/or rotates the spring 106 and then moves the spring 106 to the landing area 148 on the pin. Further movement of the pin 104 in the first direction 228 relative to the housing 102 will force the spring to snap into or be captured by the common groove defined by the housing groove 116 and the pin groove 150 as the two grooves align. At this point, the connector is in the first latched state with the spring 106 captured by the common groove but before the housing 102 is activated. To activate the housing 102, the second housing sub-component 108*b* is moved relative to the first housing sub-component 108*a* until the two are bottomed out at the keyways 242. The connector is now in its second latched state, as shown in FIG. 14.

The first subcomponent 108*a* and the third housing sub-components 108*c* are sprung together by means of a Belleville spring. Other types of springs that can be used include wavy springs or helical springs as well as other suitable engagement means.

FIGS. 14-14E show a groove on the shaft and a housing mounted canted coil spring. However, the same connector assembly but having no groove on the shaft falls within the scope of this application, as well as the same connector assembly but having a shaft mounted canted coil spring instead, with and without a groove in the housing.

Figure 15D:
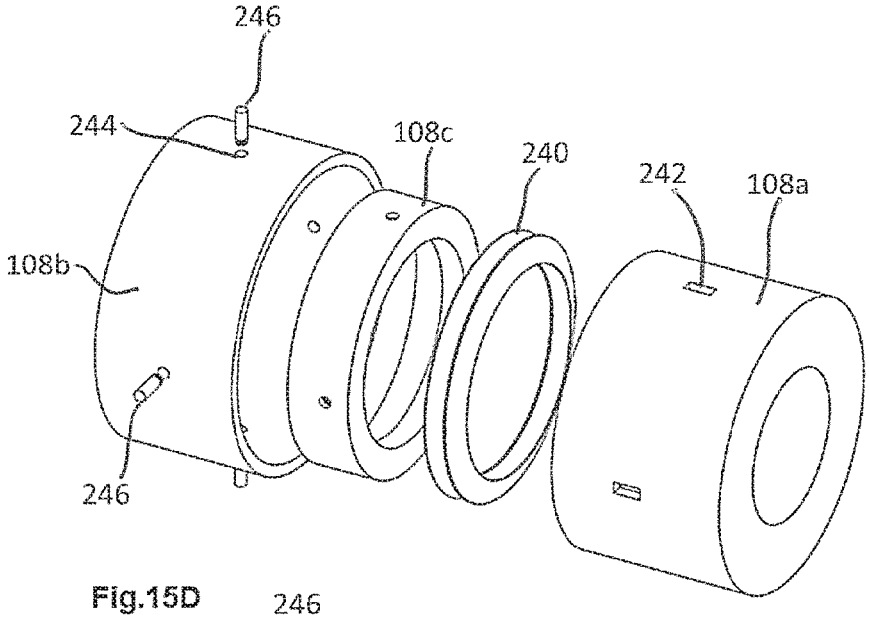
Figure 15E:
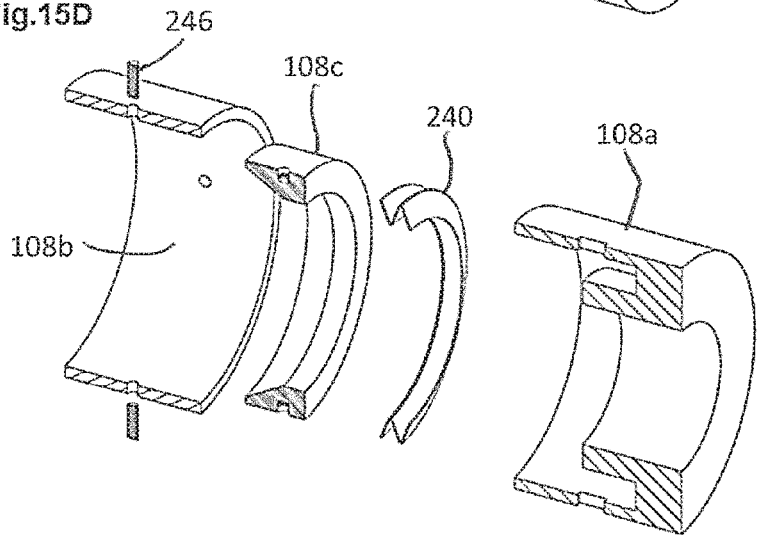

FIGS. 15-15E illustrate a connector assembly 212 similar to the connector assembly shown in FIGS. 14-14E but wherein the pins 246, which has threads on each respective lower end, are screwed into the bores of the third sub-component 108*c*. The bores 244 of second housing sub-component 108*b* simply allow the pins 246 to pass therethrough. Further, the third sub-component 108*c* incorporates threaded bores instead of a ring groove to receive the pins. Other suitable types of coupling a pin to a bore are contemplated.

Figure 16A:
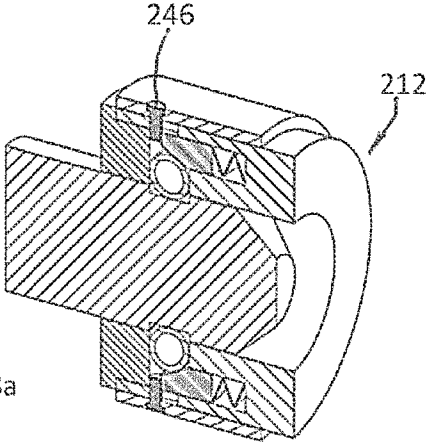
Figure 16C:
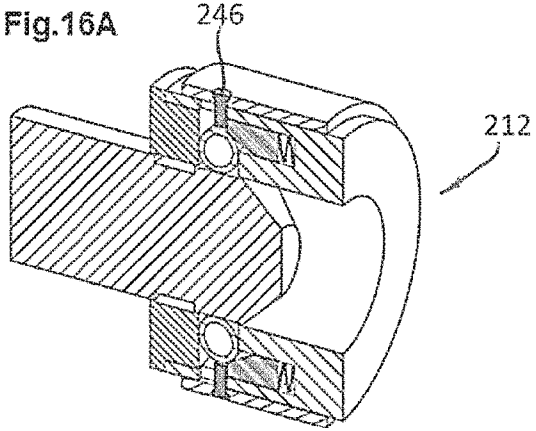
Figure 16:
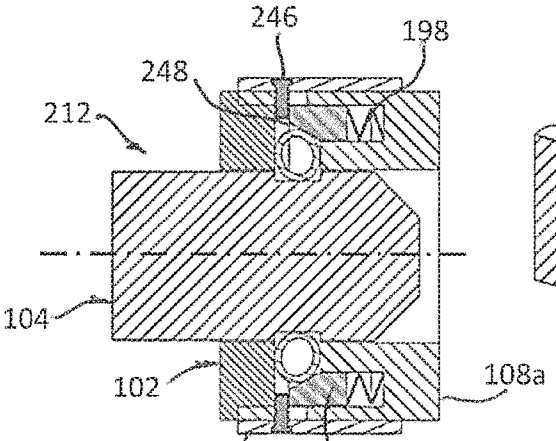
Figure 16B:
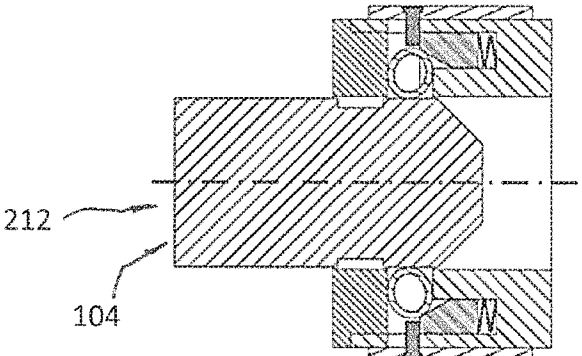
Figure 16D:
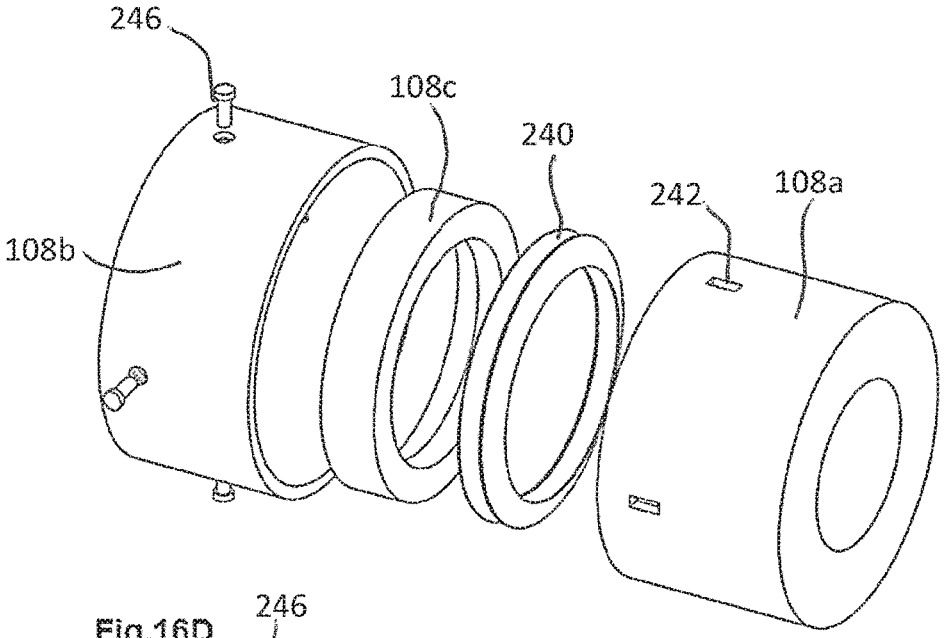
Figure 16E:
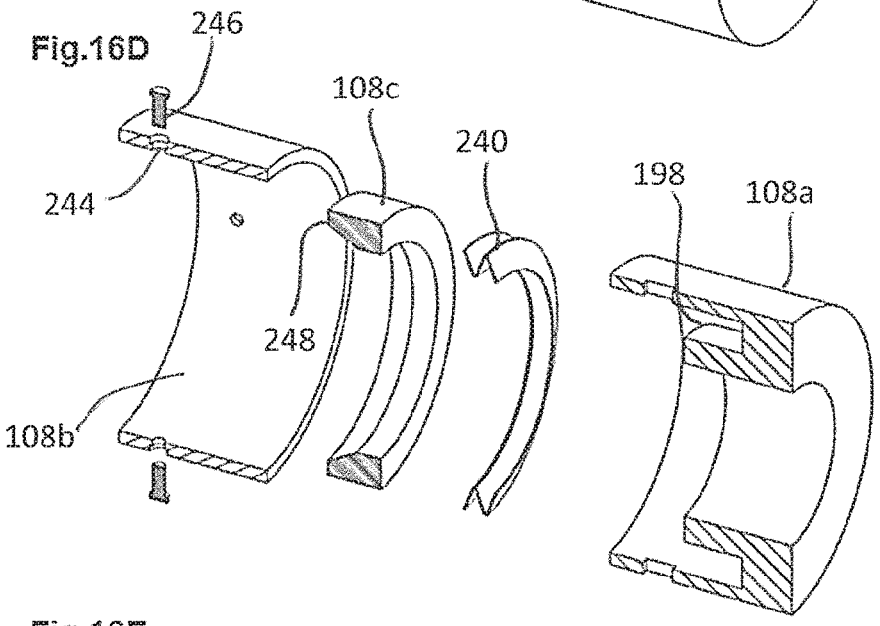

FIGS. 16-16E illustrate a connector assembly 212 similar to the connector assembly shown in FIGS. 14-14E but wherein the pins 246 are either press-fit or screwed into the bores 244 of the second housing sub-component 108*b* and wherein the free end of one or more of the pins 246 abut or contact and end edge 248 of the third housing sub-component 108*c*. Other suitable types of coupling a pin to a bore are contemplated.

Figures 17, 17A, 17B, 17C, 17D, 17E:
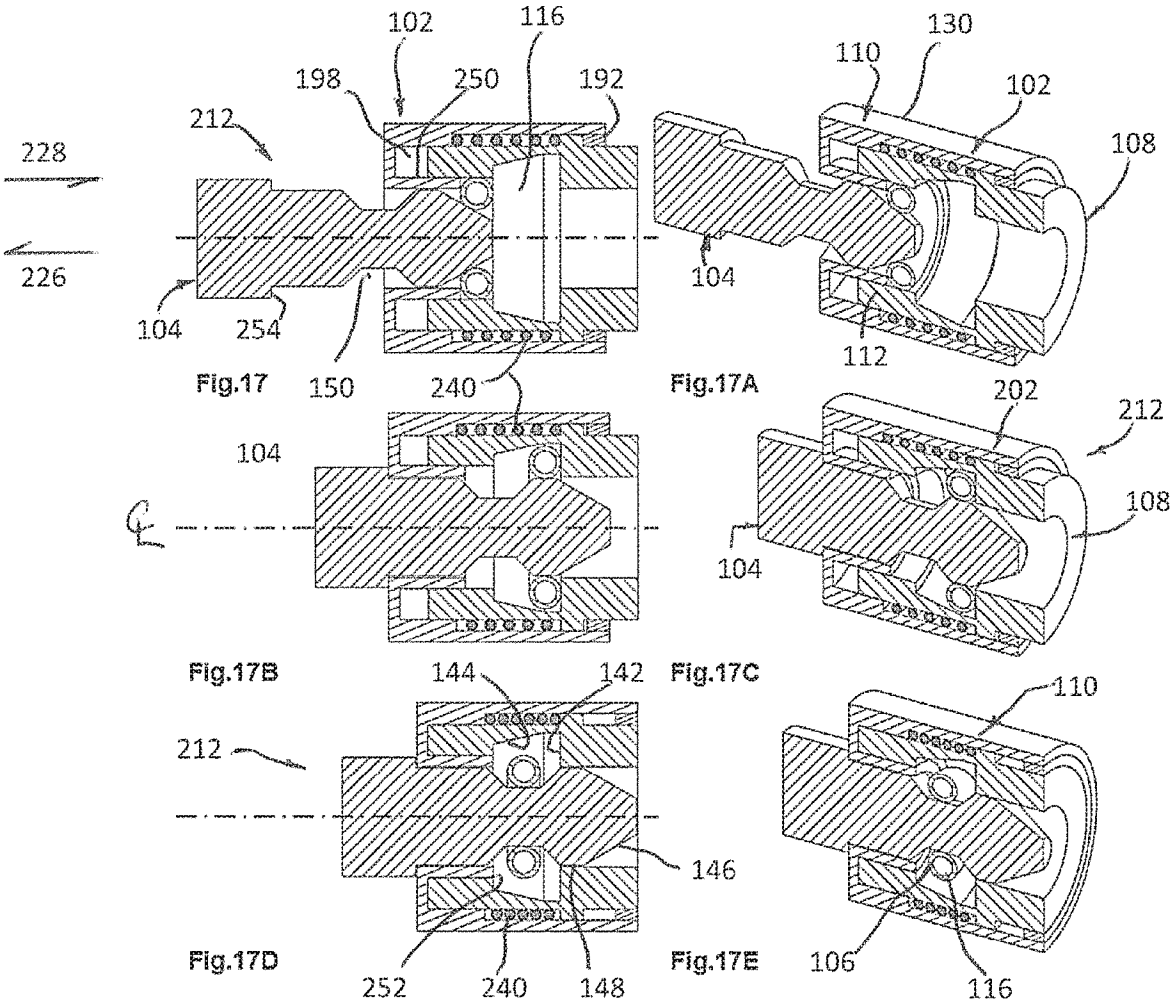
FIGS. 17, 17A, 17B, 17C, 17D, 17E, 17F, 17G, 17H, 17I, 17J, and 17K show the connection-disconnection sequence of a connector assembly comprising a housing, a shaft and a helical or ribbon spring, wherein the housing comprises two components.
Figures 17F, 17G, 17H, 17I, 17J, 17K:
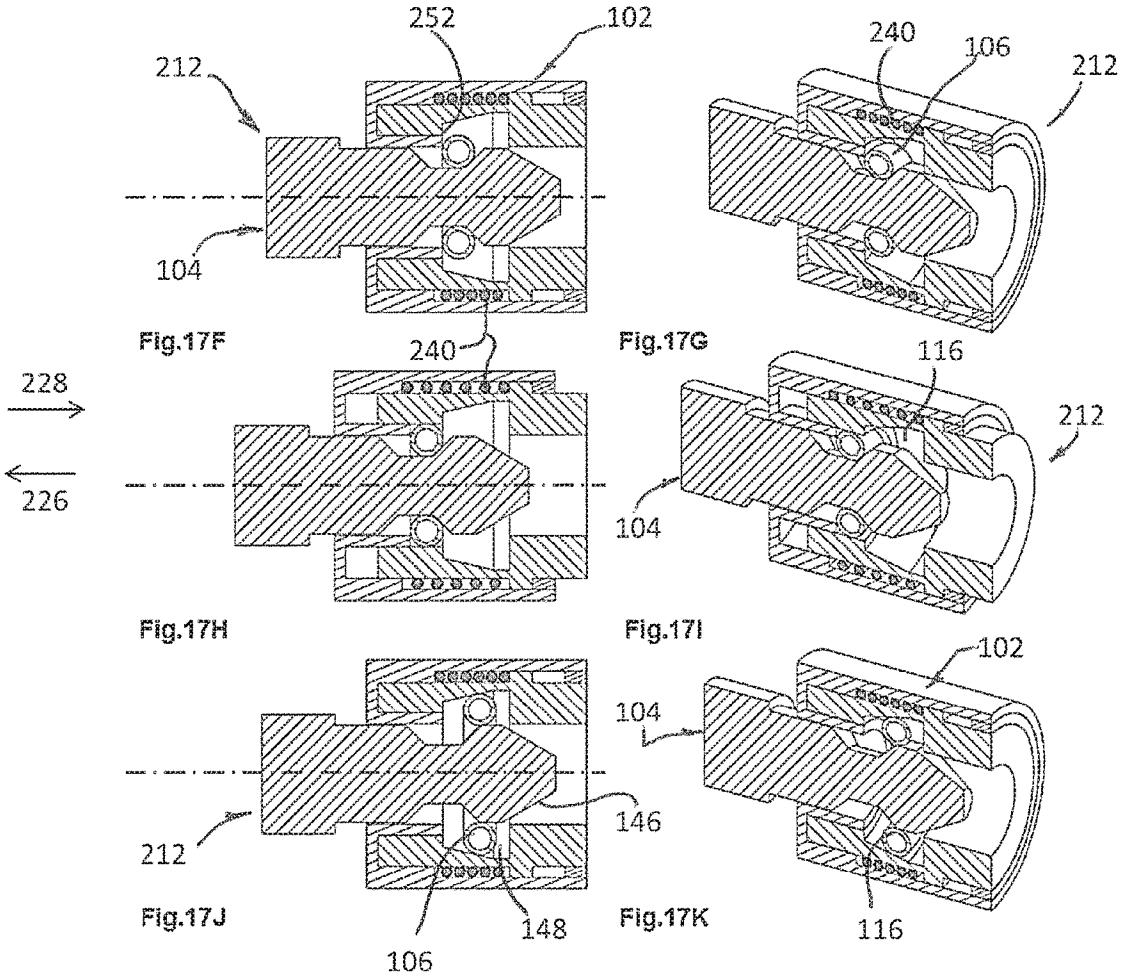
Figures 1, 17:
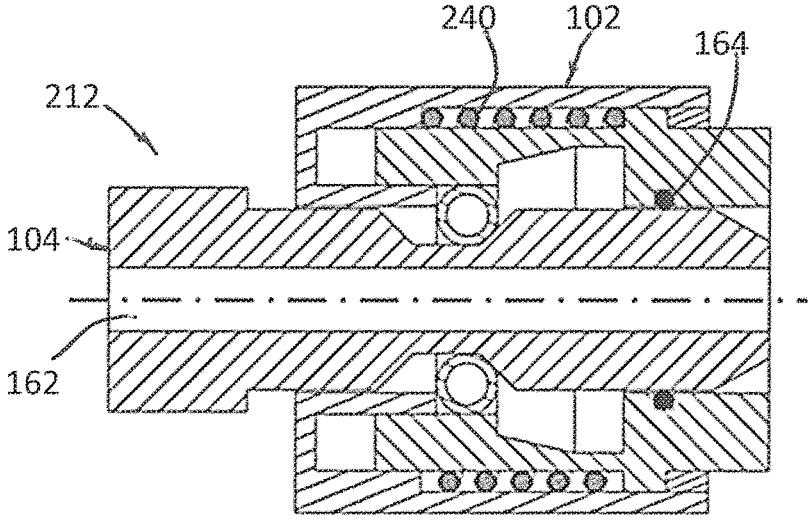
Figures 1A, 17:
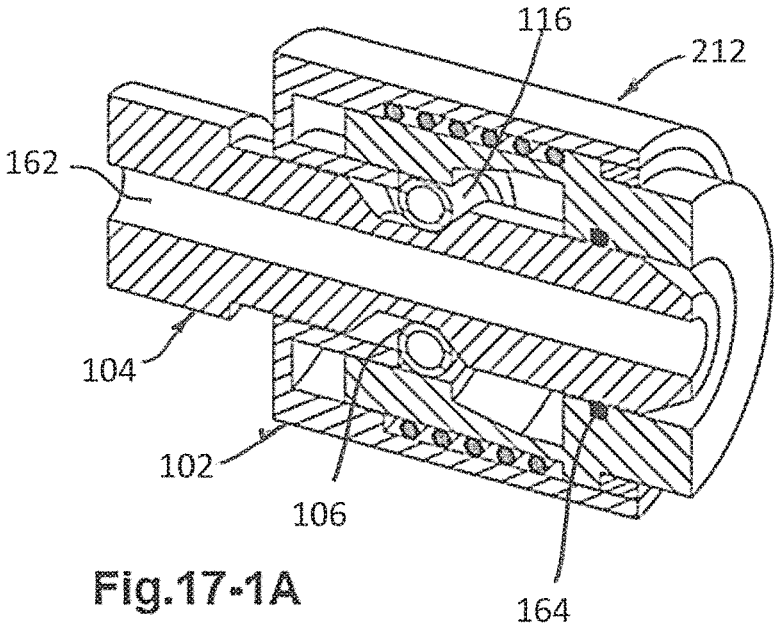

FIGS. 17-17K show a connector assembly 212 provided in accordance with another embodiment of the present device, system, and method. FIGS. 17-17K show the connect-disconnect sequence of the connector assembly 212, which comprises a housing 102 with a housing groove 116 and a pin 104 with a pin groove 150. The pin 104 incorporates a shoulder 254 for abutting against the inlet end wall 124 of the housing to stop further advancement of the pin into the housing 102 along the first direction 228. Also, FIG. 17A is a perspective view of FIG. 17, FIG. 17C is a perspective view of FIG. 17B, FIG. 17E is a perspective view of FIG. 17D, FIG. 17G is a perspective view of FIG. 17F, FIG. 17I is a perspective view of FIG. 17H, and FIG. 17K is a perspective view of FIG. 17J. In the present embodiment, the housing 102 comprises a first housing component 108 and a second housing component 110. The second housing component 110 and the first housing component 108 together define a housing groove 116.

In the figures, the second housing component 110 has an outer body 130 and an inner body 250 defining an annular space therebetween for receiving the body portion 112 of the first component 108. With specific reference to FIG. 17B, the housing groove 116 has a bottom wall 144 and a sidewall 142 defined by the first component 108 and a second sidewall 140 defined by both the first component 108 and the second housing component 110, specifically by an end surface of the inner body 250. A spring 106 is disposed in the housing groove 116, which may be a helical spring or a canted coil spring. The sidewall 140 formed by both components 108, 110 may be referred to as a mixed sidewall 252. Thus, as the first and second housing components 108, 110 move relative to one another, the height of the mixed sidewall 252 can change, as further discussed below.

A biasing member 240 is located in a recessed section of the annular space 198 for restraining relative movement between the first and second components 108, 110, similar to the same structures discussed elsewhere herein. In the present embodiment, the biasing member 240 abuts a shoulder on the first housing component and a shoulder on the second housing component. A retaining collar 192 is used to retain the two components 108, 110 together after assembly.

In the present embodiment, the housing groove 116 can change from a first housing groove dimension or size to a larger second housing groove dimension or size, which is understood to mean a larger grove width, a larger groove depth, or both. In one example, the first housing component 108 and the second housing component 110 can move relative to one another to change the housing groove dimension. In the example shown, the first housing component 108 is configured to move away from the second housing component 110 to increase the housing groove width and depth. In combination with the geometry of the pin groove 150, which has two tapered surfaces subtended by a flat bottom surface, the spring 106 may be repositioned along the width of the housing groove 116, as further discussed below, to allow for movement of the connector through the various states, as further discussed below.

The present connector assembly 212 may operate in a similar way as other connector assemblies discussed elsewhere herein. The connector 212 has a first latched state (FIGS. 17H and 17I) and a second latched state (FIGS. 17D and 17E). The present connector assembly also has a transit state. Looking first at FIGS. 17 and 17A, the connector assembly 212 is in the process of being latched by moving the pin 104 in the first direction 228 into the housing 102. FIGS. 17B and 17C show further insertion of the pin 104 into the housing until the pin shoulder 254 abuts the inlet end wall 124. During this process, the spring 106 is advanced by the tapered inlet end 146 of the pin until the spring 106 hits the sidewall 142 of the housing groove, which then forces the spring 106 to expand to reposition onto the landing area 148 of the pin. To activate the connector, the first housing section 108 is moved in the second direction 226 until the body section 112 bottoms out against the inside surface of the end wall 124 of the second body section 110. During this process, the spring 106 is pushed off of the landing area by the sidewall 142 and into the common groove, as shown in FIGS. 17D and 17E, and the biasing member 240 is also compressed in the annular space 196 by the two shoulders.

FIGS. 17F and 17G show the pin 104 moving in the second direction 226 in an attempt to disconnect from the housing 102. During the process, the spring 106 is moved within the common groove by the mixed sidewall 252. However, further retraction by the pin cannot deflect the spring to permit separation due to the contact point of the mixed sidewall 252 against the spring, being near the spring's major axis, which does not deflect.

FIGS. 17H and 17I show the housing being deactivated by moving the two housing components 108, 110 away from one another, which movement is aided by the expanding biasing member 240. The housing 102 configuration appears similar to that of FIGS. 17 and 17A except for the location of the spring, which is being constrained by the pin groove 150 and both the first and second housing components 108, 110. To enable removal of the pin from the housing, the spring 106 must first slide over to the landing area 148 on the pin 104. To do so, the housing is again activated to enlarge the common groove and allow the spring 106 to expand while at the same time moving the pin 104 in the second direction 226, as shown in FIGS. 17J and 17K. From this position, the pin 104 can separate completely from the housing 102.

In the present embodiment, the biasing member 240 is a helical spring. In other examples, the biasing member can be wavy springs or Belleville springs. The two components 108, 110 may also be threaded together. Other suitable engagement means fall within the scope of this application. Moreover, the spring 106 located in the housing groove may be a ribbon spring or a cantilever spring.

FIGS. 17-1 and 17-1A show a connector assembly 212 provided in accordance with yet another aspect of the present disclosure. The connector assembly 212 is similar to the connector assembly shown in FIGS. 17 to 17K but wherein a passage 162 is provided through the shaft to allow a fluid to flow through and an O-ring 164 is incorporated to provide sealing to prevent leakage of such fluid.

Figure 18D:
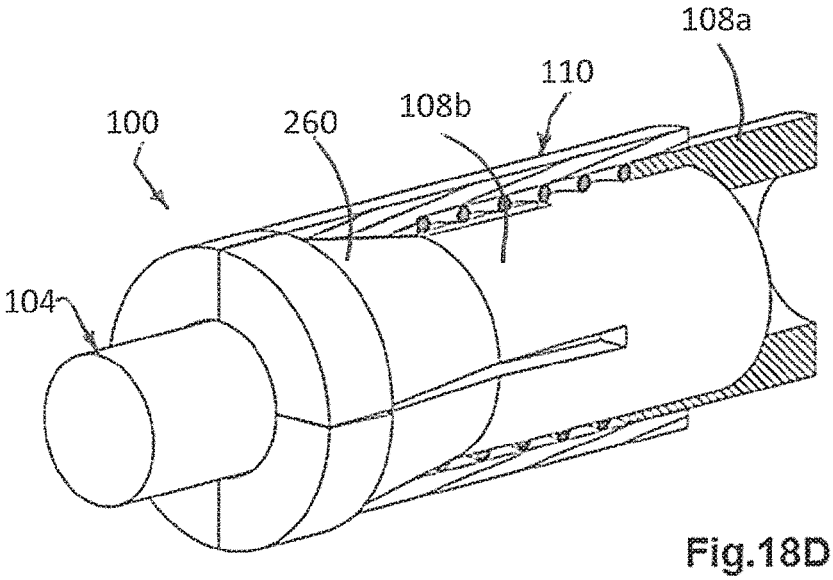
Figure 18E:
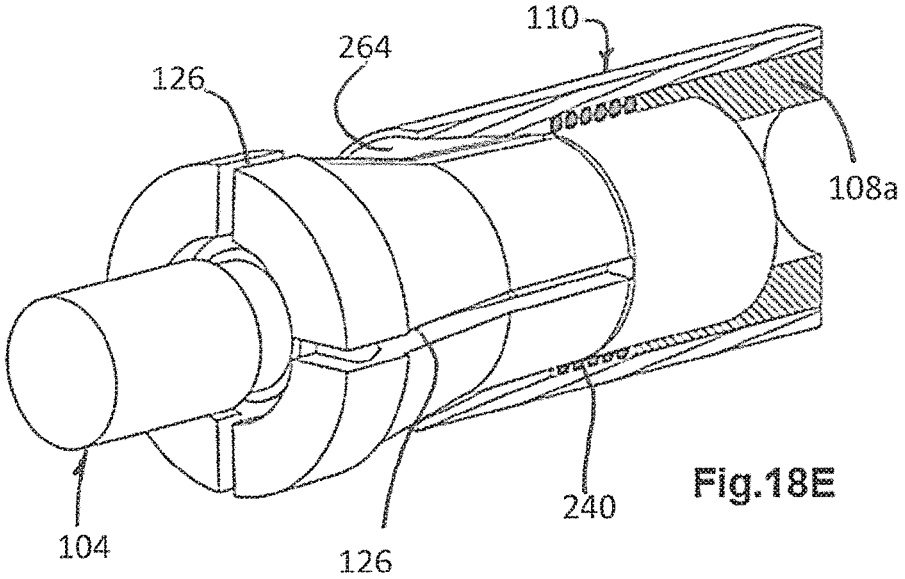

FIGS. 18-18E illustrate a connector assembly 100 provided in accordance with yet other alternative aspects of the present disclosure. The connector 100 is similar to the connector assembly shown in FIGS. 1 to 1E with several exceptions. In the present embodiment, the first housing component 108 comprises a first housing sub-component 108*a* and a second housing sub-component 108*b*. The first housing sub-component 108*a* comprises a receiving end 256 for receiving a body end 258 of the second housing sub-component 108*b*, which has a body portion 112 comprising a plurality of slits 126 defining a plurality of collapsible extending members 128 (FIGS. 18D and 18E). The receiving end 156 and the body end 258 of the first and second sub-components define a shoulder for supporting one of the ends of the biasing member 240 while the other end of the biasing member is supported by a shoulder formed in the second housing component 110. The biasing member 240 is held in the annular space 198 for restraining movement between the first and the second components 108, 110, as discussed above.

With further reference to FIGS. 18B, 18C, and 18E, the body portion 112 has an enlarged end 121 and an elongated sloping body contour 260 defining a shoulder 262 therebetween. The sloping contour 260 is sized and shaped to fit with a corresponding tapered bore 264 on the second housing component 110. When the first and the second housing components are activated 108, 110, the two sloped surfaces 260, 264 form a line contact and the end surface on the second housing component 110 abut the shoulder 262 on the body portion 112.

The present connector assembly 110 may operate in a similar way as other connector assemblies discussed with reference to FIGS. 1-1E. The present connector 100 has a first latched state (not shown) and a second latched state (FIGS. 18, 18A, and 18D). The present connector also has a transit state that requires different force to move due to the biasing element 240, as discussed above. For example, when de-activating the housing 102, as shown in FIG. 18B, the biasing element 240 is compressed, which requires more force than when activating the housing 102 (as shown in FIG. 18) due to the biasing element 240 expanding and assisting with the movement. The two first and second components may also incorporate temporary straining means to maintain the biasing member 240 in the compressed state. In some examples, the corresponding sloped surfaces create an interference to retain the spring in the compressed state.

Figure 19A:
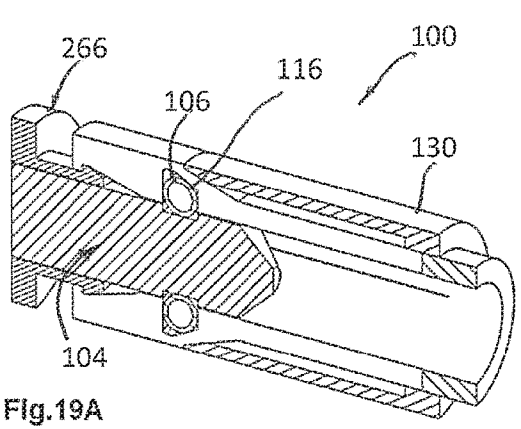
FIGS. 19, 19A, 19B, 19C, 19D, 19E, 20, 20A, 20B, 20C, 20D, and 20E show similar connector assemblies comprising a housing, a shaft and a canted coil spring, wherein the housing comprises two components and the assemblies are shown in different stages of connect/disconnect.
Figure 19C:
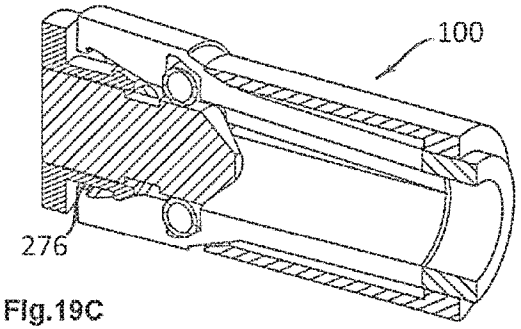
Figure 19:
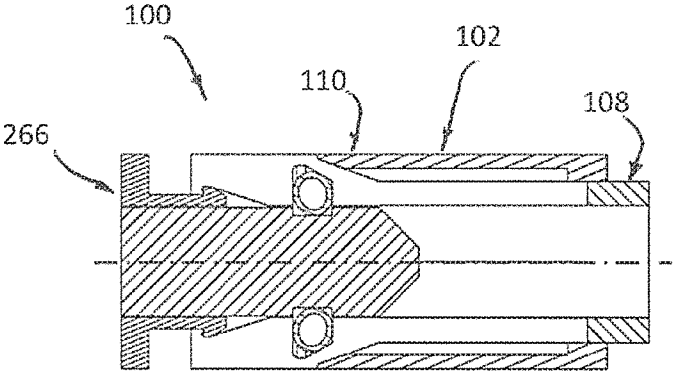
Figure 19B:
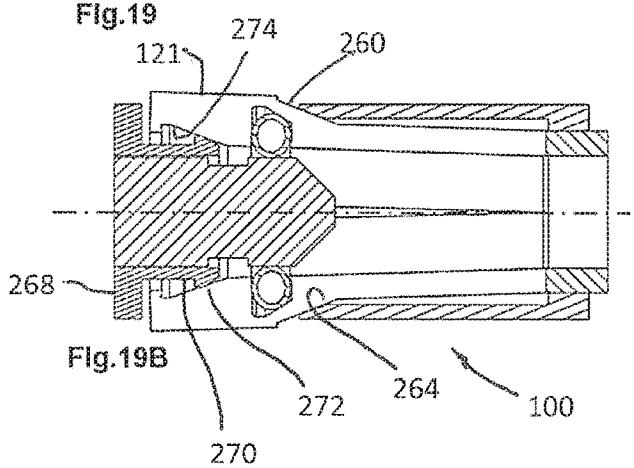
Figure 19D:
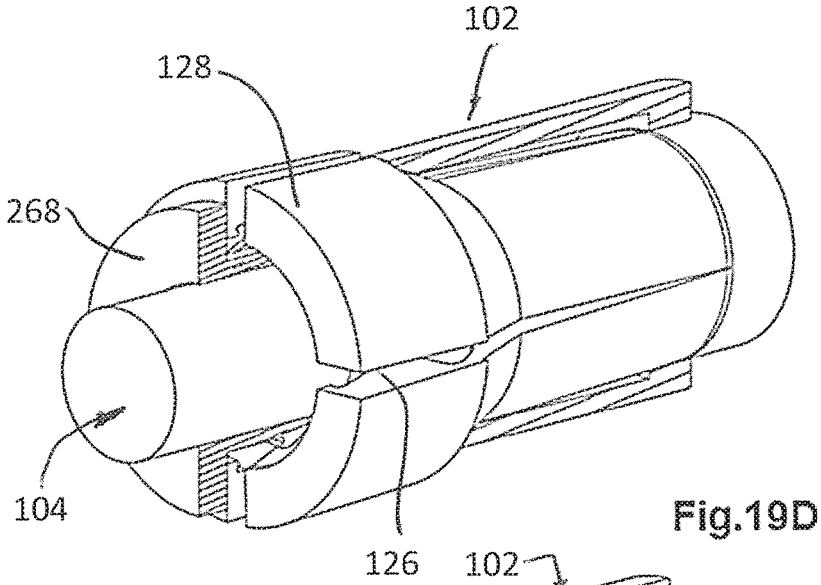
Figure 19E:
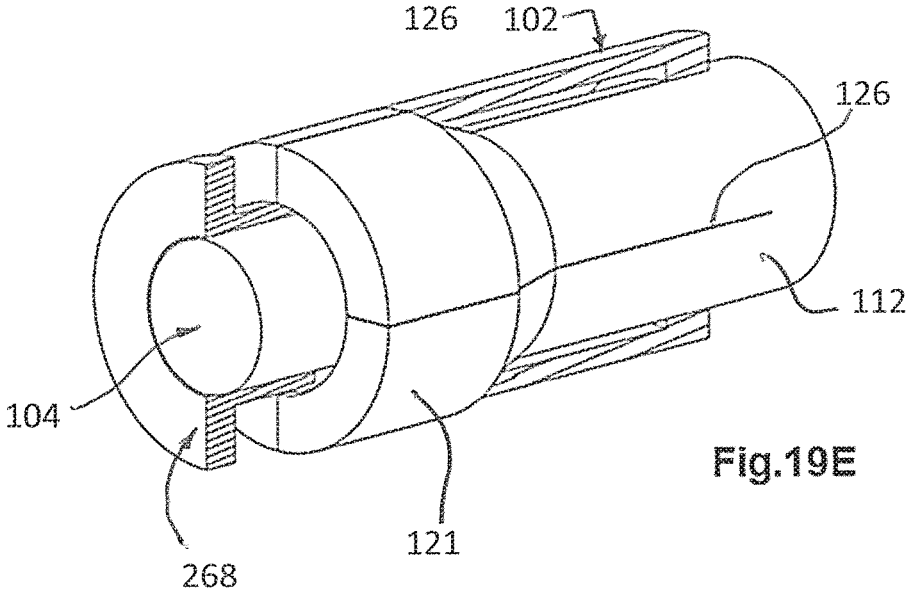

FIGS. 19-19E illustrate a connector assembly 100 provided in accordance with yet another alternative aspects of the present disclosure. The connector 100 is similar to the connector assembly shown in FIGS. 1-1E and with 18-18E with a few exceptions. In the present embodiment, the first housing component 108 is made from a single unitary body and does not incorporate a biasing element for activation and de-activation, like that of FIGS. 1-1E. However, the body portion 112 of the first housing component 108 incorporates a sloping contour 260 and a corresponding sloping bore 264 in the second housing component 110, similar to the connector of FIGS. 18-18E. The slopes also differ in that the present embodiment utilizes a steeper slope for the sloping contour and the sloping bore.

In the present embodiment, an activator 266 is provided on the pin 104. As shown, the activator comprises a flange 268, a body section 270 fitted over the pin 104, and a projection 272 having a sloping exterior surface provided at an end thereof. Part of the body section 270 and the projection 272 are located inside the body portion 112 of the first housing component 108, which has a tapered inlet bore 274 and a lip 276 at an end thereof. The housing groove dimension 116 can increase when the housing 102 is de-activated, as discussed above. Additionally, the activator 266 may be pushed axially along the first direction 228 relative to the pin 104 to expand the collapsible extending members 128 on the first housing component 108, as shown in FIG. 19B. This allows the housing groove 116 to expand to loosen the constraint on the spring 106. The pin 104 can now be retracted from the housing 102 by moving in the second direction 226 to separate the pin from the housing. Once the pin 104 is removed, the activator 266 remains with the housing 102.

The present connector assembly 110 may operate in a similar way as discussed with the connector assembly of FIGS. 1-1E and modified by the activator 266.

Figures 20, 20A, 20B, 20C:
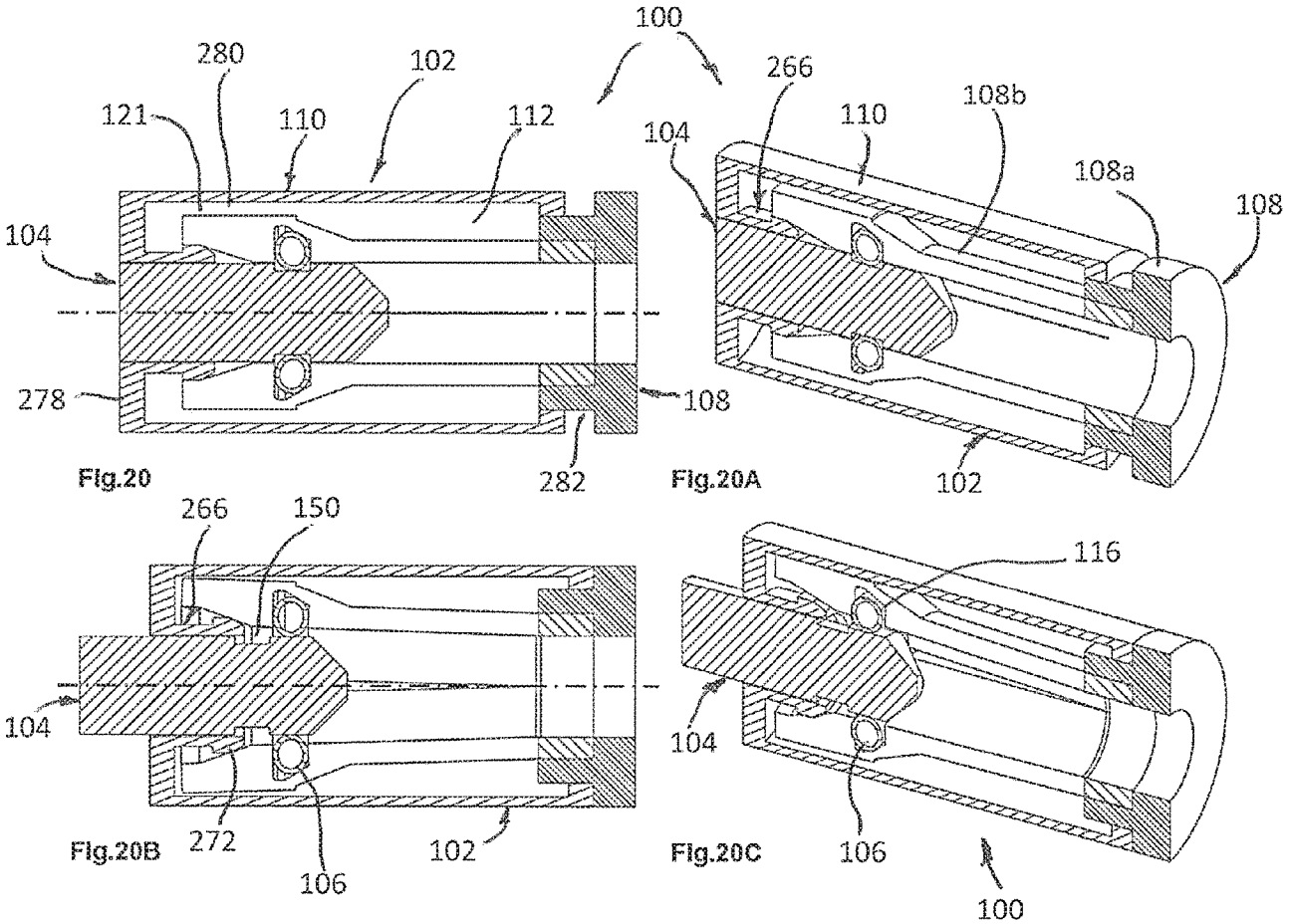
Figure 20D:
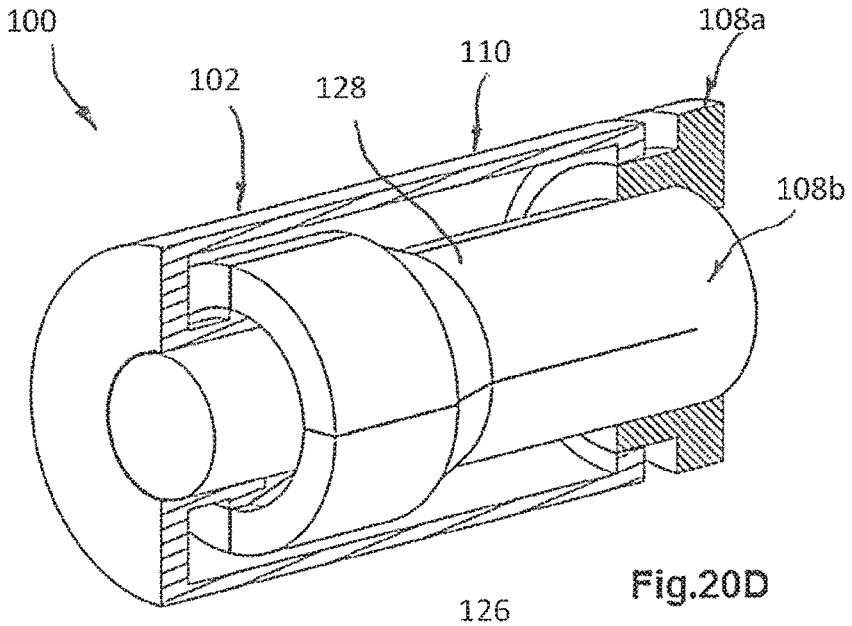
Figure 20E:
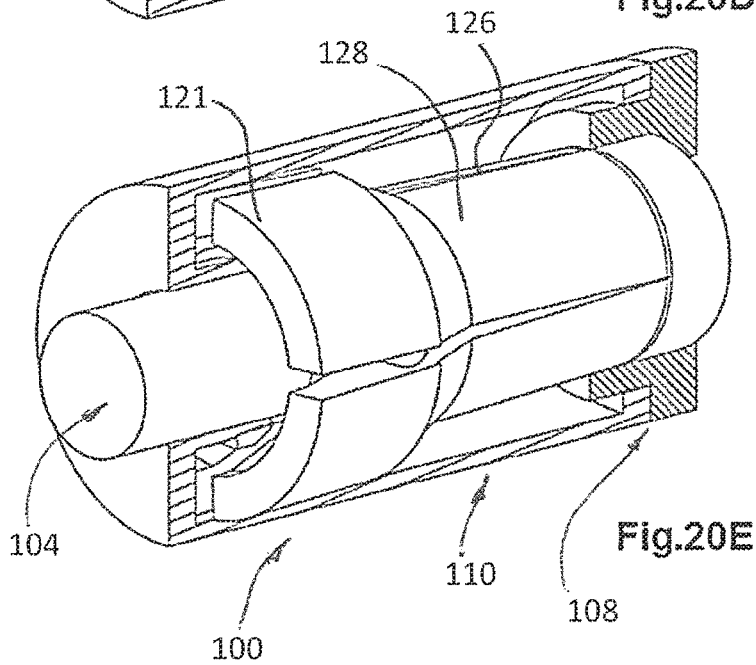

FIGS. 20-20E illustrate a connector assembly 100 similar to the connector assembly shown in FIGS. 19-19E. In the present embodiment, the second housing component 110 is integrated with the activator 266. As shown, the activator 266 is unitarily formed with the second housing component 110 via an end wall 278. Additionally, a gap 280 is provided between the interior surface of the second housing component 110 and the enlarged section 121 on the body section 112 of the first housing component 108, which is formed with a first housing sub-component 108*a* and a second housing sub-component 108*b*.

Another different aspect of the present connector is in activating and de-activating the housing 102. As shown in FIGS. 20, 20A, and 20E, the housing is activated by moving the first and second housing components 108, 110 away from one another so that there is a gap 282, i.e., the two are not bottomed out. In this configuration, the projection 272 on the activator 266 is moved further away from the housing groove 116 to not bias the collapsible extending members 118 outwardly, which would increase the housing groove dimension. To de-activate the housing 102, the two housing components 108, 110 are moved towards one another so that they bottom out, which also causes the projection 272 on the activator 266 to bias the collapsible members 128 outwardly to enlarge the common groove.

The present connector assembly 110 may operate in a similar way as discussed with the connector assembly of FIGS. 19-19E and modified by the integrated activator 266 with the second housing component 110.

These housing components of FIGS. 19-20E are shown engaged via frictional contact surfaces at the outer surface of the housing. However, at such location, they may be threaded together instead or sprung together by means of wavy springs, a Belleville spring or a helical spring for example. Further, in both cases the figures show a groove on the shaft and a housing mounted canted coil spring. However, the same connector assembly but having no groove on the shaft falls within the scope of this application, as well as the same connector assembly but having a shaft mounted canted coil spring instead, with and without a groove in the housing.

Figures 1, 1A, 2, 2A, 21, 21A:
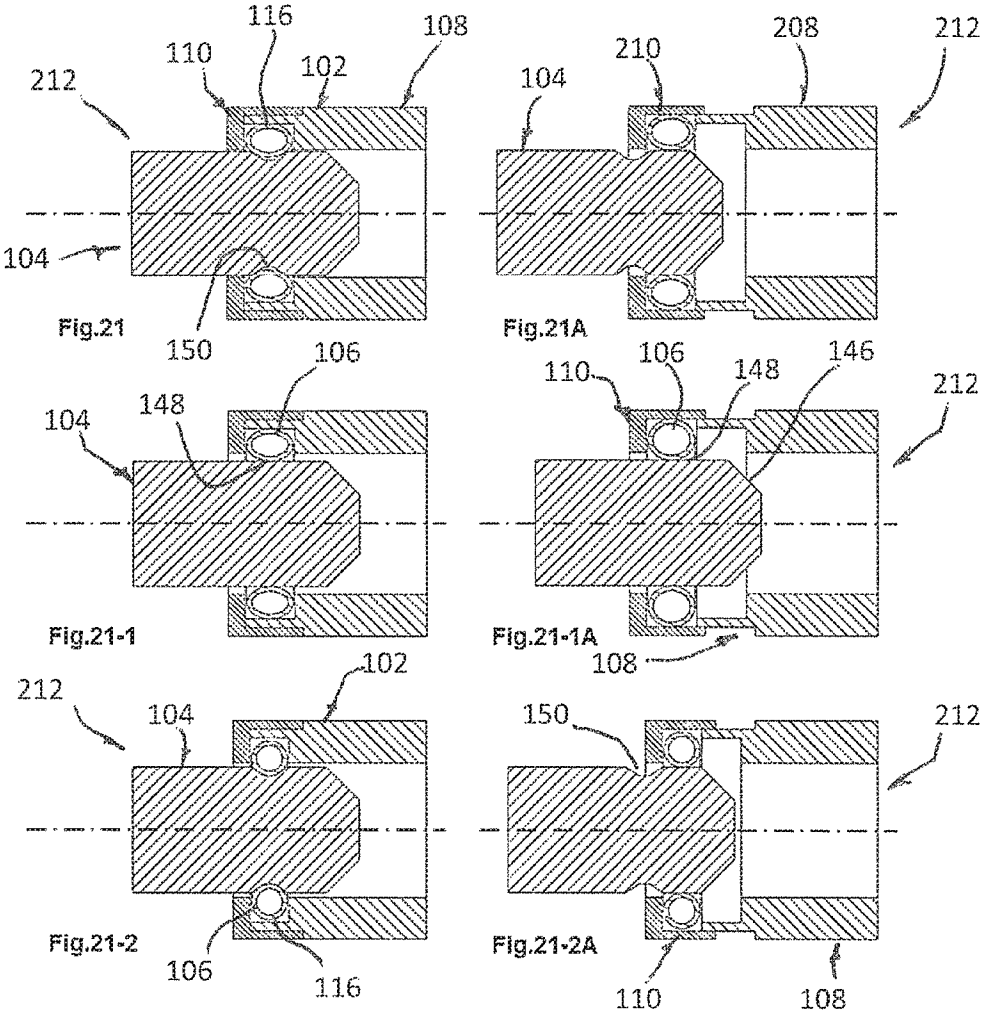

FIGS. 21-21A illustrate a connector assembly 212 provided in accordance with another embodiment of the present device, system, and method, which comprises a housing 102 with a housing groove 116 and a pin 104 with a pin groove 150. The present connector is similar to the connector shown and described with reference to FIGS. 13-13C but without an insert ring 238. The present connector assembly 110 may operate in a similar way as discussed with the connector assembly of FIGS. 13-13C and modified to function without the insert ring.

FIGS. 21-21A show the first and second components 108, 110 being engaged via frictional contact surfaces. These two components may be threaded together instead, or sprung together by means of wavy springs, a Belleville spring or a helical spring for example. Exemplary threaded engagement between the housing components is shown with reference to FIG. 27-1.

FIGS. 21-1 and 21-1A illustrate a connector assembly 212 provided in accordance with another embodiment of the present device, system, and method, which comprises a housing 102 with a housing groove 116 and a pin 104. However, in the present embodiment, the pin 104 does not incorporate a groove, i.e., there is no pin groove for latching with the spring. Thus, the present connector assembly may be considered a holding connector in that the spring is not latched by a common groove as there is only a single groove in the housing. In other examples, the single groove is on the shaft and not the housing. Further, as the housing 102 is de-activated, the holding force on the shaft is reduced since the housing groove is enlarged and therefore the deflection on the spring is reduced by the enlarged groove.

FIGS. 21-2 and 21-2A illustrate a connector assembly 212 provided in accordance with another embodiment of the present device, system, and method, which comprises a housing 102 with a housing groove 116 and a pin 104 with a pin groove 150. The present connector is similar to the connector of FIGS. 21 and 21-A except wherein the spring 106 is a helical spring or a ribbon spring instead of a canted coil spring.

Note that while FIGS. 21 to 21-2A all illustrate connector assemblies with housing mounted springs. However, similar connector assemblies with shaft mounted springs also fall within the scope of this application, as well as other types of spring means, such as cantilever springs.

Figures 1, 1A, 2, 2A, 22, 22A:
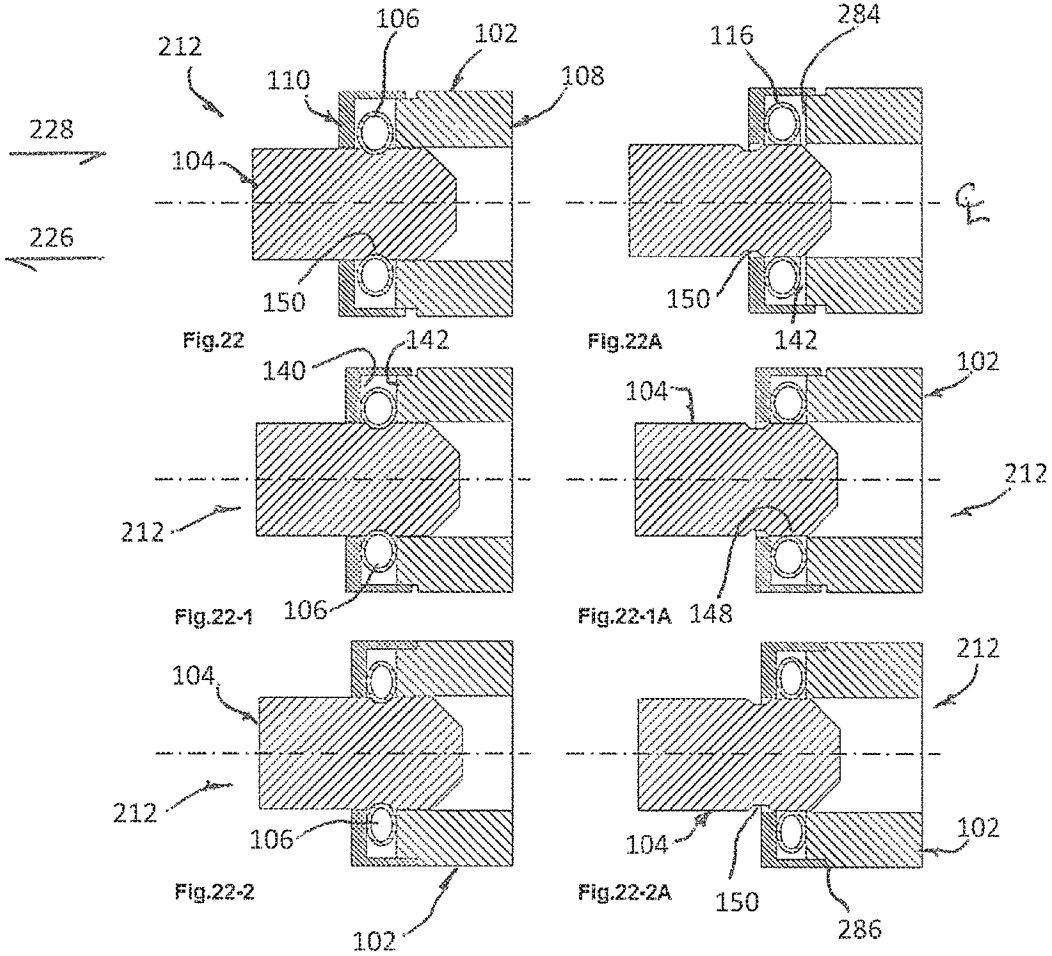

FIGS. 22 to 22-2A illustrate a connector assembly 212 provided in accordance with another embodiment of the present device, system, and method, which comprises a housing 102 with a housing groove 116 and a pin 104 with a pin groove 150. The present connector is similar to the connector of FIGS. 13-13C but without an insert ring 238 and wherein the spring 106 is an axial canted coil spring. A first relative movement of the first and second components 108, 110 (FIGS. 22 and 22A) results in a first configuration that results in a first shaft insertion force and a first shaft removal force. In particular, a gap 284 is provided between the spring 106 and at least one of the two sidewalls 140, 142 of the housing groove. Thus, the spring is not biased along the coils' minor axes due to the presence of the gap 284.

FIG. 22-1 shows the two housing components 108, 110 moving closer together so that the spring 106 is slightly biased by the two housing groove sidewalls 140, 142. FIG. 22-1A shows the pin being moved in the second direction 226 so that the spring is now in the landing area 148 of the pin 104. This sequence may be referred to as the second relative movement for the first and second housing components 108, 110.

FIGS. 22-2 and 22-2A show similar movement for the two housing components 108, 110 but wherein the spring 106 is more compressed compared to that shown in FIGS. 22-1 and 22-1A. For example, the two components are moved so that they bottomed out 286. This further compressing on the spring 106 restricts the spring from expanding when the pin 104 moves to separate the common groove therefore producing a higher insertion or withdraw force.

The second and third relative movements of the first and second components 108, 110 shown in FIGS. 22-1/22-1A and 22-2/22-2A, respectively, result in a second and a third configuration, respectively, that result in a second and a third shaft insertion force, respectively, and a second and a third shaft removal force, respectively.

As shown in FIGS. 22 to 22-2A, the relative position of the first and second components 108, 110 determines the amount of deflection of the minor axis of the canted coil spring coils, which may contribute to different shaft insertion and removal forces. Other types of spring means, such as cantilever springs, may be used as well.

The figures show the first and second components being engaged via frictional contact surfaces. These two components may be threaded together instead, or sprung together by means of wavy springs, a Belleville spring or a helical spring for example. The figures also show a housing mounted spring means. A similar configuration but having a shaft mounted spring means is contemplated, as well as a configuration wherein only one of the housing and shaft has a groove.

Figure 23:
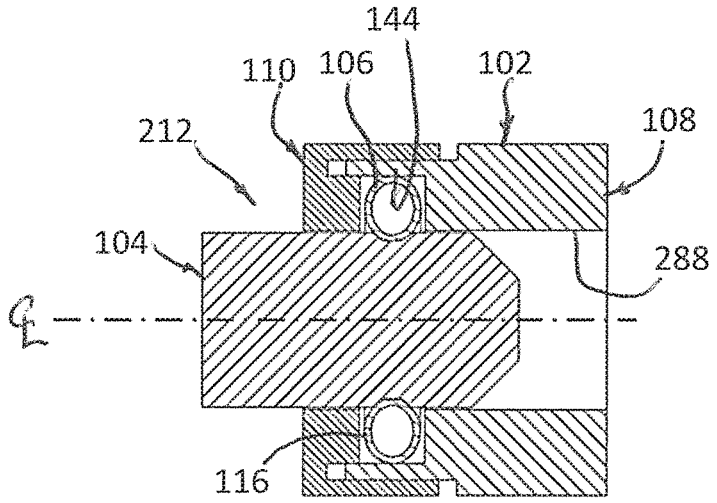
Figures 1, 23:
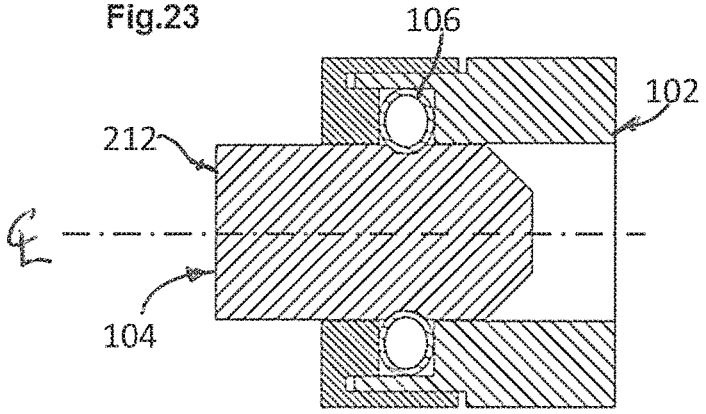
Figures 2, 23:
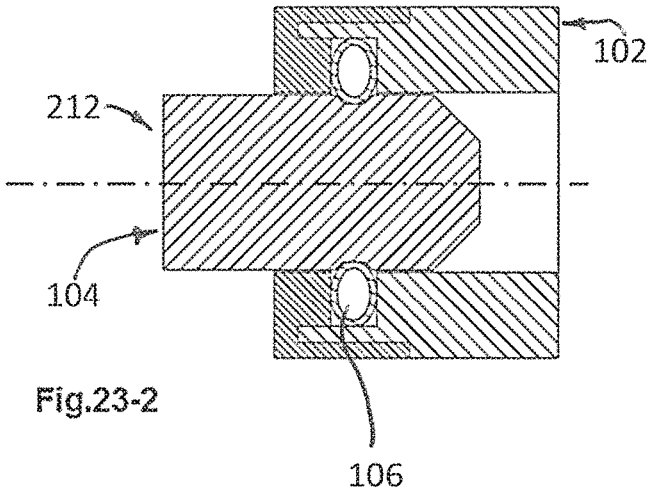

FIGS. 23 to 23-2 show a connector assembly 212 provided in accordance with another embodiment of the present device, system, and method, which comprises a housing 102 with a housing groove 116 and a pin 104 with a pin groove 150. The present connector is similar to the connector of FIGS. 13-13C but without an insert ring 238 and wherein the spring 106 is an axial canted coil spring. Further, the housing groove 116 has a depth that, as measured from the groove bottom surface 144 of the housing groove and a line drawn across the housing groove opening, such as line 288, has been reduced so that at least part of the axial canted coil spring contacts the bottom surface 144 and extends outside the housing groove. Reducing the groove depth limits the ability of the canted coil spring to expand and contract with respect to the longitudinal axis and may constrain the spring enough to require rotation and further deflection of the coils in order to remove the shaft, and thus may contribute to different shaft insertion and removal forces.

FIG. 23-1 shows the first and second housing components 108, 110 further activated and the gap 282 reduced between the two components compared to the same gap shown in FIG. 23. This in turn squeezes the spring to limit the spring's ability to expand and/or deflect.

FIG. 23-2 shows the first and second housing components 108, 110 fully activated and the gap 282 eliminated between the two components compared to the same gap shown in FIG. 23. This in turn further squeezes the spring to limit the spring's ability to expand and/or deflect.

Figure 24:
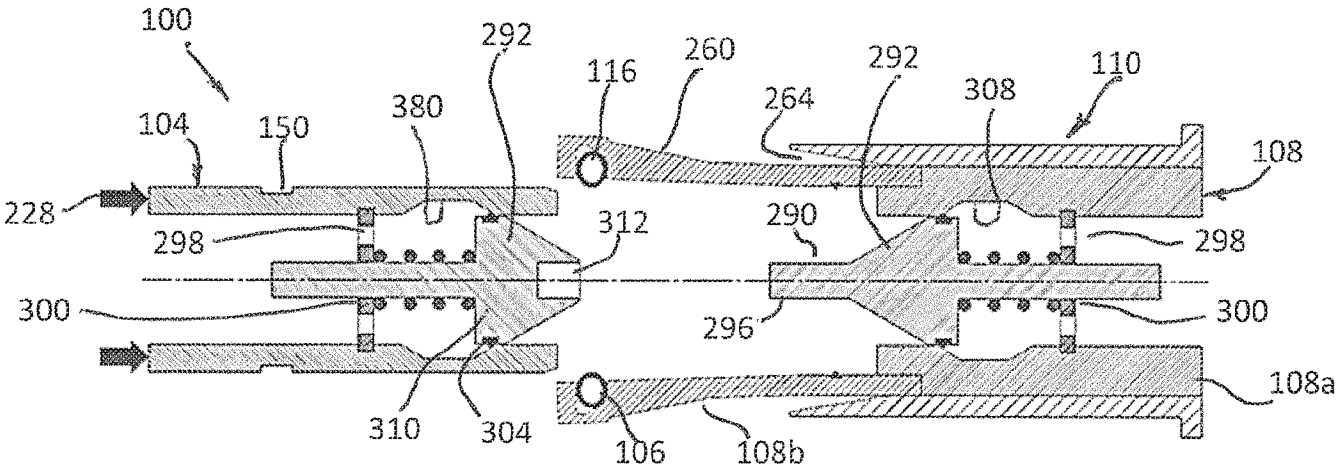
FIGS. 24, 24A, 24B, and 24C illustrate a connector assembly comprising a housing, a shaft and a canted coil spring, wherein the housing comprises two components and comprises a valve core and the assembly is shown in different stages of connect/disconnect.
Figure 24A:
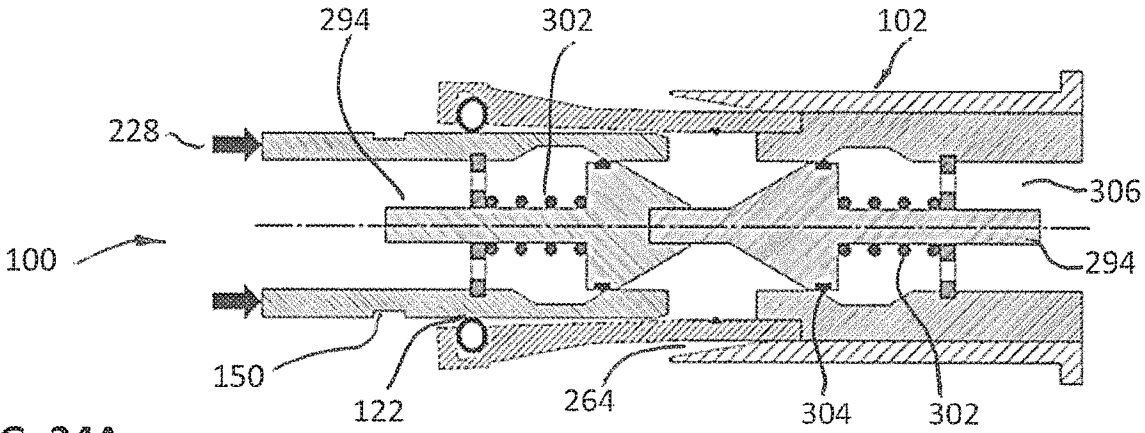
Figure 24B:
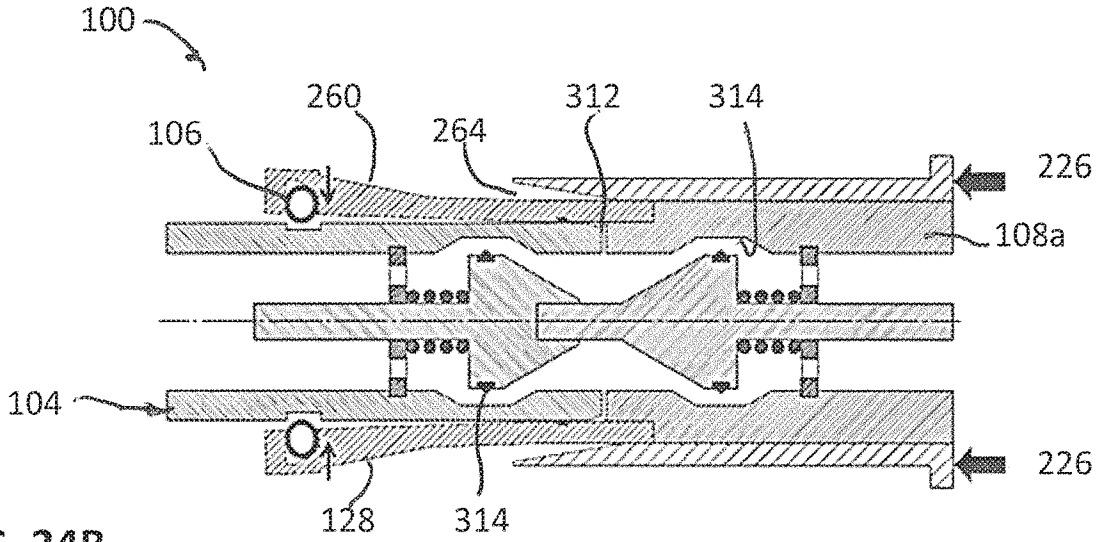
Figure 24C:
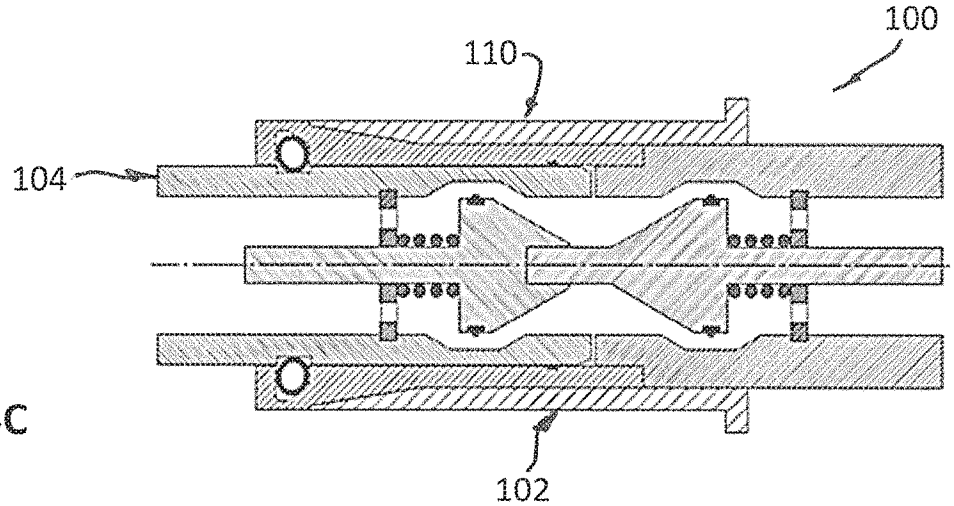

FIGS. 24-24C show a connector assembly 100 provided in accordance with another embodiment of the present device, system, and method, which comprises a housing 102 with a housing groove 116 and a pin 104 with a pin groove 150. The housing further comprises a first housing component 108 and a second housing component 110. The first housing component 108 further comprises a first housing sub-component 108*a* and a second housing sub-component 108*b*. The second housing sub-component 108*b* has a housing groove 116 formed therein and comprises a plurality of slits forming a plurality of collapsible members, similar to the connector of FIGS. 18-18C with a few exceptions. In the present embodiment, the annular space 198 and the biasing spring 240 housed in the annular space to bias the two housing components 108, 110 are eliminated. Further, the housing 102 and the pin 104 are both hollow to permit fluid flow to flow therethrough and each comprises structures or features for restricting flow when the connector is disconnected, as further discussed below.

To control flow through the connector assembly 100, the housing 102 and the pin 104 both incorporate a valve core that can be actuated. With reference initially to the housing 102, a male valve core 290 is shown comprising a stem body 292 comprising a stem or shaft 294 and a male coupling end 296. The male valve core 290 is supported internally of the housing by an anchor plate 298, which has a plurality of openings or passages formed therethrough to permit flow thereacross. The anchor plate 298 is stationary positioned in the interior cavity of the housing 102 and has a central bore 300 for receiving the stem 294. A biasing element 302, such as a compression spring, is mounted on the stem 294 to bias the male valve core 290 away from the anchor plate. An O-ring or other annular sealing member 304 is provided to seal the passage 306 of the housing. Internally of the housing 102, an enlarged cavity section 308 is provided as flow channels around the stem body 292, as further discussed below.

The pin 104 has a female valve core 310 located therein. The female valve core 310 comprises a stem body 292, a stem or shaft 294, and a female coupling end 312. The female valve core 310 is supported internally of the pin 104 by an anchor plate 298, which has a plurality of openings or passages formed thereon to permit flow thereacross. The anchor plate 298 is stationary positioned in the interior cavity of the pin 104 and has a central bore 300 for receiving the stem 294 of the female valve core 310. A biasing element 302, such as a compression spring, is mounted on the stem 294 to bias the female valve core 310 away from the anchor plate. An O-ring or other annular sealing member 304 is provided to seal the passage 306 of the housing. Internally of the pin 104, an enlarged cavity section 308 is provided as flow channels around the stem body 292, as further discussed below.

FIG. 24A shows the connector assembly 100 of FIG. 24 in the process, i.e., in a transit state, of latching. The pin may be inserted along the first direction, as shown by the arrows depicting the first direction 228. As shown, the pin 104 is inserted into the inlet opening 122 of the housing 102 and the male coupling end 296 engaging the female coupling end 312. However, as the spring 106 is not trapped between the common groove defined by the housing groove 116 and the pin groove 150, the connector is not yet latched in FIG. 24A.

FIG. 24B shows the pin 104 further inserted into the bore of the housing 102 until the spring 106 is trapped by the common groove defined by the housing groove and the pin groove in a first latched position. The extent of insertion of the pin into the housing may be controlled by bottoming the pin against a shoulder on the first housing sub-component 108*a*, as shown at 312. Concurrently, the male and female valve cores 290, 310 are compressed against the constraints of the two springs 302 to open up flow paths 314 around the stem bodies 292. Fluid can now flow between the pin 104 and the housing 102 through the flow paths 314.

To move the connector to a second latched state, the second housing component 110 is moved in the second direction 226, as shown in FIG. 24B, to activate the housing 102. Movement of the second housing component 110 moves the tapered bore 264 over the sloping body contour 260, as shown in FIG. 24C, to push the collapsible extending members 128 inward towards the lengthwise axis of the connector to constrain the spring 106 within the common groove and to prevent the pin 104 from separating from the housing 102. The spring 106 therefore acts like a lock to prevent the pin from separating from the housing.

FIGS. 24-24C show the first and second components 108, 110 being engaged via frictional contact surfaces. These two components may be threaded together instead, or sprung together by means of wavy springs, a Belleville spring or a helical spring for example. The figures also show a housing mounted spring means. A similar configuration but having a shaft mounted spring means is also contemplated, as well as a configuration wherein only one of the housing and shaft has a groove.

Figure 25:
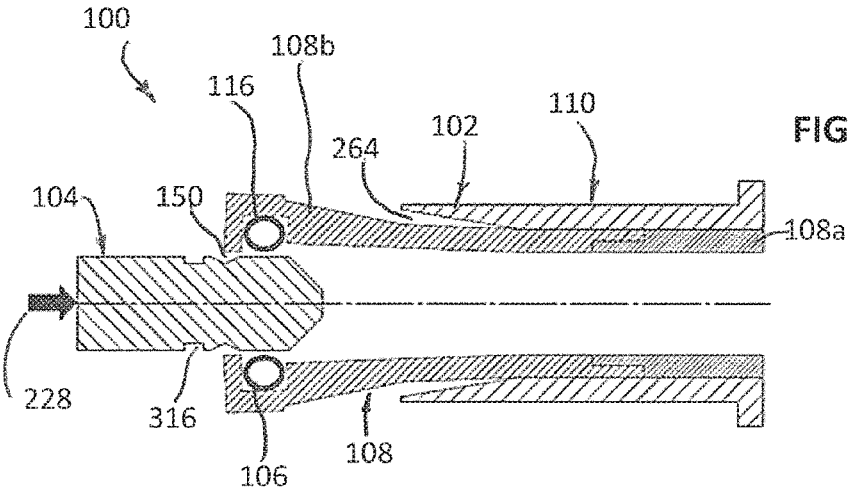
FIGS. 25, 25A, and 25B, illustrate a connector assembly comprising a housing, a shaft and a canted coil spring, wherein the housing comprises two components and the assembly is shown in different stages of connect/disconnect.
Figure 25A:
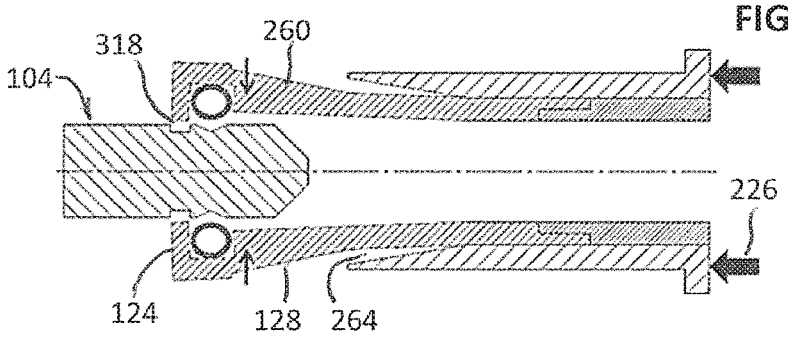
Figure 25B:
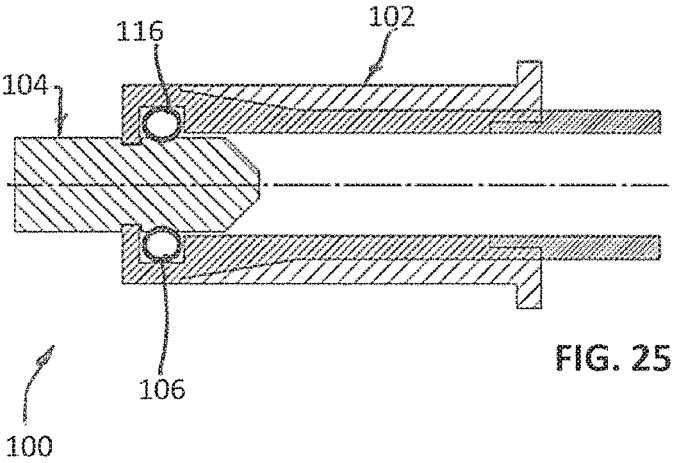

FIGS. 25-25B show a connector assembly 100 provided in accordance with another embodiment of the present device, system, and method, which comprises a housing 102 with a housing groove 116 and a pin 104 with a pin groove 150. The pin groove 150 in the present embodiment can be V-shape. The housing further comprises a first housing component 108 and a second housing component 110. The first housing component 108 further comprises a first housing sub-component 108*a* and a second housing sub-component 108*b*. The second housing component 108*b* has a housing groove 116 formed therein and comprises a plurality of slits forming a plurality of collapsible members, similar to the connector of FIGS. 18-18C with a few exceptions. In the present embodiment, the pin 104 incorporates a second pin groove or retention groove 316, which has a bottom wall located between two sidewalls. The second pin groove 316 is sized and shaped to receive the inlet end wall 124 of the second sub-component 108*b* when the housing 102 is activated, as further discussed below.

From the transit state of FIG. 25, the pin 104 can further be inserted in the first direction 228 to latch the spring 106 in the common groove in the first latched position, as shown in FIG. 25A. To activate the housing 102, the second housing component 118 is moved in the second direction 226 to push the tapered inlet bore 264 over the sloping contour portion 260 of the second sub-component 108*b*, as shown in FIG. 25B. At this point, the ends 318 of the inlet end wall 124 of the plurality of collapsible extending member 128 are pushed into the second pin groove 316. The pin 104 is now held fixed to the housing 102 by the engagement between the inlet end wall 124 and the second pin groove 316, which is additional to the engagement of the spring 106 by the common groove in the second latched state, shown in FIG. 25B. Note that during insertion of the pin 104 into the housing 102, as shown in FIG. 25, the collapsible members 128, the inlet end wall 124, and the pin diameter are structured so that they do not contact during the insertion step.

The spring 106 shown in FIGS. 25-25B is a radial canted coil spring. However, other spring means, such as an axial canted coil spring, a ribbon spring, a V spring, etc. may also be used. It is also possible to use multiple springs in series. Furthermore, while the first and second components 108, 110 are shown engaged via frictional contact surfaces, these two components may be threaded together instead, or sprung together by means of wavy springs, a Belleville spring or a helical spring for example. The figures also show a housing mounted spring means. A similar configuration but having a shaft mounted spring means is also contemplated, as well as a configuration wherein only one of the housing and shaft has a groove.

Figure 26:
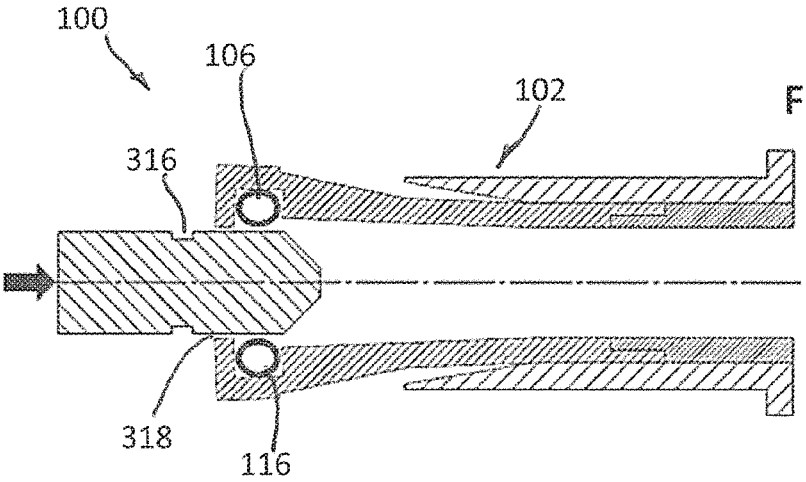
FIGS. 26, 26A, and 26B illustrate a connector assembly comprising a housing, a shaft and a canted coil spring, wherein the housing comprises two components and the assembly is shown in different stages of connect/disconnect.
Figure 26A:
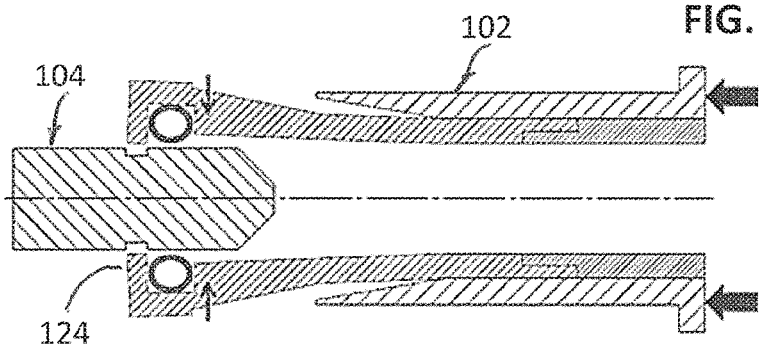
Figure 26B:
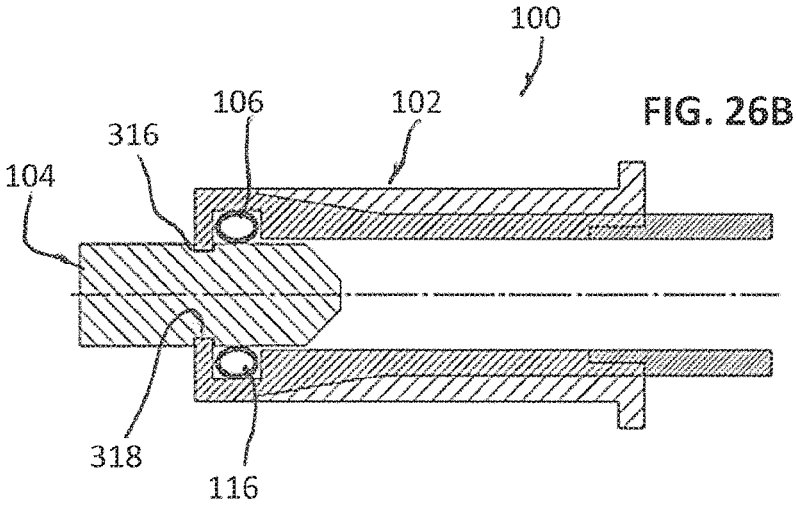

FIGS. 26-26B show a connector assembly 100 similar to the connector assembly presented in FIGS. 25-25B but wherein the first pin groove 150 is omitted and the spring 106, which can be a radial canted coil spring, is held in the housing groove 116 against a flat surface on the pin in a holding configuration, even when the housing is activated. However, other spring types, such as an axial canted coil spring, a ribbon spring, a V spring, etc. may also be used. It is also possible to use multiple springs in series. Securement from disconnection between the pin and the housing is provided by the ends of the inlet end wall 124 of the plurality of collapsible extending member 128 engaging the pin groove 316 on the pin.

Figure 27:
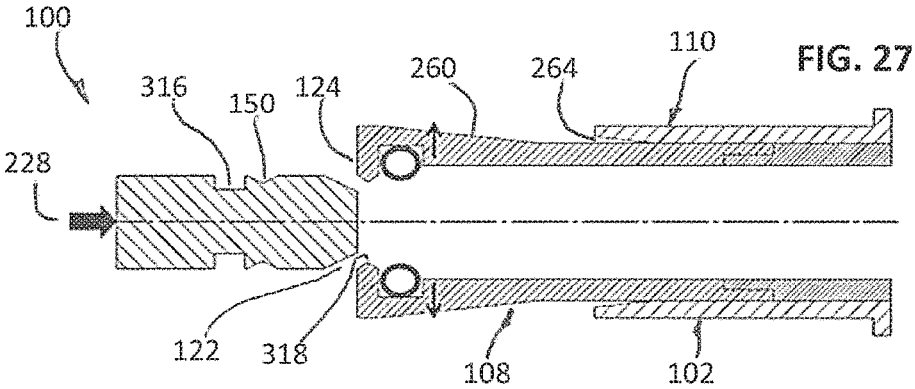
FIGS. 27, 27A, 27B, 27C, and 27D illustrate a connector assembly comprising a housing, a shaft and a canted coil spring, wherein the housing comprises two components and the assembly is shown in different stages of connect/disconnect.
Figure 27A:
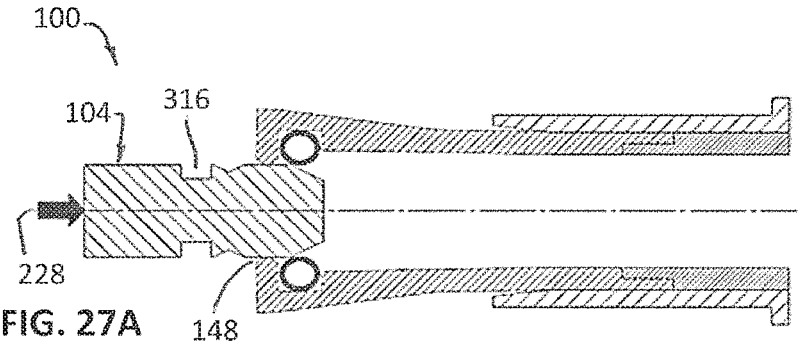
Figure 27B:
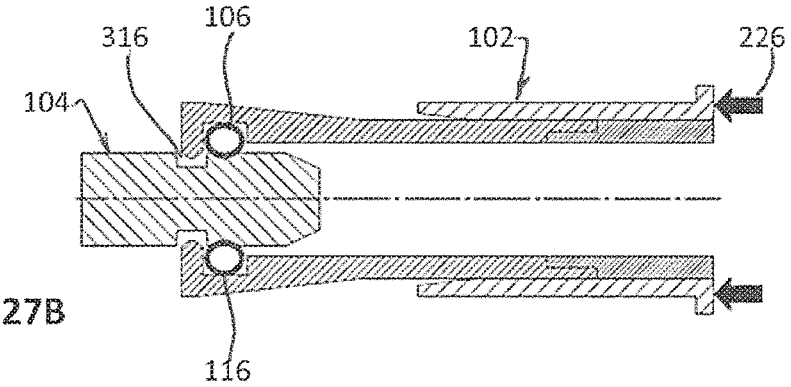
Figure 27C:
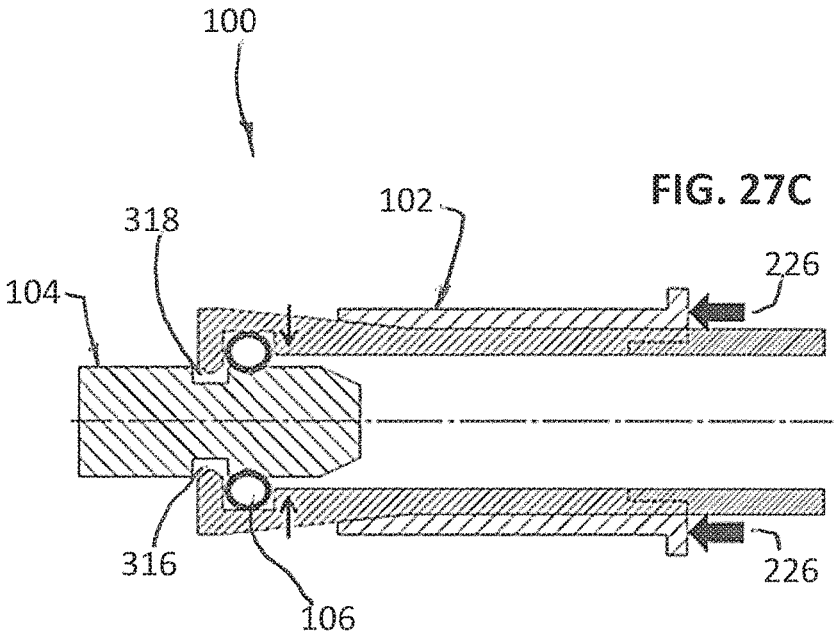
Figure 27D:
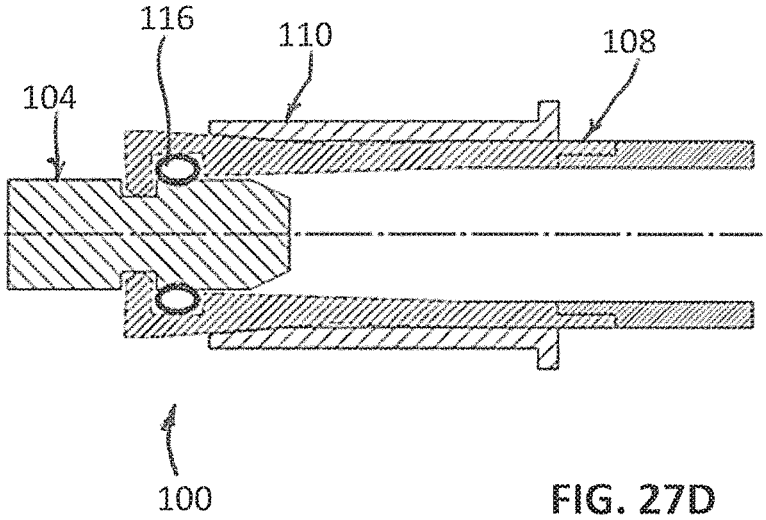
Figures 1, 27:
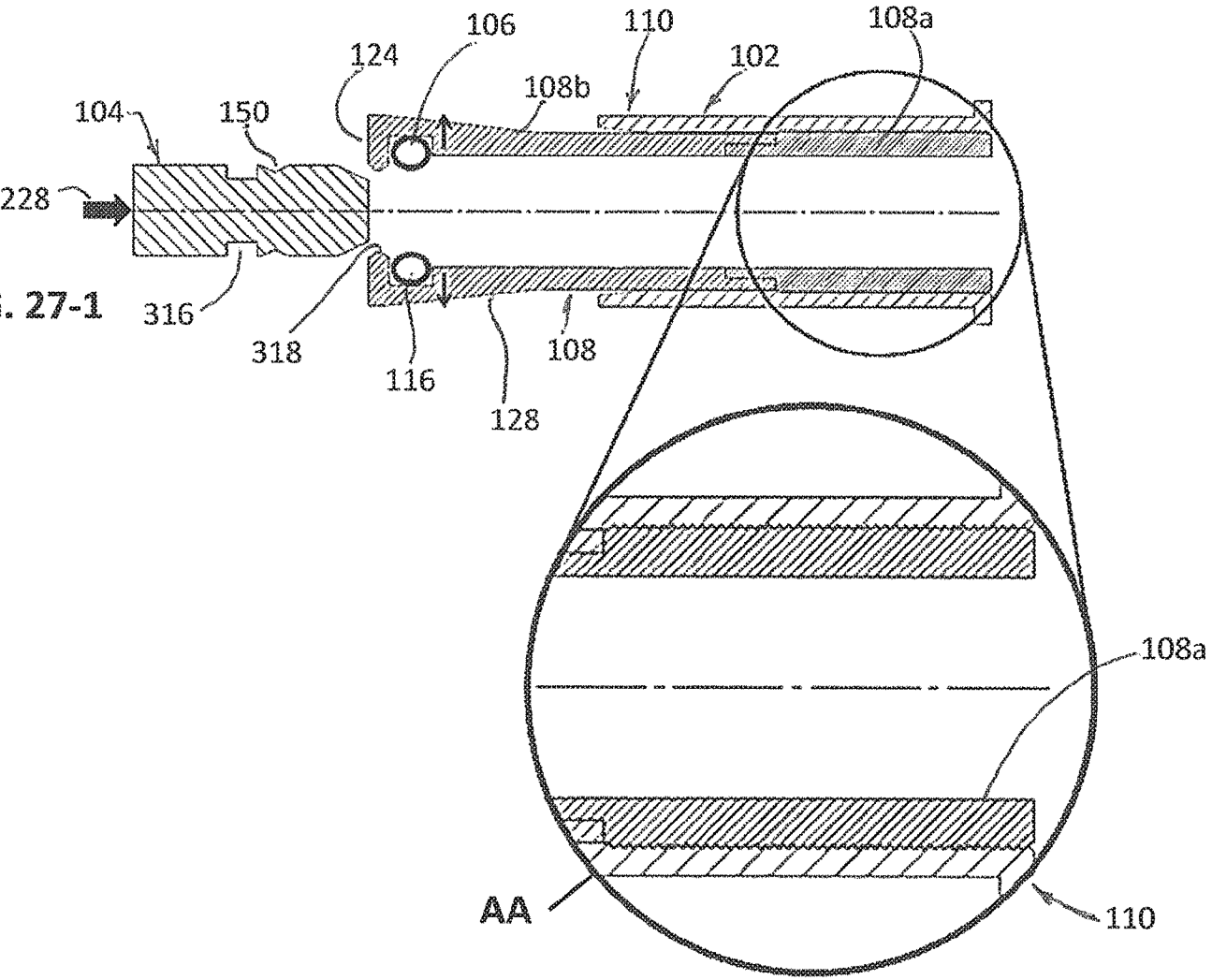
Figures 1A, 27:
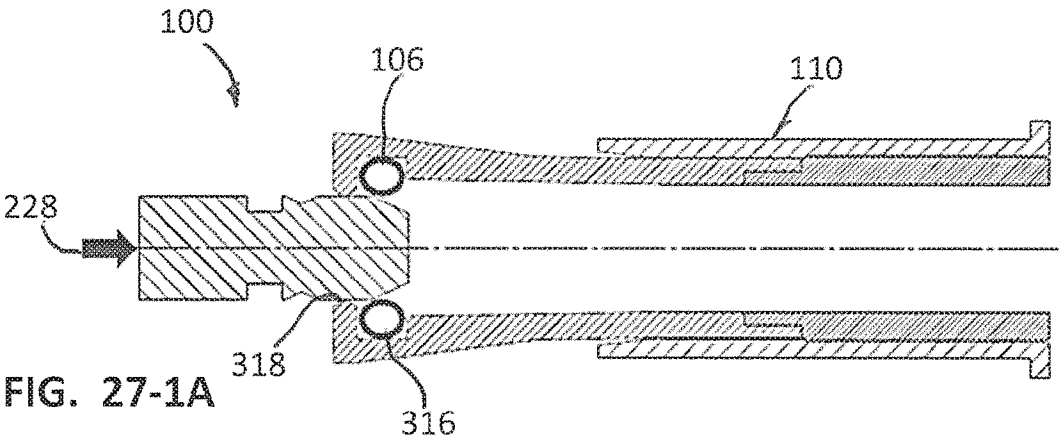
Figures 1B, 27:
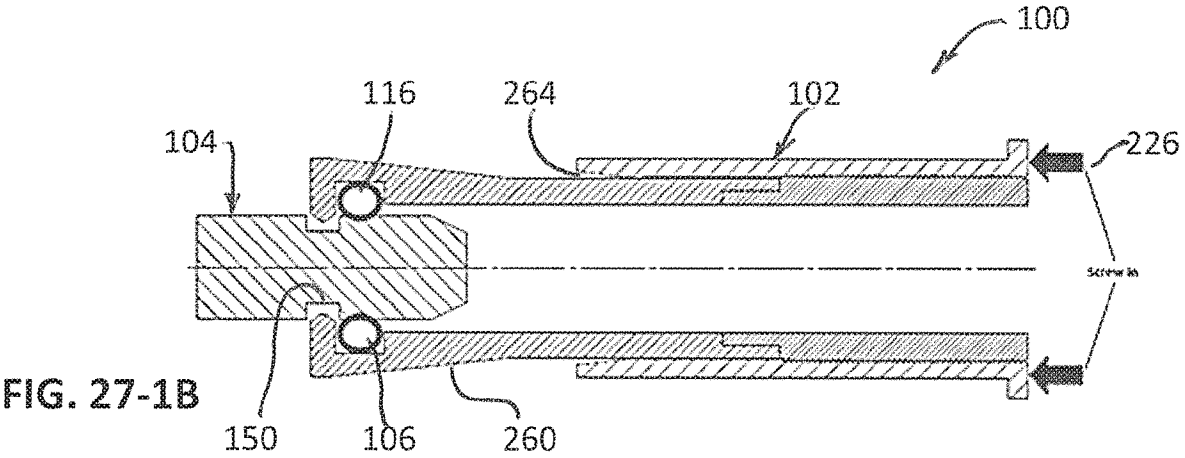
Figures 1C, 27:
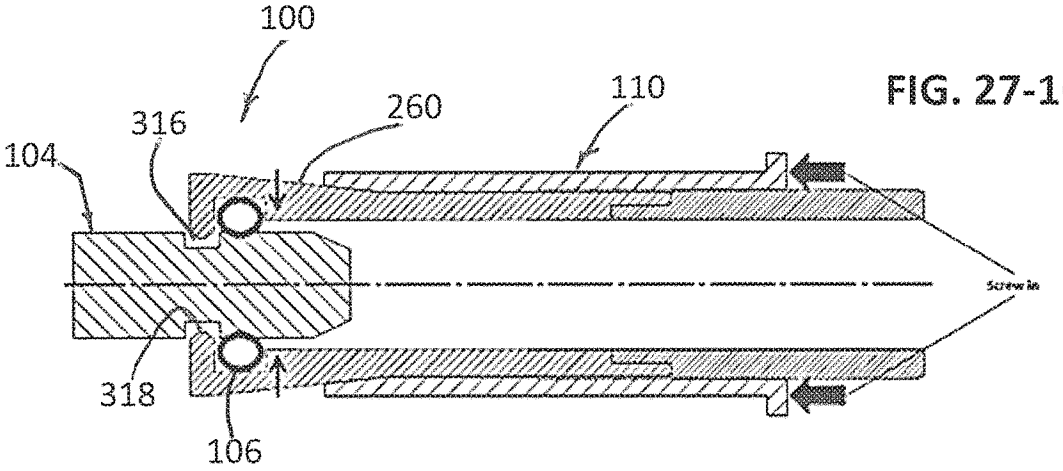
Figures 1D, 27:
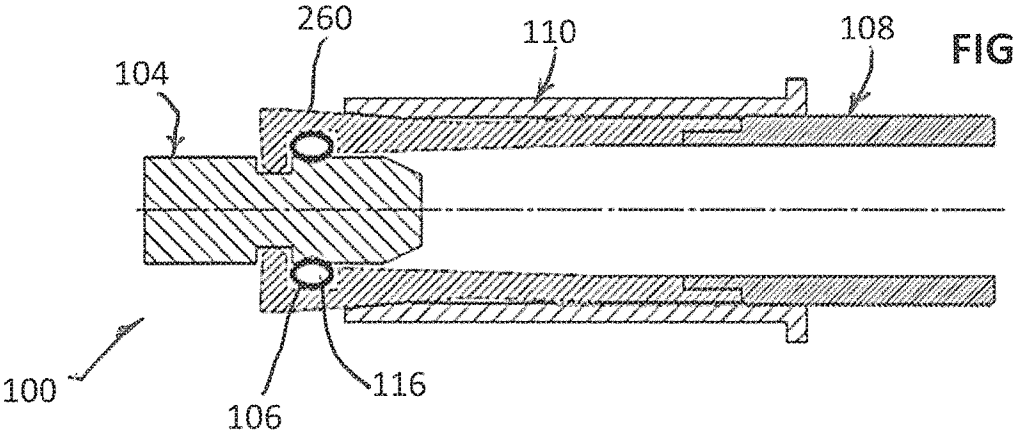

FIGS. 27-27D show a connector assembly 100 provided in accordance with another embodiment of the present device, system, and method, which comprises a housing 102 with a housing groove 116 and a pin 104 with a pin groove 150 and a retention pin groove 316. The pin groove 150 in the present embodiment can be V-shape. The housing further comprises a first housing component 108 and a second housing component 110. The first housing component 108 further comprises a first housing sub-component 108*a* and a second housing sub-component 108*b*. The second housing component 108*b* has a housing groove 116 formed therein and comprises a plurality of slits forming a plurality of collapsible members, similar to the connector of FIGS. 25-25B with a few exceptions.

In the present embodiment, the inlet end wall 124 is extended so that the inlet opening 122, defined by the end walls of the plurality of collapsible members 128 (See, e.g., FIGS. 1D and 1E), contacts the pin 104 with its tapered end edge 318. The tapered end edge 318 is configured to touch the pin when the housing is de-activated. From the transit state of FIG. 27, the pin 104 can further be inserted in the first direction 228 to latch the spring 106 in the common groove in the first latched state, as shown in FIG. 27B. In the transit state prior to the first latched state, as shown in FIG. 27A, the tapered end edge 318 is shown in contact with the landing area 148, which differs for the end wall shown in FIG. 25. Once at the first latched state, the connector can now move to the second latched state by activating the housing 102.

To activate the housing 102, the second housing component 110 is moved in the second direction 226 to push the tapered inlet bore 264 over the sloping contour portion 260 of the second sub-component 108*b*, as shown in FIG. 27C. From there, further advancement of the second housing component 110 in the second direction 226 further forces the tapered inlet bore 264 to squeeze the sloping contour portion 260 until the tapered end edge 318 of the end wall 124 bottoms out on the bottom wall of the second pin groove 316. At this point, the ends of the inlet end wall 124 of the plurality of collapsible extending member 128 are pushed into the second pin groove 316, as shown in FIG. 27D, and the connector is in the second latched state. The pin 104 is now held fixed to the housing 102 by the engagement between the inlet end wall 124 and the second pin groove 316, which is additional to the engagement of the spring 106 by the common groove in the second latched state, shown in FIG. 27D.

The spring type 106 shown in FIGS. 27-27D is a radial canted coil spring. However, other spring types, such as an axial canted coil spring, a ribbon spring, a V spring, etc. may also be used. It is also possible to use multiple springs in series.

FIGS. 27-1-27-1D show a connector assembly 100 provided in accordance with another embodiment of the present device, system, and method, which comprises a housing 102 with a housing groove 116 and a pin 104 with a pin groove 150 and a second or retention pin groove 316. The present connector assembly 100 is similar to the connector of FIGS. 27-27D with a few exceptions. In the present embodiment, the second housing component 110 is threaded to the first housing component 108. With reference to the enlarged view AA of FIG. 27-1, the second housing component 110 has internal threads and is threaded to the exterior threads formed on the first sub-component 108*a* of the first housing component 108. The threaded engagement allows for more precise control of the radial movement of the collapsible extending members 128, specifically the end edge 318 of the end wall, into the second pin groove 316 thus the deflection of the spring 106 into the first spring groove 150. Similarly, all connector assemblies disclosed herein may also have a threaded engagement between the housing components or between two movable pin components.

From the transit state of FIG. 27-1, the pin 104 can further be inserted in the first direction 228 to latch the spring 106 in the common groove in the first latched state, as shown in FIG. 27-1B. In the transit state prior to the first latched state, as shown in FIG. 27-1A, the tapered end edge 318 is shown in contact with the landing area 148. Once at the first latched state, the connector can now move to the second latched state by activating the housing 102.

To activate the housing 102, the second housing component 110 is rotated, clockwise or counter-clockwise depending on whether the threads are left-handed or right-handed threads, to advance the second housing component in the second direction 226. As the second housing component 110 is rotated, the tapered inlet bore 264 slowly advances over the sloping contour portion 260 of the second sub-component 108*b*, as shown in FIG. 27-1C. From there, further rotation of the second housing component 110 forces the tapered inlet bore 264 to squeeze the sloping contour portion 260 until the tapered end edge 318 of the end wall 124 bottoms out on the bottom wall of the second pin groove 316. At this point, the ends of the inlet end wall 124 of the plurality of collapsible extending member 128 are pushed into the second pin groove 316, as shown in FIG. 27-1D, and the connector is in the second latched state. The pin 104 is now held fixed to the housing 102 by the engagement between the inlet end wall 124 and the second pin groove 316, which is additional to the engagement of the spring 106 by the common groove in the second latched state, shown in FIG. 27-1D.

Figure 28:
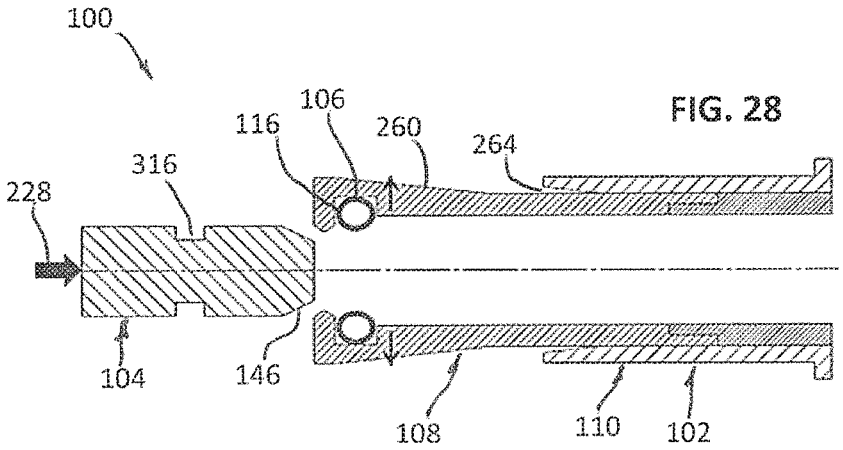
FIGS. 28, 28A, 28B, 28C, and 28D illustrate a connector assembly comprising a housing, a shaft and a canted coil spring, wherein the housing comprises two components and the assembly is shown in different stages of connect/disconnect.
Figure 28A:
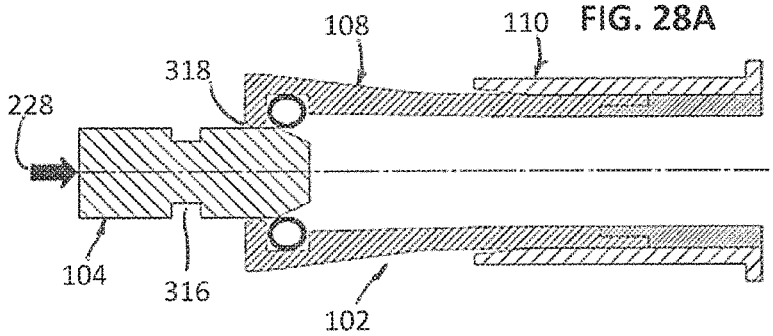
Figure 28B:
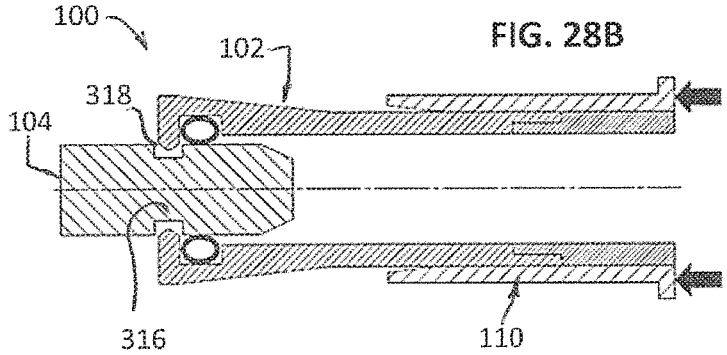
Figure 28C:
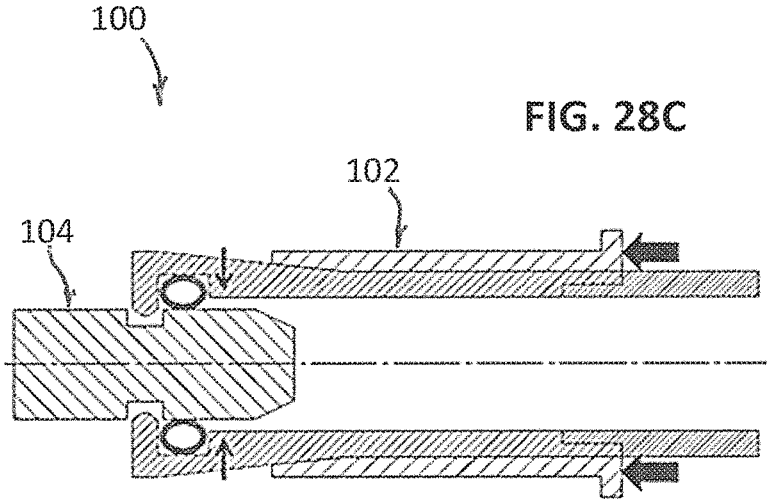
Figure 28D:
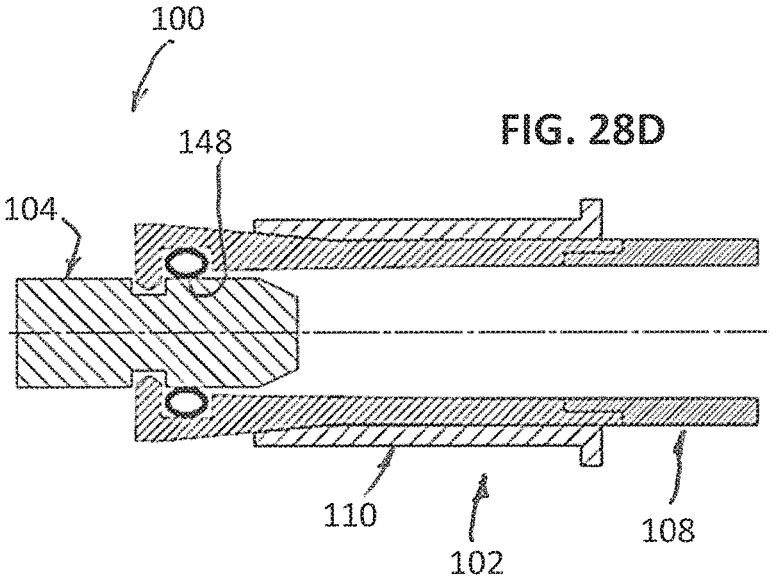

FIGS. 28-28D show a connector assembly 100 provided in accordance with another embodiment of the present device, system, and method, which comprises a housing 102 with a housing groove 116 and a pin 104 with a retention pin groove 316. The present connector assembly 100 is similar to the connector of FIGS. 27-27D with a few exceptions. In the present embodiment, the pin groove 150 for receiving the spring 106 in the first and second latched states has been omitted. In the connector activated position of FIG. 28D, the spring 106 is retained in the housing groove 116 and is pressed against the landing area 148 of the pin. Further, the second housing section 110 may be threaded to the first housing sub-component 108*a*, similar to the connector of FIGS. 27-1 to 27-1D.

Figure 29:
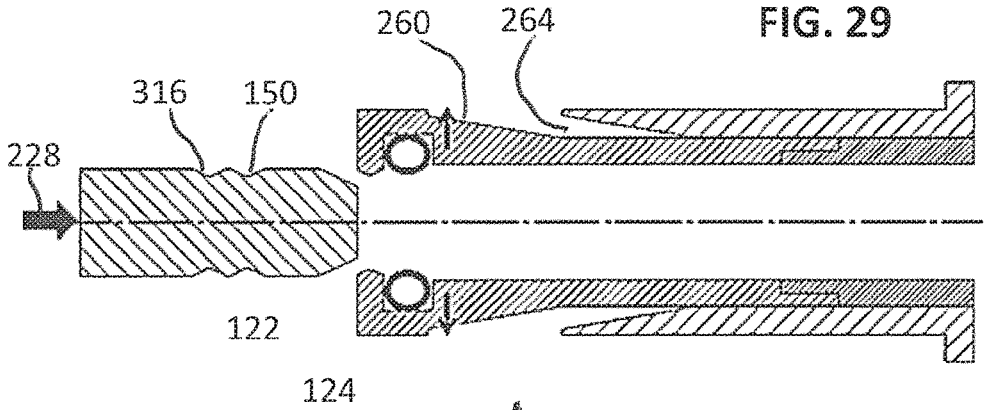
FIGS. 29, 29A, 29B, and 29C illustrate a connector assembly comprising a housing, a shaft and a canted coil spring, wherein the housing comprises two components and the assembly is shown in different stages of connect/disconnect.
Figure 29A:
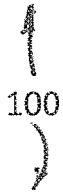
Figure 29A:
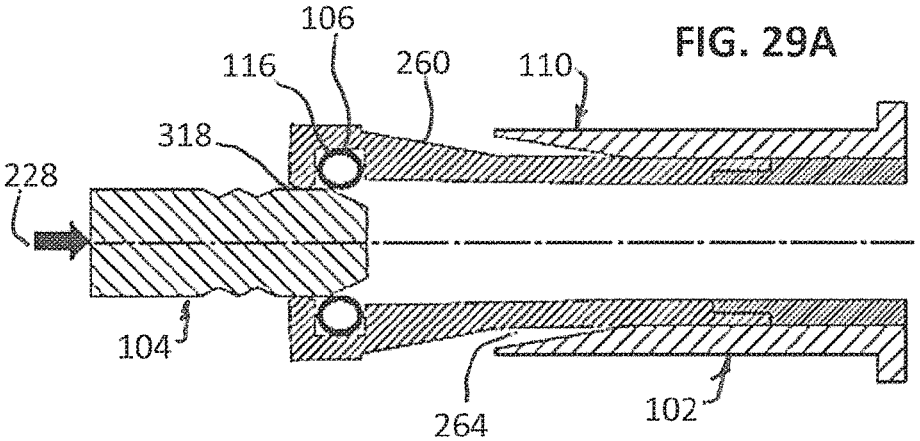
Figure 29B:
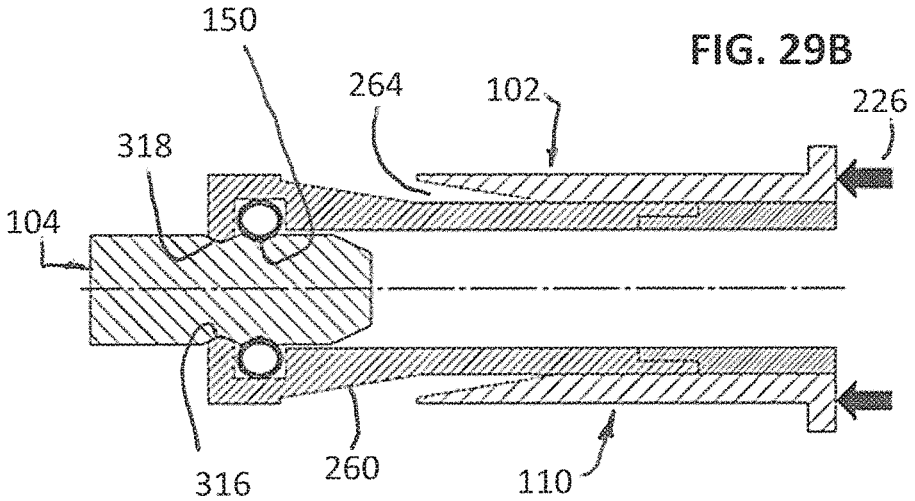
Figure 29C:
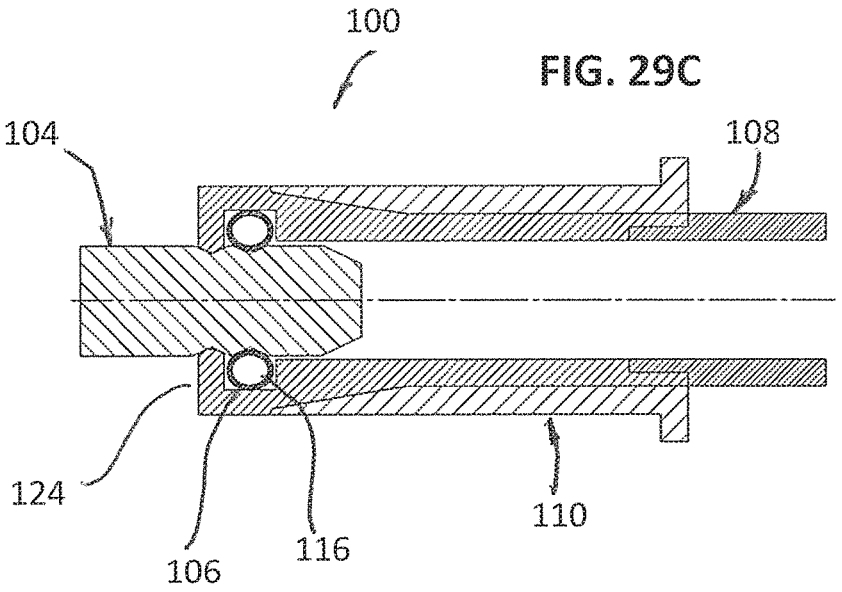

FIGS. 29-29C show a connector assembly 100 provided in accordance with another embodiment of the present device, system, and method, which comprises a housing 102 with a housing groove 116 and a pin 104 with a pin groove 150 and a second or retention pin groove 316. The present connector assembly 100 is similar to the connector of FIGS. 27-27D with a few exceptions. In the present embodiment, when the connector 100 is latched in the first latched state in which the spring 106 is held in the common groove defined by the housing groove 116 and the pin groove 150, as shown in FIG. 29B. The tapered end edge 318 is bottomed out against the retention pin groove 316, before the housing 102 is activated.

In the example shown, the retention groove 318 is contoured to match the shape of the end edge 318 of the end wall 124. Thus, the collapsible extending members 128 do not further deflect inwardly upon activation of the housing, as shown in FIG. 29C by moving the second housing component 110 in the second direction to move the tapered bore 264 over the elongated sloping body contour 260. Instead, in the second latched configuration, the second housing component 110 prevents the first housing component 108 from changing its configuration to allow for disconnection. Said differently, disconnection of the pin 104 from the housing 102 is permitted only if the collapsible members 128 are allowed to change their configuration, such as to deflect outwardly away from the lengthwise axis. In the present embodiment, the second housing component 110 prevents the collapsible members 128 from changing their configuration in the second latched state to prevent disconnection.

Figure 30:
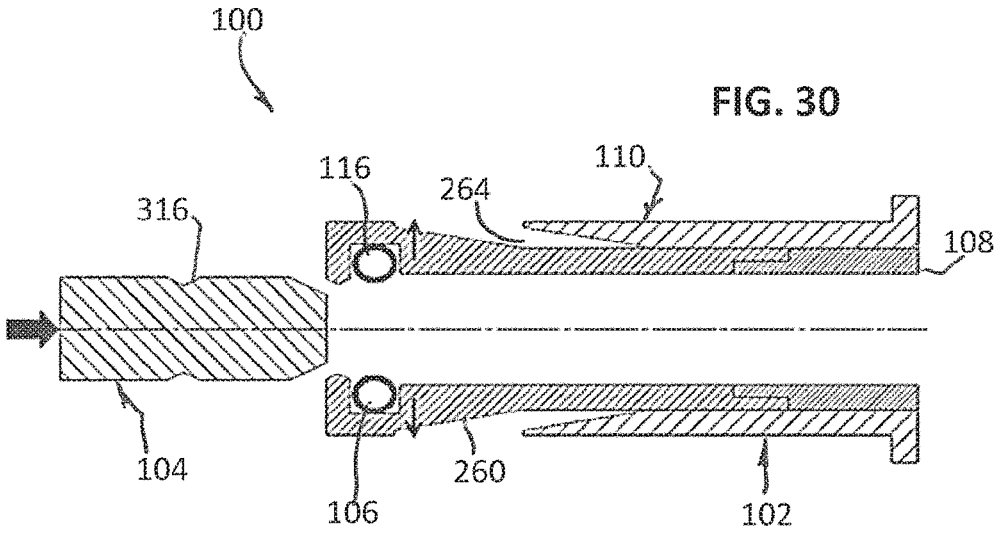
FIGS. 30, 30A, 30B, and 30C illustrate a connector assembly comprising a housing, a shaft and a canted coil spring, wherein the housing comprises two components and the assembly is shown in different stages of connect/disconnect.
Figure 30A:
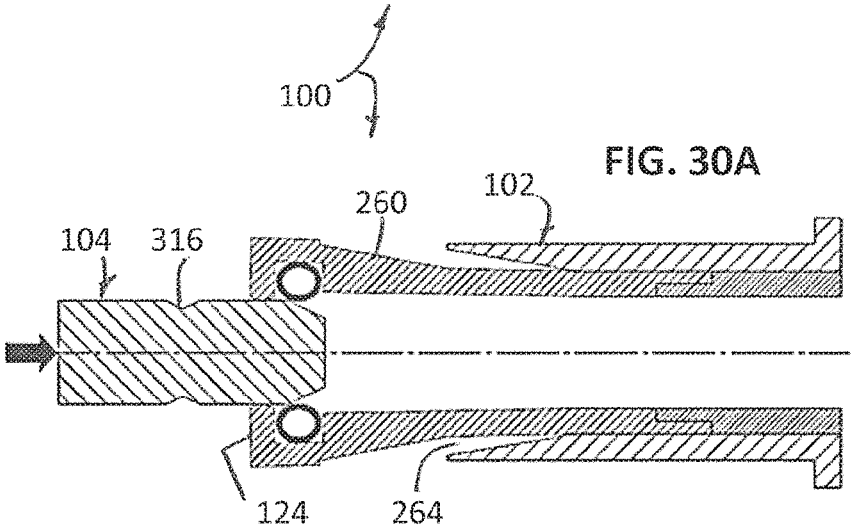
Figure 30B:
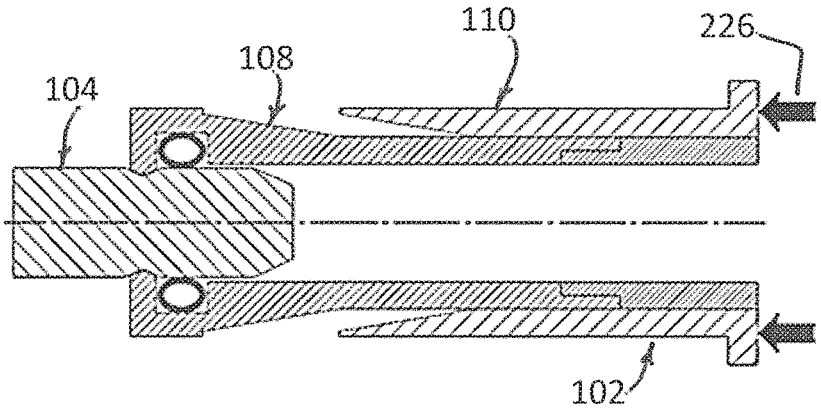
Figure 30C:
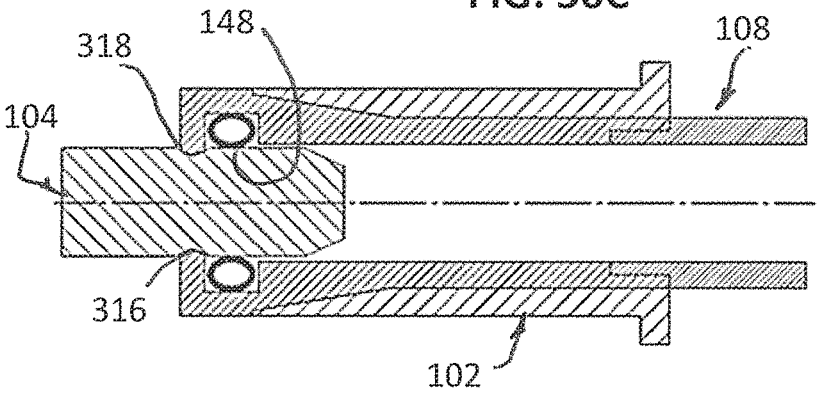

FIGS. 30-30C show a connector assembly 100 provided in accordance with another embodiment of the present device, system, and method, which comprises a housing 102 with a housing groove 116 and a pin 104 with a retention pin groove 316. The present connector assembly 100 is similar to the connector of FIGS. 29-29C with a few exceptions. In the present embodiment, the pin groove 150 for receiving the spring 106 in the first and second latched states has been omitted. In the connector activated position of FIG. 30C, the spring 106 is retained in the housing groove 116 and is pressed against the landing area 148 of the pin. Further, the second housing section 110 may be threaded to the first housing sub-component 108*a*, similar to the connector of FIGS. 27-1 to 27-1D.

Figure 31:
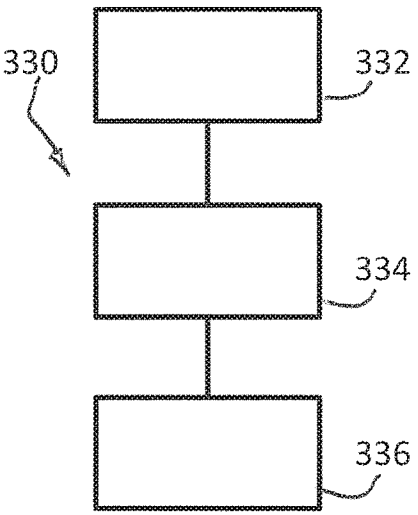
FIG. 31 illustrates process flow for connecting a connector assembly.

FIG. 31 is a schematic diagram showing a method for latching a connector assembly 330. In exemplary embodiments, the method comprises the step of inserting a pin into a bore of a housing at step 332. The housing can have a housing groove inside the bore, the pin can have a pin groove, or both. A spring can also be located in the pin groove or the housing groove. The spring can be a canted coil spring, a helical spring, a V-spring, or a helical spring. The method can further comprise the step of moving the pin inside the bore relative to the housing until the spring is captured by a common groove defined by the housing groove and the pin groove at step 334. At this position, the common groove can alter or change in size, such as to increase the depth, the width, or both the depth and the width of the housing groove, the common groove or both the housing groove and the common groove. This position in which the spring is latched in the common groove but the connector, such as the housing, has not activated so that the housing groove and/or the common groove can alter or change in size is referred to as a first latched position or state.

The method can still further comprise the step of activating the housing to move the connector to a second latched state at step 336. At the second latched state, the pin is latched to the housing and the common groove cannot alter or change in size by simply moving the pin relative to the housing. In some examples, the housing has a first housing component and a second housing component and wherein the two housing components move or slide relative to one another to activate the housing and move the connector to the second latched state. In other examples, the two housing components are rotated relative to one another to engage corresponding threads to activate the housing. In still other examples, collapsible members of the first housing component are constrained by the bore of the second housing component to activate the housing. In still other examples, part of the housing engages a retention groove on the pin to activate the housing. In yet other examples, additional springs or biasing members may be provided to constrain the relative movement between the first housing component and the second housing component. The additional springs or biasing members can be provided so that activating the housing requires greater force than de-activating the housing. Alternatively, the additional springs or biasing members can be provided so that activating the housing requires lower force than de-activating the housing.

Figure 32:
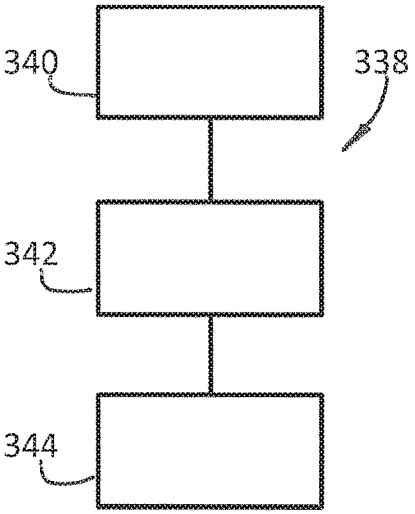
FIG. 32 illustrates a process flow for disconnecting a connector assembly.

FIG. 32 is a schematic diagram showing a method for unlatching a connector assembly 338. In exemplary embodiments, the method comprises the step of de-activating the connector at step 340. In some examples, de-activating the connector can comprise axially sliding two housing components relative to one another to widen the housing groove along an axial direction with reference to the lengthwise axis of the housing. This wider groove allows the spring to turn to enable the pin to retract away from the housing. In other examples, de-activating the connector can comprise axially sliding two housing components relative to one another so that collapsible housing sections on the inside housing component can deflect radially to allow the housing groove and/or the common groove to expand, such as to enlarge. This enlarged groove allows the spring to turn to enable the pin to retract away from the housing. Upon deactivating the housing, the connector is now at a first latched position at 342. At the first latched position, the spring is still located in the common groove defined by the housing groove and the pin groove but wherein the pin can retract away from the housing as the housing groove and/or the common groove can now deform or change in shape. At step 344, the pin is moved from the first latched position away from the housing to separate completely from the housing.

Figure 33:
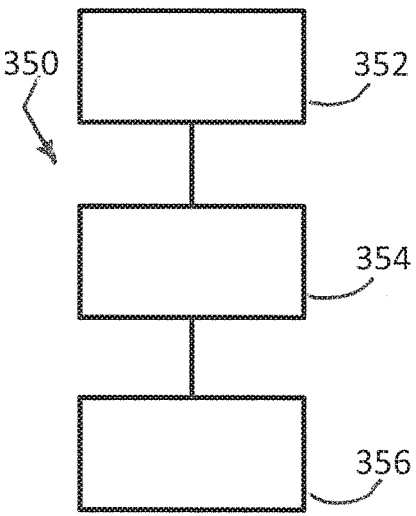
FIG. 33 illustrates a second process flow for connecting a connector assembly.

FIG. 33 is a schematic diagram showing another method for latching a connector assembly 350 provided in accordance with aspects of the present disclosure. In exemplary embodiments, the method comprises the step of inserting a pin into a bore of a housing at step 352. The housing can have a housing groove located in the bore, the pin can have a pin groove, or both. A spring can also be located in the pin groove or the housing groove. The spring can be a canted coil spring, a helical spring, a V-spring, or a helical spring. The method can further comprise the step of moving the pin inside the bore relative to the housing until the spring is captured by a common groove defined by the housing groove and the pin groove at step 354. At this position, the common groove can alter or change in size, such as to increase the depth, the width, or both the depth and the width of the pin groove, the common groove or both the pin groove and the common groove. This position in which the spring is latched in the common groove but the connector, such as the pin, has not activated so that the pin groove and/or the common groove can alter or change in size is referred to as a first latched position or state.

The method can still further comprise the step of activating the pin to move the connector to a second latched state at step 356. At the second latched state, the pin is latched to the housing and the common groove cannot alter or change in size by simply moving the pin relative to the housing. In some examples, the pin has a first pin component and a second pin component and wherein the two pin components move or slide relative to one another to activate the pin and move the connector to the second latched state. In other examples, the two pin components are rotated relative to one another to engage corresponding threads to activate the pin. In still other examples, collapsible members of the outside pin component are constrained by a solid inside pin component located in the bore of the outside pin component to activate the pin. In yet other examples, additional springs or biasing members may be provided to constrain relative movement between the first pin component and the second pin component. The additional springs or biasing members can be provided so that activating the pin requires greater force than de-activating the pin. Alternatively, the additional springs or biasing members can be provided so that activating the pin requires lower force than de-activating the pin.

Figure 34:
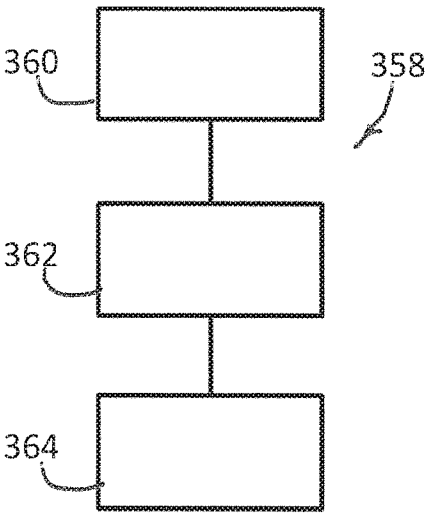
FIG. 34 illustrates a second process flow for disconnecting a connector assembly.

FIG. 34 is a schematic diagram showing an alternative method for unlatching a connector assembly 358. In exemplary embodiments, the method comprises the step of de-activating the connector at step 360. In some examples, de-activating the connector can comprise axially sliding two pin components relative to one another to allow the common groove to change in size, such as to grow larger or bigger. This larger groove allows the spring to turn to enable the pin to retract away from the housing. In other examples, de-activating the connector can comprise axially sliding two pin components relative to one another so that collapsible housing sections on the outside pin component can deflect radially to allow the pin groove and/or the common groove to expand, such as to enlarge. This enlarged groove allows the spring to turn to enable the pin to retract away from the housing. Upon deactivating the pin, the connector is now at a first latched position at 362. At the first latched position, the spring is still located in the common groove defined by the housing groove and the pin groove but wherein the pin can retract away from the housing as the pin groove and/or the common groove can now deform or change in shape. At step 364, the pin is moved from the first latched position away from the housing to separate completely from the housing.

Methods of making or forming connector assemblies are also within the scope of the present disclosure. The method can comprise forming or shaping various housing component and pin components discussed elsewhere herein.

Although limited embodiments of canted coil springs and connector assemblies and their components have been specifically described and illustrated herein, many modifications and variations will be apparent to those skilled in the art. For example, the various canted coil springs and connector assemblies may incorporate different metal claddings or different platings, may be used in different end applications, etc. For example, the connectors described with reference to 16A-16F may be used in any number of industries, including in aerospace, automotive, military defense, consumer electronics, oil and gas, etc. Furthermore, it is understood and contemplated that features specifically discussed for one canted coil spring and connector assembly embodiment may be adopted for inclusion with another canted coil spring and connector assembly embodiment, provided the functions are compatible. For example, while one connector is described with certain groove geometry and a certain spring ring, different groove geometries and different spring rings with different coil alternating patterns may be used that are described elsewhere herein. Accordingly, it is to be understood that the canted coil springs and connector assemblies and their components constructed according to principles of the disclosed device, system, and method may be embodied other than as specifically described herein. Still furthermore, where one feature of an embodiment is shown but not expressly described but the same or similar feature is shown and described in another embodiment, the disclosed part may be understood to describe or teach the same or similar feature in the other disclosed but not expressly described embodiment. The disclosure is therefore understood to teach a person of ordinary skill in the art the disclosed embodiments without having to repeat similar components in all embodiments. The disclosure is also defined in the following claims.

The invention claimed is:

1. A locking connector assembly comprising:

a shaft comprising a length and an outer surface with a shaft groove on the outer surface;

a first housing having a body, made from a metallic material, having an exterior surface, an inner surface defining a bore, an opening, and end surface, the opening being sized and shaped to receive a portion of the shaft inside the bore of the body, wherein said body having a housing groove on the inner surface and the housing groove is recessed from the end surface;

a canted coil spring comprising a plurality of coils located in the shaft groove and the housing groove and the plurality of coils abutting the shaft groove and the housing groove in a locked state to prevent unlocking of the connector assembly by preventing the shaft from separating from the first housing;

a second housing shaped to at least partially surround the exterior surface of the body of the first housing or an inner shaft shaped to project at least in part into the shaft;

wherein the housing groove and the shaft groove define a common groove in which the canted coil spring is located in the locked state;

wherein the canted coil spring is located in the common groove in the locked state when the shaft is moved in a first direction; and wherein the shaft is movable in a second direction opposite the first direction, after the first housing and the second housing move relative to one another, to separate the canted coil spring from the common groove.

2. The locking connector assembly according to claim 1, wherein the opening is cylindrical; and wherein the housing groove is a circumferential groove.

3. The locking connector assembly according to claim 2, wherein the shaft groove is a circumferential groove.

4. The locking connector assembly according to claim 3, wherein the second housing has a first position and a second position and wherein when the second housing is in the second position, the shaft is prevented from separating from the first housing.

5. The locking connector assembly according to claim 4, wherein when the housing is in the first position, the shaft is separable from the first housing.

6. The locking connector assembly according to claim 2, wherein a first end of the first housing with the end surface is radially deflectable.

7. The locking connector assembly according to claim 6, wherein the second housing has a structure to constrain the first end of the first housing from deflecting radially outward.

8. The locking connector assembly according to claim 1, wherein the second housing comprises a through bore having a constant diameter.

9. The locking connector assembly according to claim 1, wherein a first end of the first housing with the opening comprises a slit extending orthogonally relative to a medial plane of the housing groove.

10. The locking connector assembly according to claim 9, wherein the slit crosses through the housing groove.

11. A method of using a locking connector assembly comprising:

inserting a canted coil spring into an opening of a first housing such that the canted coil spring is located in a housing groove of the first housing, said canted coil spring comprising a plurality of coils and said first housing comprising a body having an exterior surface, an inner surface defining a bore having the housing groove, and a first shoulder;

inserting a shaft comprising a length, an outer surface, and a shaft groove on the outer surface in through the opening of the first housing and into the bore, the opening sized and shaped to receive a portion of the shaft;

coupling a second housing to the first housing, the second housing being shaped to at least partially surround the exterior surface of the body of the first housing and the second housing comprising a second shoulder;

wherein the canted coil spring is located between the first housing and the shaft and the plurality of coils abutting the shaft groove and the housing groove in a locked state and preventing unlocking of the connector assembly by preventing the shaft from separating from the first housing;

wherein the second shoulder of the second housing provides an abutting surface for the first shoulder of the first housing to prevent separation of the first housing from the second housing in a direction that the first and second shoulders abut;

wherein the housing groove and the shaft groove define a common groove in which the canted coil spring is located in the locked state;

wherein the canted coil spring is located in the common groove in the locked state when the shaft is moved in a first direction; and wherein the shaft is movable in a second direction opposite the first direction, after the first housing and the second housing move relative to one another, to separate the canted coil spring from the common groove.

12. The method according to claim 11, wherein the opening is cylindrical; and wherein the housing groove is a circumferential groove.

13. The method according to claim 12, wherein the shaft groove is a circumferential groove.

14. The method according to claim 13, wherein each coil of the plurality of coils of the canted coil spring has a major axis and a minor axis and wherein the canted coil spring is loaded closer to the major axes of the plurality of coils than to the minor axes of the plurality of coils to prevent the shaft from unlocking and separating from the first housing.

15. The method according to claim 12, wherein the first housing comprises a first end and a second end, said first end being closer to the housing groove than said second end, and wherein the first end of the first housing is radially deflectable.

16. The method according to claim 15, wherein the second housing has a first position and a second position, wherein movement of the second housing from the first position to the second position constrains the first end of the first housing from deflecting radially outward.

17. The method according to claim 11, wherein a first end of the first housing with the opening comprises a slit extending orthogonally relative to a medial plane of the housing groove.

18. The method according to claim 17, wherein the slit crosses through the housing groove.

19. The method according to claim 11, wherein the second housing is movable to prevent separation of the shaft from the first housing.

20. A locking connector assembly comprising:

a shaft comprising a length and an outer surface with a shaft groove on the outer surface and a tapered insertion end;

a first housing having a body with a plurality of independently movable sections, an exterior surface, an inner surface defining a bore, an opening, an end surface, and a shoulder, the opening being sized and shaped to receive a portion of the shaft;

a second housing coupled to the first housing, the second housing having an inner surface defining a bore, and a shoulder;

a canted coil spring comprising a plurality of coils located in a housing groove and the shaft groove and the plurality of coils abutting the shaft groove and the housing groove in a locked state to prevent unlocking of the connector assembly by preventing the shaft from separating from the first housing;

wherein the housing groove has a shape and wherein first housing and the second housing are movable relative to one another to change the shape of the housing groove.

21. The locking connector assembly of claim 20, wherein the shoulder of the second housing provides an abutting surface for the shoulder of the first housing to prevent separation of the first housing from the second housing in a direction that the two shoulders abut.

22. The locking connector assembly of claim 21, wherein the first housing comprises a plurality of spaced apart slits, and wherein each slit extends generally orthogonal to the end surface of the first housing.

23. The locking connector assembly of claim 20, wherein the second housing comprises an opening at a first end with a first dimension and an opening at a second end with a second dimension, and wherein the first dimension is larger than the second dimension.

24. The locking connector assembly of claim 20, wherein the housing groove comprises at least one of a bottom surface, a side wall, a tapered surface.

25. The locking connector assembly of claim 20, wherein the first housing and the second housing are concentric with one another and share a common axis.

26. The locking connector assembly of claim 20, wherein the housing groove is located at the plurality of independently movable sections of the first housing.

27. The locking connector assembly of claim 20, wherein the housing groove comprises a tapered bottom surface and a sidewall that is orthogonal to a lengthwise axis of the first housing.

* * * * *